US010952552B2

(12) United States Patent
Hernandez et al.

(10) Patent No.: US 10,952,552 B2
(45) Date of Patent: Mar. 23, 2021

(54) FRAME APPARATUS

(71) Applicant: MCS Industries, Inc., Easton, PA (US)

(72) Inventors: Luis Jaime Hernandez, El Paso, TX (US); Martin Zamorano Fragoso, Ciudad Juarez (MX); Michael Lee Pyle, Sugar Grove, IL (US); Robert Terry Coyle, Jr., Palmer, PA (US); Matthew Scott Kressin, Allentown, PA (US)

(73) Assignee: MCS Industries, Inc.

( * ) Notice: Subject to any disclaimer, the term of this patent is extended or adjusted under 35 U.S.C. 154(b) by 66 days.

(21) Appl. No.: 15/992,961

(22) Filed: May 30, 2018

(65) Prior Publication Data

US 2018/0271305 A1 Sep. 27, 2018

Related U.S. Application Data

(63) Continuation-in-part of application No. 15/481,822, filed on Apr. 7, 2017, now Pat. No. 10,143,315.

(Continued)

(51) Int. Cl.

*A47G 1/16* (2006.01)
*A47G 1/08* (2006.01)

(Continued)

(52) U.S. Cl.

CPC ..... *A47G 1/08* (2013.01); *A47G 1/0605* (2013.01); *A47G 1/16* (2013.01); *A47G 1/1626* (2013.01); *A47G 1/202* (2013.01)

(58) Field of Classification Search

CPC ..... A47G 1/1626; A47G 1/0611; A47G 1/08; A47G 1/06; A47G 1/202; A47G 1/10;

(Continued)

(56) References Cited

U.S. PATENT DOCUMENTS 1,202,321 A * 10/1916 Schleicher ..... A47G 1/08 40/741
1,209,582 A * 12/1916 Hoernegel ..... A47G 1/16 248/494

(Continued)

FOREIGN PATENT DOCUMENTS

DE 19900723 9/1999

OTHER PUBLICATIONS

Under the Roof Decorating, "How to Attach a Sawtooth Hook to a Frame" [online] (retrieved from the internet on Jul. 24, 2018) <URL http://www.utrdecorating.com/blog/how-to-attach-a sawtooth-hook-to-a-frame/>, Nov. 11, 2016 (Nov. 11, 2016); entire document, especially Figs. 1-2. US.

(Continued)

*Primary Examiner* — Nkeisha Smith
(74) *Attorney, Agent, or Firm* — Belles Katz LLC

(57) ABSTRACT

A frame apparatus for displaying an article. The frame apparatus includes a support structure having a frame and a backer panel. A plurality of slots are formed into the backer panel that include a first slot that is elongated along a first axis that is parallel to top and bottom edges of the support structure and a second slot that is elongated along a second axis that is parallel to lateral edges of the support structure. The frame apparatus also includes a hanging element for hanging the support structure from a support surface such as a wall. The hanging element is configured to be slidably coupled to the support structure such that the hanging element can slide back and forth within one of the slots while remaining coupled to the support structure. This structure enables the frame apparatus to be moved side-to-side along the support surface while hanging therefrom.

20 Claims, 59 Drawing Sheets

Related U.S. Application Data

(60) Provisional application No. 62/319,851, filed on Apr. 8, 2016, provisional application No. 62/513,752, filed on Jun. 1, 2017.

(51) Int. Cl.
*A47G 1/20* (2006.01)
*A47G 1/06* (2006.01)

(58) Field of Classification Search
CPC ..... A47G 1/0605; A47G 1/16; G09F 1/12; G09F 15/0012
USPC ..... 248/495–497, 466, 475.1, 477, 48, 317, 248/339, 468, 470, 471, 473, 476, 478, 248/480, 490, 489; 40/792, 761, 759, 40/741, 790, 791, 766
See application file for complete search history.

(56) References Cited

U.S. PATENT DOCUMENTS 2,262,287 A * 11/1941 Johnson ..... A47B 96/062 248/496
2,263,901 A * 11/1941 Olney ..... A47G 1/162 248/496
2,639,109 A * 5/1953 Hoag ..... A47G 1/162 248/497
2,668,032 A * 2/1954 Haefner ..... A47G 1/06 52/126.3
2,681,194 A * 6/1954 Halvorsen ..... A47G 1/1626 248/495
2,885,166 A * 5/1959 Lehni ..... G09F 1/12 248/490
3,265,339 A * 8/1966 Hushek ..... A47G 1/162 248/495
3,370,822 A * 2/1968 Miller ..... A61B 6/4283 248/476
3,924,307 A * 12/1975 Tate ..... A47G 1/0638 24/543
4,171,117 A 10/1979 Prochaska
4,216,597 A * 8/1980 Kocina ..... A47G 1/0605 248/496
4,420,138 A * 12/1983 Sobel ..... A47G 1/162 248/496
4,428,135 A * 1/1984 Sobel ..... A47G 1/162 40/782
4,458,873 A * 7/1984 Sutherland ..... A47G 1/162 206/499
RE31,799 E * 1/1985 Paskerian ..... A47G 1/06 248/489
4,531,315 A * 7/1985 Sobel ..... A47G 1/162 40/758
4,571,866 A * 2/1986 Cole ..... A47G 1/162 248/496
4,641,441 A 2/1987 Roth
4,645,165 A 2/1987 Raap
4,704,814 A 11/1987 Astolli
5,050,324 A * 9/1991 Casull ..... A47G 1/0605 40/767
5,303,895 A 4/1994 Hart
5,335,424 A 8/1994 Spangler
5,441,338 A 8/1995 Kane et al.
5,947,438 A 9/1999 Lemire
6,241,210 B1 6/2001 Brindisi
6,298,593 B1 10/2001 Vilims
6,527,244 B1 3/2003 Kamenstein et al.
6,634,127 B2 * 10/2003 Bauer ..... A47G 1/0605 40/759
6,962,016 B1 11/2005 Meyer
7,587,850 B2 9/2009 Vineyard
7,762,517 B1 7/2010 Leseman
8,397,411 B2 3/2013 Russo et al.
8,398,048 B2 * 3/2013 Popkin ..... A47G 1/20 248/475.1
8,458,943 B2 6/2013 Horne
9,279,538 B1 3/2016 Wening
9,801,478 B1 10/2017 Kressin et al.
10,143,315 B2 * 12/2018 Pyle ..... A47G 1/0605
2002/0046477 A1 * 4/2002 Bauer ..... A47G 1/0605 40/792
2000/0218839 10/2006 Vineyard
2006/0218839 A1 * 10/2006 Vineyard ..... A47G 1/06 40/796
2007/0051023 A1 3/2007 Bravo
2010/0011602 A1 1/2010 Houssian et al.
2013/0180142 A1 7/2013 Kressin et al.
2013/0247401 A1 9/2013 Miller
2014/0026456 A1 1/2014 Pirayesh et al.
2014/0231611 A1 8/2014 Svihilik

OTHER PUBLICATIONS

International Search Report for Corresponding Application No. PCT/US18/35122, dated Aug. 23, 2018. WO.

* cited by examiner

FRAME APPARATUS

CROSS-REFERENCE TO RELATED APPLICATIONS

The present application is a continuation in part of U.S. patent application Ser. No. 15/481,822, filed Apr. 7, 2017, which claims the benefit of U.S. Provisional Patent Application No. 62/319,851, filed Apr. 8, 2016. The present application also claims the benefit of U.S. Provisional Patent Application No. 62/513,752, filed Jun. 1, 2017. Each of the aforementioned applications is hereby incorporated by reference in its entirety.

FIELD OF THE INVENTION

The present invention relates generally to a frame apparatus that can be moved along a support surface without detaching it from the support surface.

BACKGROUND OF THE INVENTION

People often commemorate their achievements or memorialize particular life events by placing an article within a frame for display. Specifically, individuals may frame a diploma for hanging on a wall in their office space. Individuals may also frame various photographs for display throughout their home and offices spaces by either hanging such frames on the wall or allowing such frames to stand upright on a horizontal surface such as a desk or table. Furthermore, people often hang mirrors from a wall and there is a noted difficulty in hanging mirrors and frames from a wall in a level manner. Furthermore, once a frame is hung on a wall, it's location on the wall cannot be changed without relocating the hardware from which the frame is hanging, which results in an additional hole being put into the wall. Thus, a need exists for a frame apparatus having features that enable movement of the frame along the wall as well as helping consumers to hang the frame in a level manner.

BRIEF SUMMARY OF THE INVENTION

The present invention is directed to a frame apparatus for displaying an article. The frame apparatus includes a support structure having a frame and a backer panel. A plurality of slots are formed into the backer panel that include a first slot that is elongated along a first axis that is parallel to top and bottom edges of the support structure and a second slot that is elongated along a second axis that is parallel to lateral edges of the support structure. The frame apparatus also includes a hanging element for hanging the support structure from a support surface such as a wall. The hanging element is configured to be slidably coupled to the support structure such that the hanging element can slide back and forth within one of the slots while remaining coupled to the support structure. This structure enables the frame apparatus to be moved side-to-side along the support surface while hanging therefrom.

In one embodiment, the invention may be a frame apparatus for displaying an article, the frame apparatus comprising: a support structure comprising a rear surface; a plurality of slots located on the rear surface of the support structure, the plurality of slots comprising: at least one slot that is elongated along a first axis; and at least one slot that is elongated along a second axis that is perpendicular to the first axis; and at least one hanging element slidably coupled to the support structure within one of the at least one slots, the at least one hanging element comprising a mounting portion for hanging the support structure from a support surface.

In another embodiment, the invention may be a frame apparatus for displaying an article, the frame apparatus comprising: a support structure comprising a rear surface, a top edge, a bottom edge, a first lateral edge, and a second lateral edge; a plurality of slots located on the rear surface of the support structure, the plurality of slots comprising: at least one slot that is elongated along a first axis that is parallel to the top and bottom edges of the support structure; and at least one slot that is elongated along a second axis that is parallel to the first and second lateral edges of the support structure, the second axis being perpendicular to the first axis; and at least one hanging element slidably coupled to the support structure within one of the at least one slots, the at least one hanging element comprising a mounting portion for hanging the support structure from a support surface.

In yet another embodiment, the invention may be a frame apparatus for displaying an article, the frame apparatus comprising: a support structure comprising a frame and a backer panel, the backer panel forming at least a portion of a rear surface of the support structure; a plurality of slots in the backer panel, the plurality of slots comprising: at least one slot that is elongated along a first axis; and at least one slot that is elongated along a second axis that is perpendicular to the first axis; and at least one hanging element coupled to the support structure within one of the at least one slots and being slidable relative to the support structure along a respective one of the first and second axes, the at least one hanging element comprising a mounting portion that is spaced apart from the rear surface of the support structure to hang the support structure from a support surface.

In still another embodiment, the invention may be a frame apparatus for displaying an article, the frame apparatus comprising: a support structure comprising a frame and a backer panel, the backer panel forming at least a portion of a rear surface of the support structure; a plurality of slots in the backer panel, the plurality of slots comprising: at least one slot that is elongated along a first axis; and at least one slot that is elongated along a second axis that is perpendicular to the first axis; and wherein each of the plurality of slots comprises an upper edge having a plurality of spaced apart receiving notches, each of the receiving notches being configured to receive a portion of an article of hardware that is coupled to a support surface to hang the support structure from the support surface.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1A:
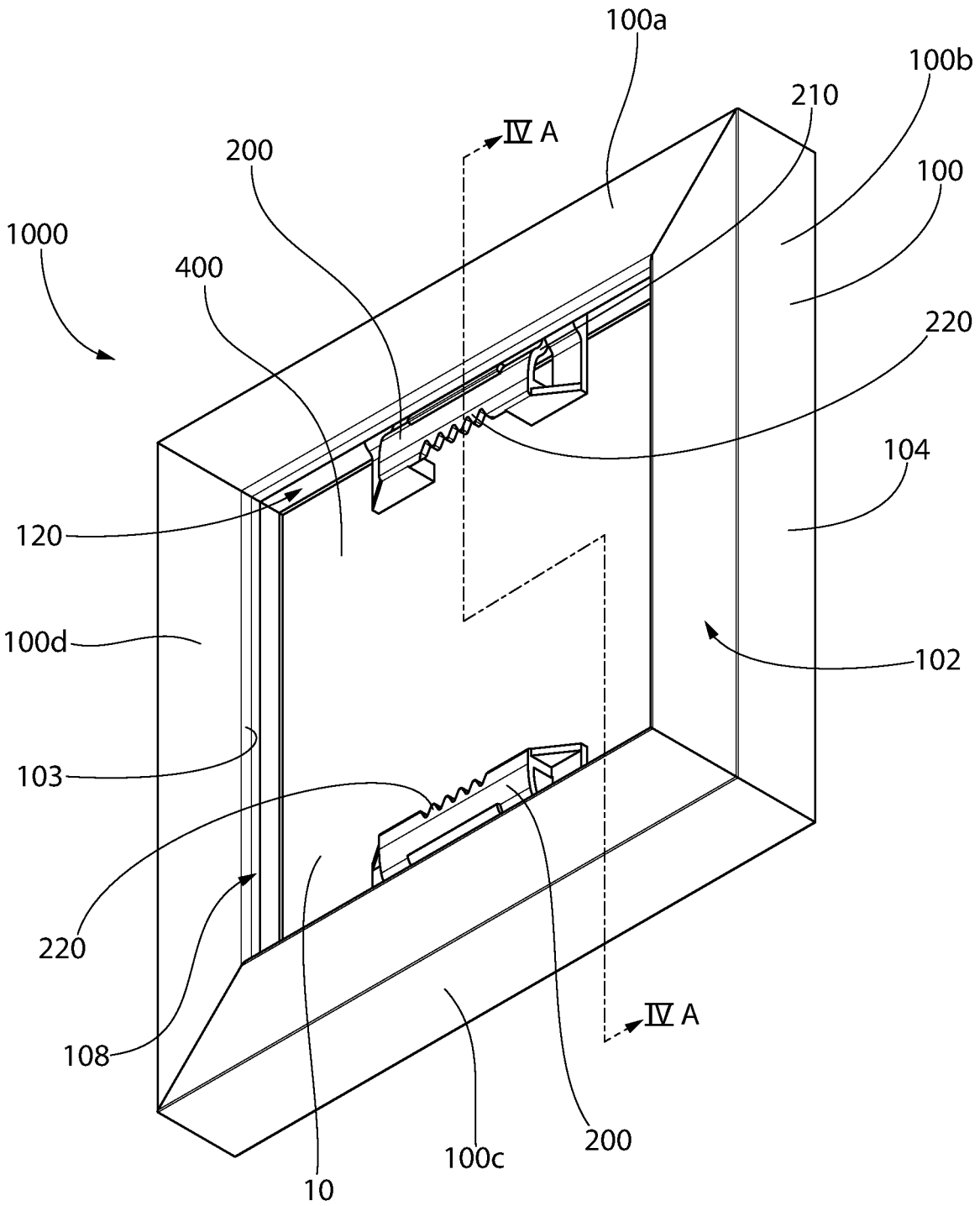
FIG. 1A is a rear perspective view of a frame apparatus having a frame and a clip member coupled thereto in accordance with an embodiment of the present invention.
Figure 1B:
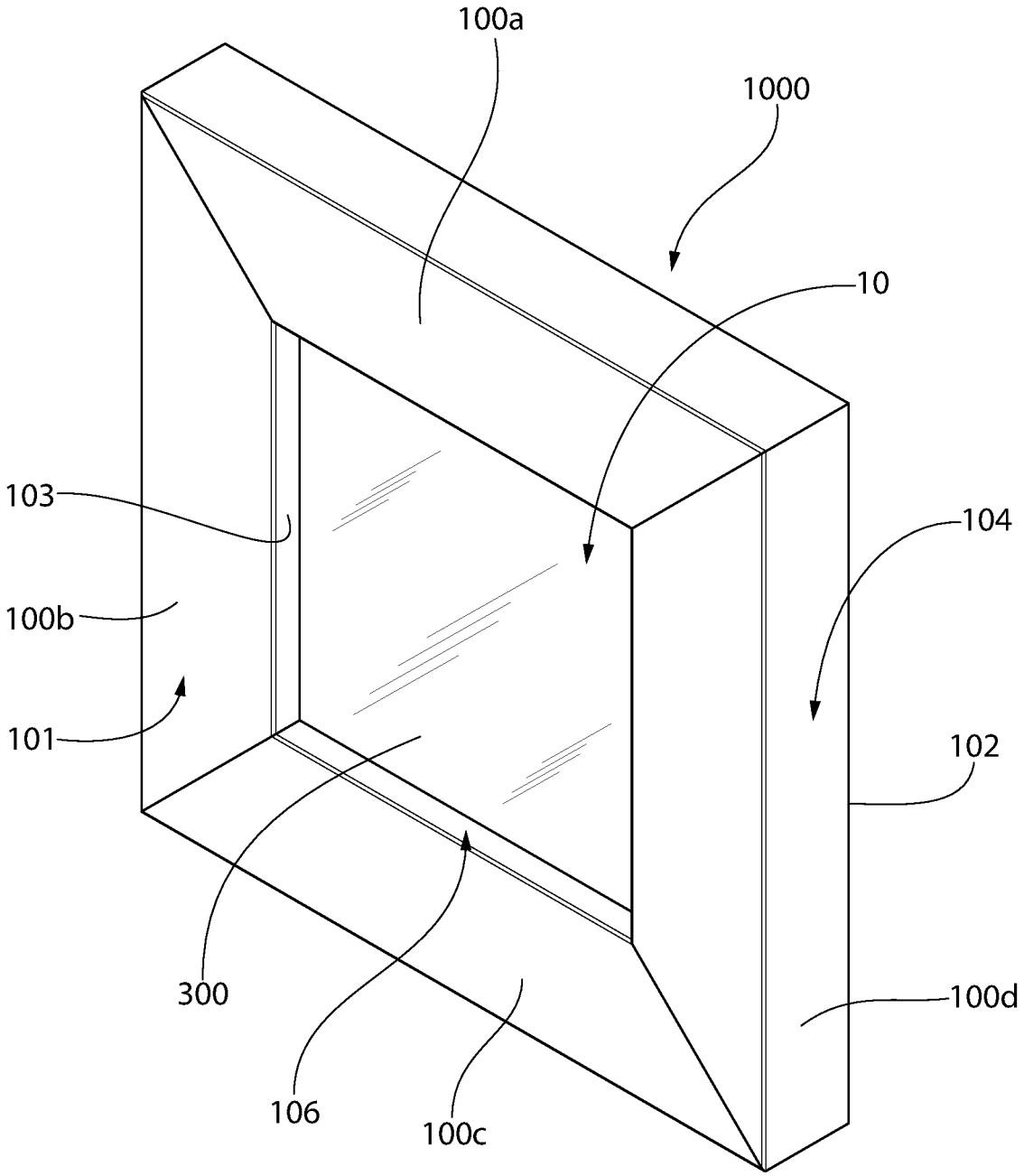
FIG. 1B is a front perspective view of the frame apparatus of FIG. 1A

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom"

as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIGS. 1A, 1B, 2, 4A, and 4B concurrently, a frame apparatus 1000 will be described in accordance with an embodiment of the present invention. The frame apparatus 1000 generally comprises a frame 100, a plurality of clip members 200, and a stack 10 that is intended to be framed by the frame 100. In the exemplified embodiment, the stack 10 comprises a glazing 300, a backer panel 400, and an article 500 that is being displayed by the frame 100. The stack 10 may also comprise additional components, such as a filler panel or the like, as may be needed to ensure that the stack 10 is sufficiently secured within the frame 100 to facilitate a consistent display of the article 500. Although the glazing 300 and the backer panel 400 are illustrated in the exemplified embodiment, these features are not necessary in all embodiments and may be omitted or replaced with similar structures. For example, in some embodiments the frame apparatus 1000 may include two glazings, one on the front and one on the rear that replaces the backer panel 400. Furthermore, the stack 10 may merely comprise the article 500 without the glazing 300 and the backer panel 400. Further still, in some embodiments the stack 10 may comprise a mirror.

The glazing 300 can be any type of material that is used as a protective and see-through covering for a framed article. In certain embodiments, the glazing 300 is a panel of glass, acrylic, plexiglass, polystyrene or other material that allows the article 500 to be viewed through the glazing 300. Thus, in certain embodiments the glazing 300 is formed of a substantially transparent material so that the article(s) 500 being framed therein are visible through the glazing 300. As used herein, the term "transparent" may include the presence of colored tint and thus is not limited to a clear material. In other embodiments, the glazing 300 may be at least partially translucent. In still other embodiments of the invention, the glazing 300 may be omitted from the frame apparatus 1000.

The backer panel 400 can be formed of hard or soft plastic materials, such as any of the thermoplastics including polymers and copolymers of ethylene, propylene (i.e., polypropylene), olefins, butadiene, vinyl compounds and polyesters. Alternatively, the backer panel 400 can be formed of a cardboard, wood, metal or other material as desired. In certain embodiments, the backer panel 400 may be a ring-like structure rather than a sheet-like structure. The backer panel 400 serves as a filler to ensure that the stack 10 adequately fills the rabbet 110 space so that the stack is securely held within the frame 100. The backer panel 400 also provides protection to the back/rear of the article 500 that is being framed.

In some embodiments, the frame apparatus 1000 may also include a filler panel between the backer panel 400 and the article 500. In such embodiments, the filler panel takes up space and reduces potential damage by adding a layer of protection for the article 500. The filler panel can also be used to provide the necessary thickness to the stack 10 to ensure adequate compression to hold the stack in the frame 100 as discussed herein below. The filler panel may be a sheet of corrugated material or other medium, such as a corrugated metal, corrugated cardboard, plastic, fiberboard (i.e., medium density fiberboard (MDF)) or the like. The filler panel can be included with the frame apparatus 1000 or omitted as desired. Furthermore, the backer panel 400 may be omitted in some embodiments as well.

The article 500 may be any object that is desired to be held by and displayed within the frame 100. Thus, the article 500 may be a flat article such as a poster or print having a design or indicia thereon. Alternatively, the article 500 may be a three-dimensional object that a person desires to frame for display. The article 500 may alternatively be a mirror that is surrounded by the frame 100. Thus, the article 500 may be any object that is conventionally framed by persons desiring to display that article.

Figure 2:
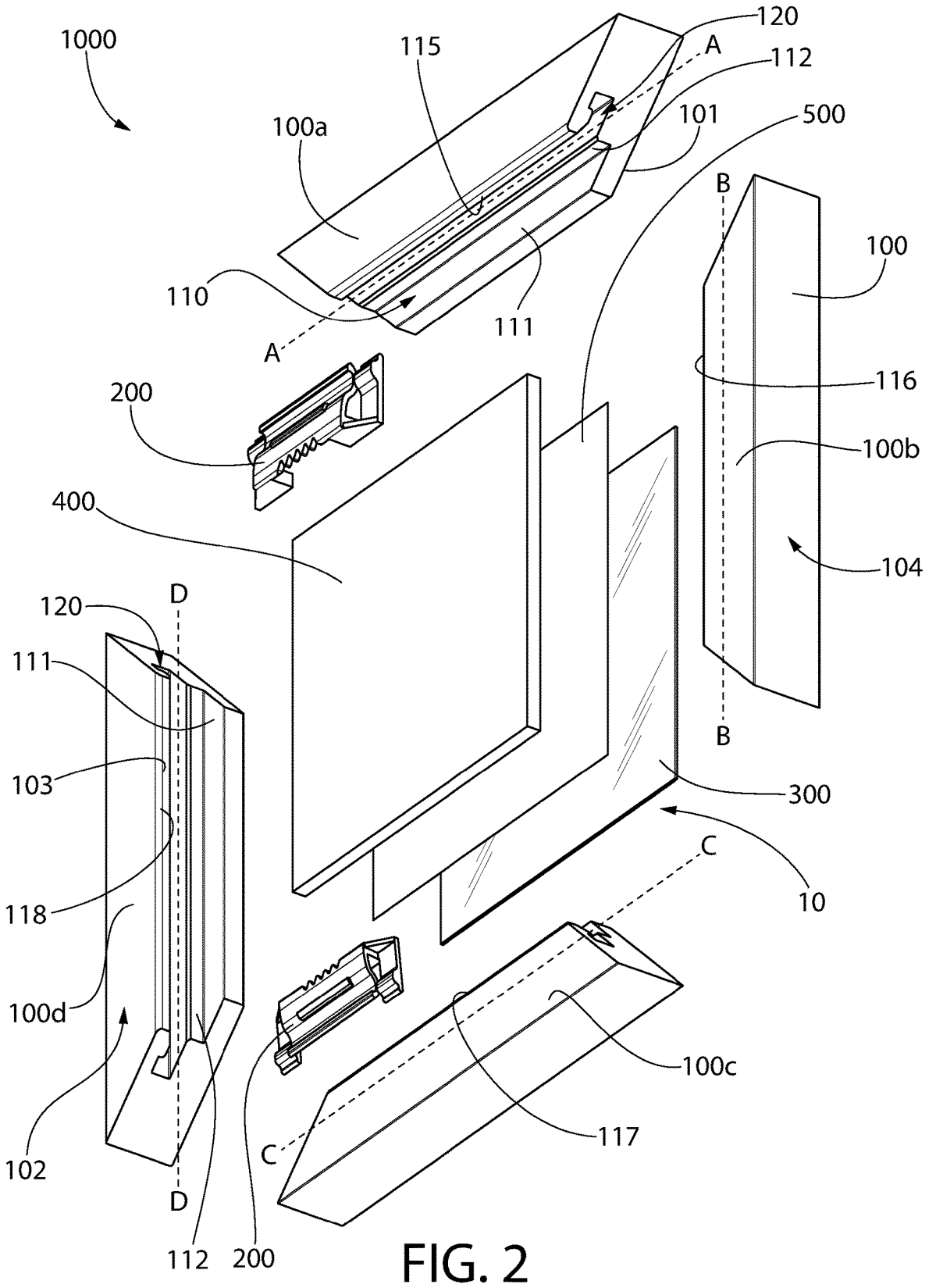
FIG. 2 is an exploded view of the frame apparatus of FIG. 1A.

In certain embodiments, the frame apparatus 1000 may be best suited for being hung from a vertical surface such as a wall. However, the invention is not intended to be so limited in all embodiments and it may be displayed in any manner currently used to display frames. In FIG. 2, the frame 100 is illustrated comprising four separate frame components 100*a-d* (a first frame component 100*a*, a second frame component 100*b*, a third frame component 100*c*, and a fourth frame component 100*d*) each having both of its opposing ends cut to approximately 45° so that when the frame components 100*a-d* are coupled together a miter joint is formed. Of course, the invention is not to be so limited and in other embodiments the frame 100 may comprise a single piece structure. In the exemplified embodiment, the frame 100 is square or rectangular shaped and has four side elements. Of course, the invention is not to be so limited and in other embodiments the frame may take on any desired shape, including triangular having three side elements, pentagonal having five side elements, hexagonal having six side elements, heptagonal having seven side elements, octagonal having eight side elements, and so forth. Thus, the inventive concepts described herein may be used with frames 100 having various shapes and sizes.

The frame 100 may be an integrally formed single component formed by injection molding, machining, milling, or the like. Alternatively, the frame 100 may be formed of an extruded polymer such as a general purpose polystyrene. In other embodiments the frame 100 may be co-extruded from expanded polystyrene such as polystyrene foam and a general purpose polystyrene. In other embodiments, the frame 100 but may also be formed of wood, medium-density fiberboard, metal, metal alloys, plastics, rubbers, or combinations thereof, etc. Thus, the invention is not to be limited by the material used to form the frame unless expressly stated otherwise herein.

Figure 10:
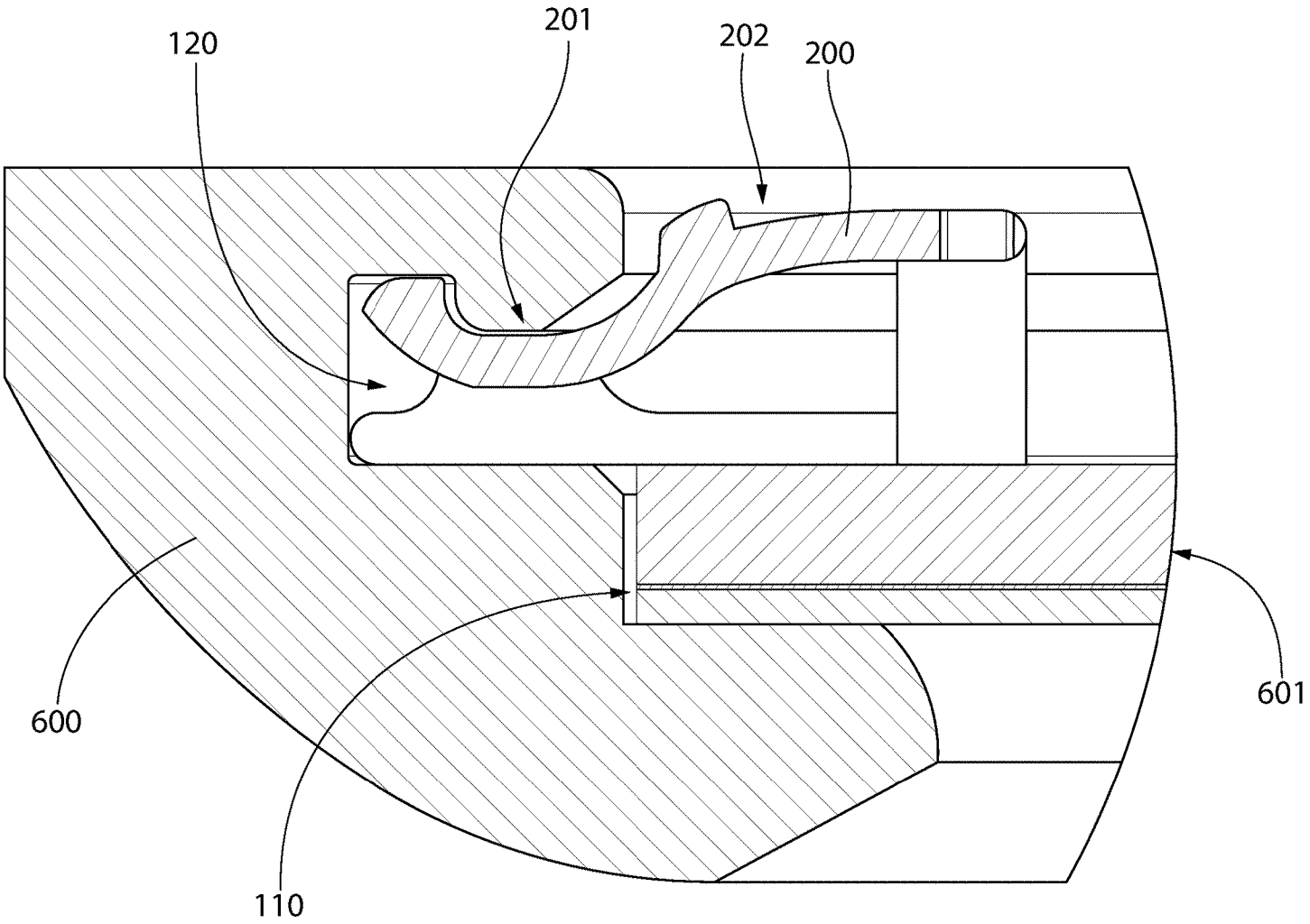
FIG. 10 is a close-up cross-sectional view taken along line IVB of FIG. 4A illustrating an alternative profile for the frame.

The frame 100 generally comprises a front surface 101, a rear surface 102, an inner surface 103 extending between the front and rear surfaces 101, 102, and an outer surface 104 extending between the front and rear surfaces 101, 102. The inner surface 103 of the frame 100 defines a display opening 106 for the frame 100 adjacent the front surface 101 of the frame 100 through which the article 500 can be viewed. The rear surface 102 of the frame 100 is the surface that is adjacent to a wall when the frame 100 is hung from the wall and the front surface 101 of the frame 100 is the surface that is exposed for viewing by a viewer. The front surface 101 and the outer surface 104 of the frame 100, which are exposed to a viewer, may take on any desired shape or profile to create a desired aesthetic. Thus, the front surface 101 and the outer surface 104 may be flat and planar as illustrated in FIGS. 1A-2 or they may be rounded, contoured, sculpted or profiled in a specific manner, or the like (one alternative example is illustrated in FIG. 10).

As will be discussed in greater detail below, the frame 100 has a rabbet 110 formed into the inner edge 103. The rabbet 110 is defined by a floor 111 and a wall 112 of the frame 100 that extends from the floor 111 to the rear surface 102 of the frame 100. The floor 111 of the rabbet 110 is recessed from the front surface 101 of the frame 100. The rabbet 110 forms a ledge onto which the glazing 300, the article 500, and the backer panel 400 (collectively referred to herein as the stack 10) are positioned or nested in the fully assembled frame apparatus 1000. Specifically, the rabbet 110 forms an annular ledge upon which the stack 10 may be positioned to frame the stack 10 (and particularly the article 500 thereof). The term "annular" as used herein does not refer specifically to a circular shape, but refers to a ring-like structure forming a closed geometry regardless of the specific shape of the ring, whether it is circular, square, rectangular, or other geometric forms. Furthermore, the term "annular" may also include a discontinuous ring-like structure of various shapes and thus the floor 111 and the ledge formed thereby need not be continuous in its extension in all embodiments.

The stack 10 has a front surface 11 and an opposite rear surface 12. The front surface 11 of the stack 10 is exposed through the display opening 106 and the rear surface 12 of the stack 10 is not exposed when the frame 100 is hung from a wall or other surface. In the exemplified embodiment, the glazing 300 forms the front surface 11 of the stack 10 and the backer panel 400 forms the rear surface 12 of the stack 10. Of course, depending on the specific components that make up the stack 10, this may be different in other embodiments. To assemble the frame apparatus 1000, a perimeter portion of the glazing 300 is positioned directly atop the floor surface 111 of the rabbet 110, and then the article 500 is positioned atop the glazing 300 and the backer panel 400 is positioned atop the article 500.

In the exemplified embodiment, the components of the stack 10 are inserted into the rabbet 10 via an opening 108 in the rear surface 102 of the frame 100. Thus, the frame 100 in the exemplified embodiment is a rear mounted frame, meaning that the article 500 (and the stack 10 generally) is mounted by inserting it through the opening 108 in the rear surface 102 of the frame 100. The invention is not to be so limited in all embodiments and it is possible that in an alternative embodiment a frame using a front mount assembly may be used in accordance with the teachings set forth herein. In the exemplified embodiment, the opening 108 in the rear surface 102 of the frame 100 is larger in at least one dimension than the display opening 106 in the front surface 101 of the frame. Thus, the stack 10 is prevented from passing into and through the display opening 106 by the floor 111 of the rabbet 110.

As seen in FIG. 2, each frame component 100*a-d* of the frame 100 has a portion of the rabbet 110 formed therein. When the frame components 100*a-d* are coupled together as described herein, the rabbets 110 of each frame component 100*a-d* are aligned with one another to form the rabbet 110 of the frame 100. The rabbet 110 of the frame 100 in its fully assembled state circumscribes the display opening 106.

The frame 100 also comprises a channel 120 formed into the wall 112 of the rabbet 110. The channel 120 is formed by an elongated notch or cutout in the wall 112 of the rabbet 110. Similar to the rabbet 110, the channel 120 is formed into each frame component 100*a-d*, and when the frame components 100*a-d* are coupled together to form the frame 100, a single continuous channel 120 is formed that circumscribes the display opening 106. In the exemplified embodiment, the channel 120 extends the entire length of the rabbet 110 within each of the frame components 100*a-d*, and thus the channel 120 is a closed geometry channel. Of course, the invention is not to be so limited in all embodiments and the channel 120 may only extend part of the length of the rabbet 110 in other embodiments. The channel 120 is defined by a top surface 121, a bottom surface 123, and a sidewall surface 122 extending between the top and bottom surfaces 121, 123. In the exemplified embodiment, the top and bottom surfaces 121, 123 of the channel 120 are parallel to each other and to the floor 111 of the rabbet 110 whereas the sidewall surface 122 of the channel 120 is parallel to the wall 112 of the rabbet 110.

The frame 100 comprises a protrusion 124 extending from the top surface 121 and into the channel 120 towards the bottom surface 123. In the exemplified embodiment, the protrusion 124 extends along the entirety of the length of the channel 120. The protrusion 124 has a leading edge 130 adjacent the inner surface 103 of the frame 100 and an opposite trailing edge 131. The leading edge 130 comprises a chamfer 125 that interacts with the clip member 200 during coupling of the clip member 200 to the frame 100 as described herein below. The trailing edge 131 is spaced apart from the sidewall surface 122 of the channel 120 by a gap 126 that forms a pocket for mounting of the clip member 200 to the frame 100 as described in more detail below. Once installed, the clip member 200 interacts with/engages the trailing edge 131 of the protrusion 124 to maintain the coupling between the clip member 200 and the frame 100.

The inner edge 103 of the frame 100 comprises a first inner edge portion 115 formed into the first frame component 100*a* of the frame 100, a second inner edge portion 116 formed into the second frame component 100*b* of the frame 100, a third inner edge portion 117 formed into the third frame component 100*c* of the frame 100, and a fourth inner edge portion 118 formed into the fourth frame component 100*d* of the frame 100. When the frame 100 is formed of a single piece rather than separate components, the different inner edge portions noted above are simply the upper, lower, left-side, and right-side inner edge portions. The first inner edge portion 115 comprises a first linear section of the channel 120 that extends along a first axis A-A. The second inner edge portion 116 comprises a second linear section of the channel 120 that extends along a second axis B-B. The third inner edge portion 117 comprises a third linear section of the channel 120 that extends along a third axis C-C. The fourth inner edge portion 118 comprises a fourth linear section of the channel 120 that extends along a fourth axis D-D. These sections of the channel 120 and axes will be used later to describe the slidability of the clip member 200 when the clip member 200 is coupled or mounted to the frame 100 within the channel 120.

During assembly of the frame apparatus 1000, the clip members 200 are coupled to the frame 100 after the stack 10 is positioned in the rabbet 110. This is because the clip members 200 are used to secure/retain the stack 10 within the rabbet 110 in place of turn buttons, flex tabs, or other components that are generally used for this purpose. Each of the clip members 200 is coupled to the frame 100 within one of the linear sections of the channel 120 while permitting the clip members 200 to be slidable within that linear section of the channel 120 along its axis A-A, B-B, C-C, D-D. Thus, the clip members 200 can slide side-to-side within the linear section of the channel 120 that they are coupled to, which helps with hanging the frame 100 in a level manner as discussed below.

As discussed in more detail herein below, the clip members 200 secure the stack 10 within the rabbet 110 by sandwiching the stack 10 between the floor 111 of the rabbet 110 and the clip members 200. Furthermore, the clip members 200 comprise a hanging feature 220 for hanging the frame 100 from a desired surface, such as a wall. The clip members 200 are configured to slide within the channel 120 along one of the axes A-A-, B-B, C-C, D-D (the one that corresponds to the linear section of the channel 120 that the clip member 200 is mounted to) to function as a self-leveling feature to ensure that the frame 100 is hung at a desired orientation.

Figure 3A:
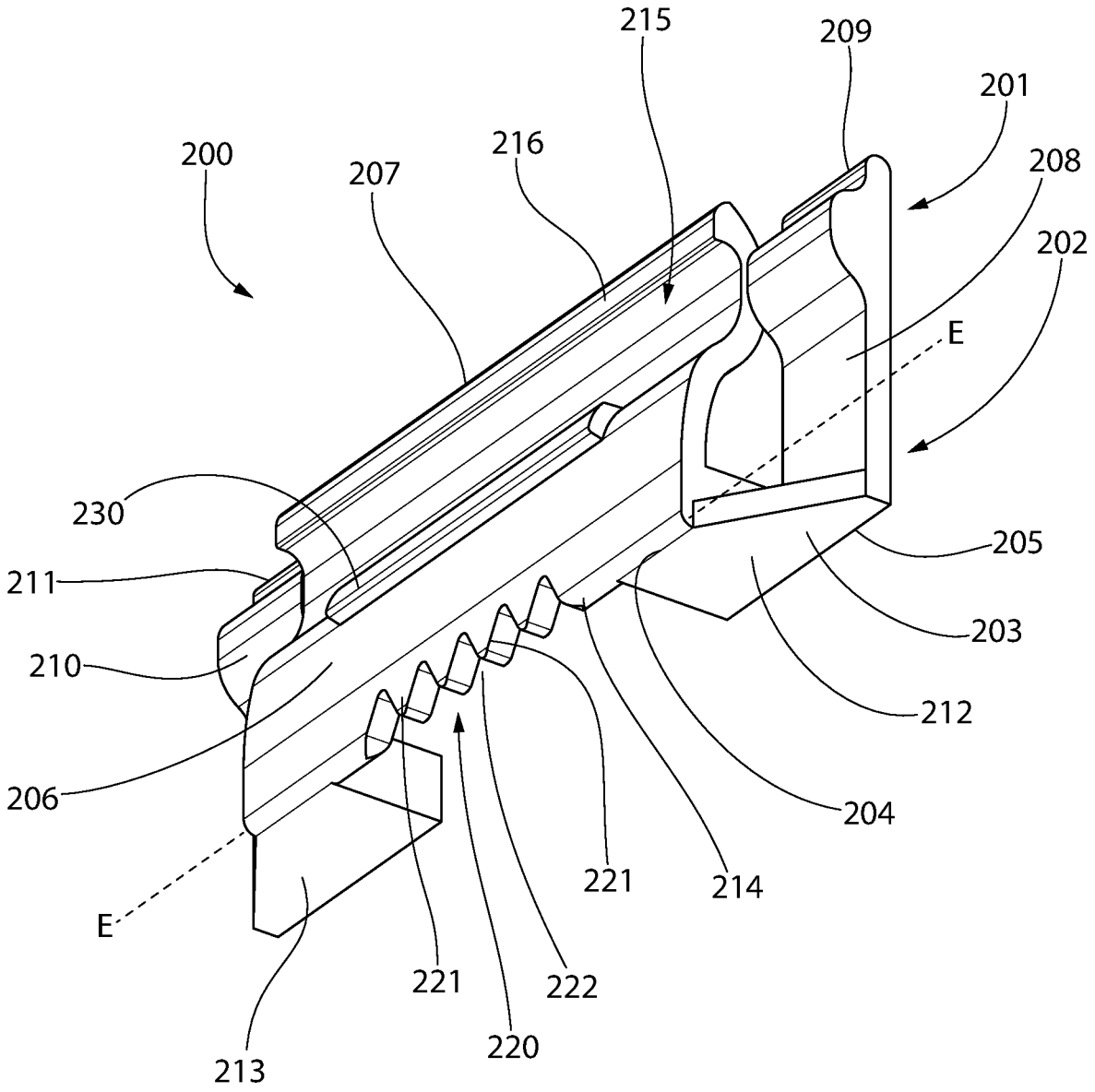
FIG. 3A is a top perspective view of the clip member of FIG. 1A.
Figure 3B:
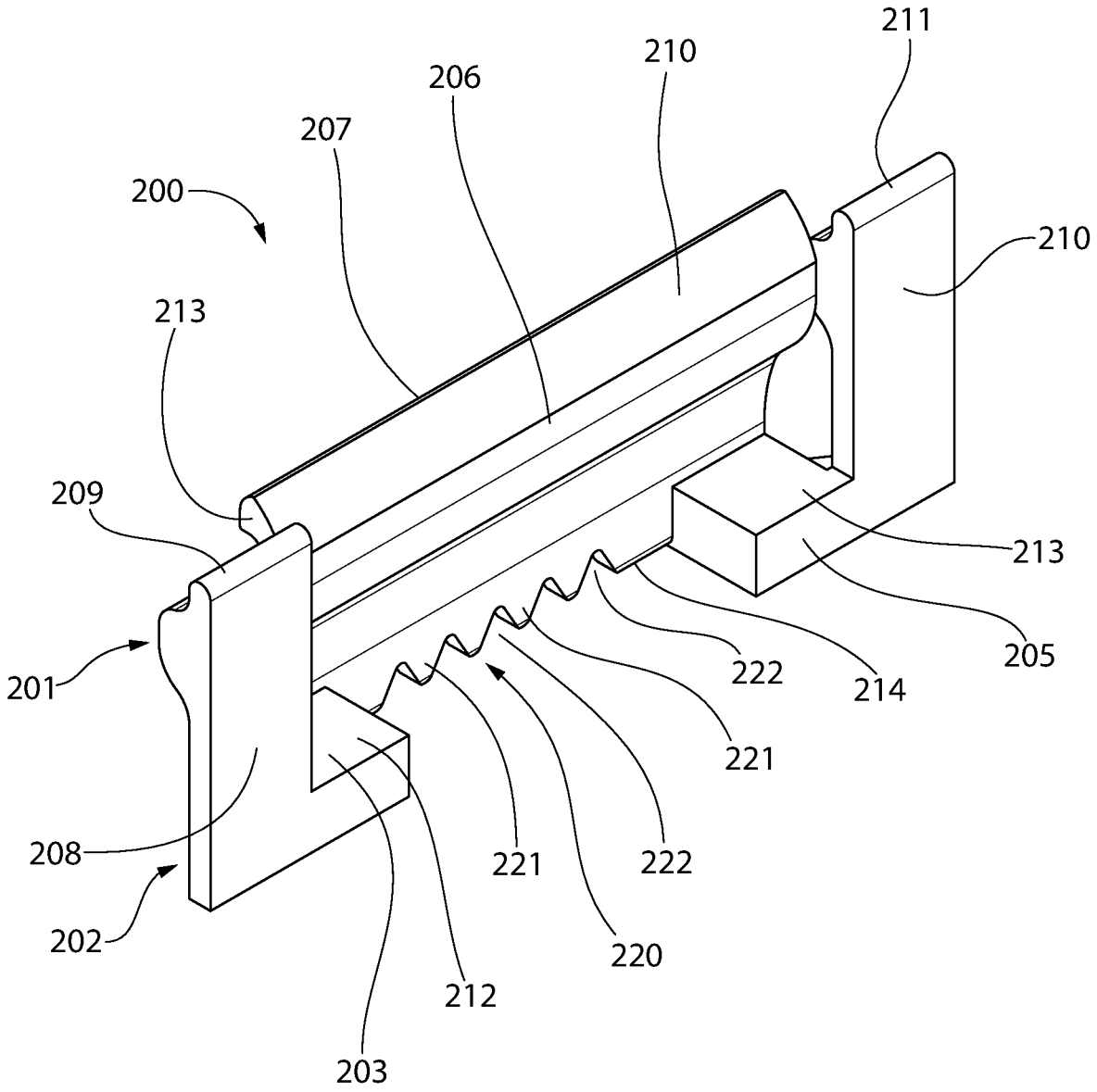
FIG. 3B is a bottom perspective view of the clip member of FIG. 1A.

Referring now to FIGS. 1, 3A, and 3B concurrently, the clip member 200 will be further described. The clip member 200 may be formed of plastic (including polystyrene or otherwise) or metal, but the material of the clip member 200 is not intended to be limiting of the present invention in all embodiments. In certain embodiments the clip member 200 may be a spring clip such that it has flexibility when a force is applied thereon as described herein but is biased into its original shape when no force is applied thereon. In the exemplified embodiment, the clip member 200 is biased into the shape/position illustrated in FIGS. 3A and 3B. The clip member 200 can flex when pressures are applied thereto to facilitate coupling of the clip member 200 to the frame 100. In the exemplified embodiment, the clip member 200 is configured to be coupled to the frame 100 by snap-fitting the clip member 200 into the channel 120. The details of this process will be described in detail below with reference to FIGS. 6A-6E.

The clip member 200 generally comprises a first portion 201 and a second portion 202. The first portion 201 of the clip member 200 is located within the channel 120 when the clip member 200 is coupled to the frame 100 and the second portion 202 of the clip member 200 protrudes from or extends out of the channel 120 when the clip member 200 is coupled to the frame 100. Thus, the first portion 201 of the clip member 200 is the portion that is located within the channel 120 and the second portion 202 of the clip member 200 is the portion that is not located within the channel 120. The second portion 202 of the clip member 200 comprises the hanging feature 220 of the clip member 200.

The clip member 200 comprises a base portion 203 having a top surface 204 and an opposite bottom surface 205, a first leg 206 extending from the base portion 203 to a distal end 207, a second leg 208 extending from the base portion 203 to a distal end 209, and a third leg 210 extending from the base portion 203 to a distal end 211. In some embodiments the third leg 210 may be omitted. The first portion 201 of the clip member 200 comprises a portion of each of the first, second, and third legs 206, 208, 210 that includes the distal ends 207, 209, 211 of the first, second, and third legs 206, 208, 210. Thus, the distal ends 207, 209, 211 of the first, second, and third legs 206, 208, 210 are positioned within the channel 120 when the clip member 200 is coupled to the frame 100. The second portion 202 of the clip member 200 comprises the remaining portion of each of the first, second, and third legs 206, 208, 210 as well as the base portion 203 of the clip member 200. Thus, the base portion 203 of the clip member 200 is external to the channel 120 when the clip member 200 is coupled to the frame 100.

The distal ends 207, 209, 211 of the first, second, and third legs 206, 208 210 are the free ends of the first, second, and third legs 206, 208, 210 that are unattached to one another or to another structure. Thus, each of the first, second, and third legs 206, 208, 210 is cantilevered from the base portion 203 to its respective distal end 207, 209, 211. If the clip members 200 were considered to have a "U" shape, the bight portion of the "U" that is formed by the base portion 203 of the clip member 200 is located outside of the channel 120 when the clip member 200 is coupled to the frame 100. In the exemplified embodiment, the first leg 206 extends from the base portion 203 at a location adjacent to the top surface 204 of the base portion 203 and the second and third legs 208, 210 extend from the base portion 203 at a location adjacent to the bottom surface 205 of the base portion 203.

In the exemplified embodiment, the base portion 203 comprises a first section 212 and a second section 213 that are spaced apart from one another. The second leg 208 extends from the base portion 203 adjacent the bottom surface 205 of the first section 212 of the base portion 203 and the third leg 210 extends from the base portion 203 adjacent the bottom surface 205 of the second section 213 of the base portion 203. Thus, the second and third legs 208, 210 are spaced apart from one another along a length of the clip member 200. The first leg 206 extends from both of the first and second sections 212, 213 of the base portion 203 and is located between the second and third legs 208, 210. Thus, the second leg 208 is located on one side of the first leg 206 and the third leg 210 is located on an opposite side of the first leg 206. The first leg 206 can flex/pivot into the space between the second and third legs 208, 210 and may do so during coupling of the clip member 200 to the frame 100.

The first leg 206 extends from both of the first and second sections 212, 213 of the base portion 203 adjacent to the top surface 204 of the base portion 203. The first leg 206 therefore also extends between the first and second sections 212, 213 of the base portion 203 and in fact serves as the structure that couples the first and second sections 212, 213 of the base portion 203 together. The first leg 206 has an exposed edge 214 extending between the first and second sections 212, 213 of the base portion 203. The exposed edge 214 is an opposite edge from the distal end 207 of the first leg 206. The exposed edge 214 of the first leg 206 comprises the hanging feature 220 of the clip member 200.

In the exemplified embodiment, the hanging feature 220 of the clip member 200 is in the form of a sawtooth hanger. Specifically, the hanging feature 220 of the clip member 200 comprises a plurality of teeth 221 and a plurality of notches 222 arranged in an alternating manner along the exposed edge 214. Thus, each pair of adjacent teeth 221 is spaced apart by one of the notches 222 and vice versa. When it is desired to hang the frame 100 with the clip member 200 mounted thereto from a hanging element (i.e., nail, screw, or the like) protruding from a wall, the hanging element is positioned within one of the notches 222 of the hanging feature 220. The use of sawtooth hangers is conventionally understood by consumers and persons skilled in the art. Furthermore, although the hanging feature 220 is a sawtooth hanger in the exemplified embodiment, the invention is not to be so limited and other types of hangers can be used including D-rings, hooks, wires, adhesive strips, plates with apertures therein, or the like.

The first leg 206 of the clip member 200 comprises a depression 215 having a concave floor. The depression 215 is elongated along the first leg 206 in a direction between the second and third legs 208, 210. Thus, if the first leg 206 extends from the base portion 203 in a first direction, the depression 215 is elongated in a second direction that is orthogonal to the first direction. As discussed in more detail below, the depression 215 of the first leg 206 is sized and shaped to receive the protrusion 124 therein to secure the clip member 200 to the frame 100. The first leg 206 has a distal portion 216 extending from the depression 215 to the distal end 207, the distal portion 216 including the distal end 207. As discussed below, the distal portion 216 forms a hook-like member that nests within the gap 126 between the protrusion 124 and the sidewall surface 122 of the channel 120 when the clip member 200 is coupled to the frame 100. The distal portion 216 of the first leg 206 of the clip member 200 interacts with the trailing edge 131 of the protrusion 124 to prevent accidental detachment of the clip member 200 from the frame 100.

At least one of the first leg 206 or the second and third legs 208, 210 of the clip member 200 is pivotable relative to the base portion 203 of the clip member 200. Specifically, the first leg 206 may be pivotable relative to the base portion 203 about a pivot axis E-E. The second and third legs 206, 208 may additionally, or alternatively, be pivotable relative to the base portion 203 about a pivot axis that is parallel to the pivot axis E-E. This permits the first leg 206 to pivot downwardly in a direction towards the bottom end 205 of the base portion 203 and into the gap between the second and third legs 208, 210 during coupling of the clip member 200 to the frame 100. Additionally or alternatively, this allows the second and third legs 208, 210 to pivot upwardly in a direction towards the top end 204 of the base portion 203 during coupling of the clip member 200 to the frame 100.

Figure 3C:
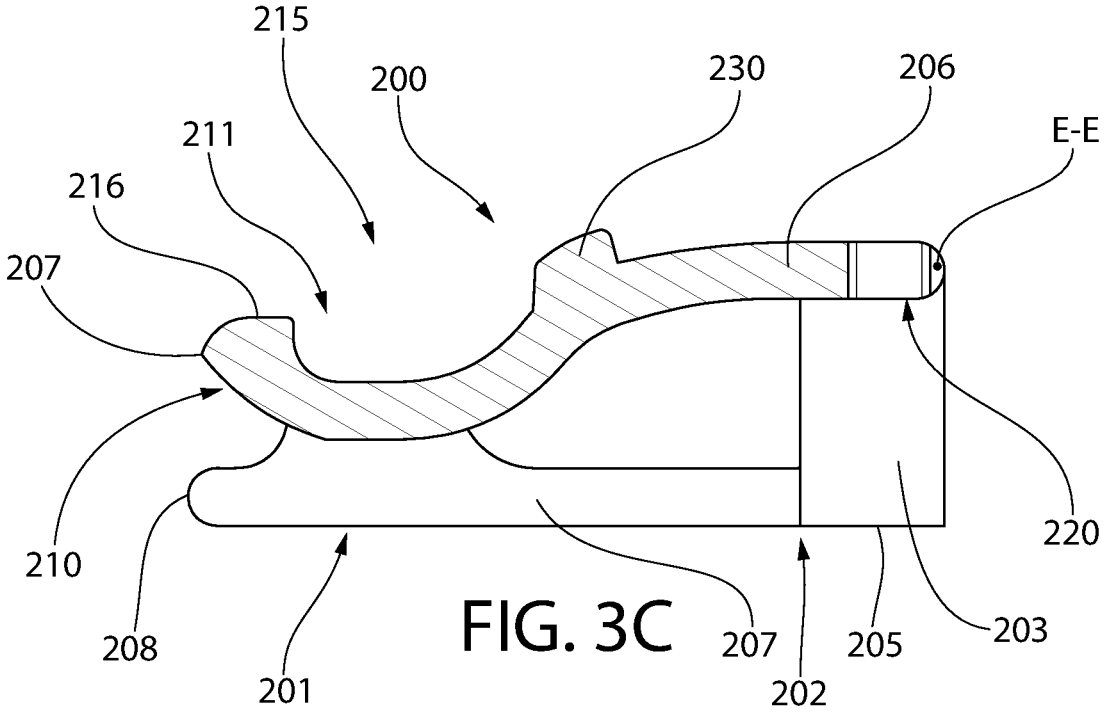
FIG. 3C is a cross-sectional schematic view of the clip member of FIG. 1A in a non-flexed state.
Figure 3D:
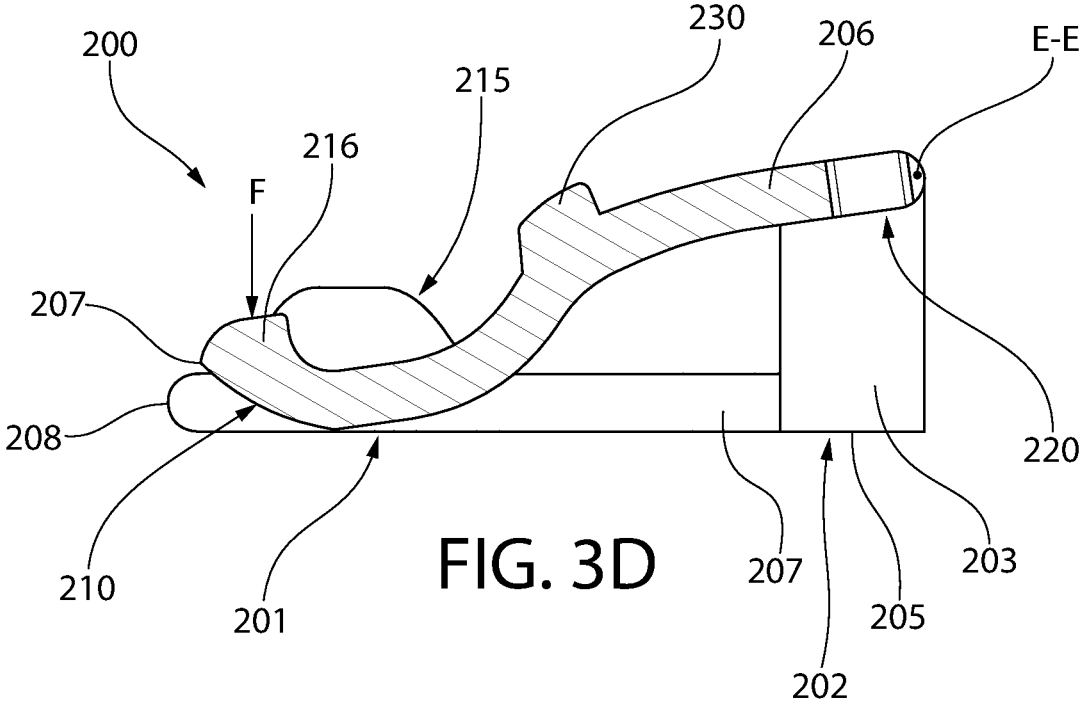
FIG. 3D is a cross-sectional schematic view of the clip member of FIG. 1A in a flexed state.

Referring to FIGS. 3C and 3D, the pivoting of the first leg 206 relative to the base portion 203 of the clip member 200 will be described. FIG. 3C illustrates the clip member 200 in its biased, non-flexed state. Specifically, when no forces are acting upon the first leg 206 relative to the base portion 203, the clip member 200 appears as illustrated in FIG. 3C. FIG. 3D illustrates the clip member 200 in a flexed state due to a downward force F being applied onto the distal portion 216 of the first leg 206 of the clip member 200. The downward force F causes the first leg 206 to pivot relative to the base portion 203 of the clip member 200 about the axis E-E. Due to the force F acting on the first leg 206, the first leg 206 pivots downwardly towards the second leg 207 and towards the bottom end 205 of the base portion 203 of the clip member 200. The first leg 206 of the clip member 200 is pivotable about the axis E-E to permit insertion of the first portion 201 of the clip member 200 into the channel 120 of the frame 100 as discussed below. The engagement between the first portion 201 of the clip member 200 and the channel 120 of the frame 100 may be a cantilever snap-fit in some embodiments.

As will be described in more detail below with reference to FIGS. 6A-6E, the first portion 201 or the first leg 206 of the clip member 200 is automatically transitioned from the non-flexed state into the flexed state during insertion of the first portion 201 of the clip member 200 into the channel 120 of the frame 100 due to the protrusion providing a downward force onto the first leg 206 of the clip member 200. The first portion 201 of the clip member 200 is then automatically transitioned back into the non-flexed state once the first portion 201 of the clip member 200 is fully inserted into the channel 120 of the frame 100 due to cessation of a force applied to the first leg 206 of the clip member 200.

As noted above, the first leg 206 of the clip member 200 comprises a depression 215 having a concave floor that is configured to mate with the protrusion 124 of the channel 120 to securely mount, in a snap-fit manner, the clip member 200 to the frame 100. The first leg 206 of the clip member 200 also comprises the distal portion 216, which forms a hook-like member that engages the trailing edge 131 of the protrusion 124 of the channel 120 to prevent the clip member 200 from being detached from the frame 100 until such time as detachment is desired. However, this is only one exemplified embodiment and other mateable profiles for the first portion 201 of the clip member 200 and the channel 120 of the frame 100 are possible. For example, the first portion 201 of the clip member 200 may have a protuberance that mates with a recess/depression of the channel 120 to facilitate the coupling between the clip member 200 and the frame 100. Other configurations, structures, and features may be incorporated to achieve the coupling of the clip member 200 to the frame 100 while permitting sliding movement of the clip member 200 relative to the frame 100 as discussed below.

In the exemplified embodiment, the first leg 206 of the clip member 200 also comprises a grip protrusion 230 extending therefrom. The grip protrusion 230 provides a surface for a user to grip when inserting the clip member 200 into the channel 120 of the frame 100 and removing the clip member 200 from the channel 120 of the frame 100. The grip protrusion 230 may also assist a user in flexing the first leg 206 to facilitate removal of the clip member 200 from the channel 120 of the frame 100.

Figure 4A:
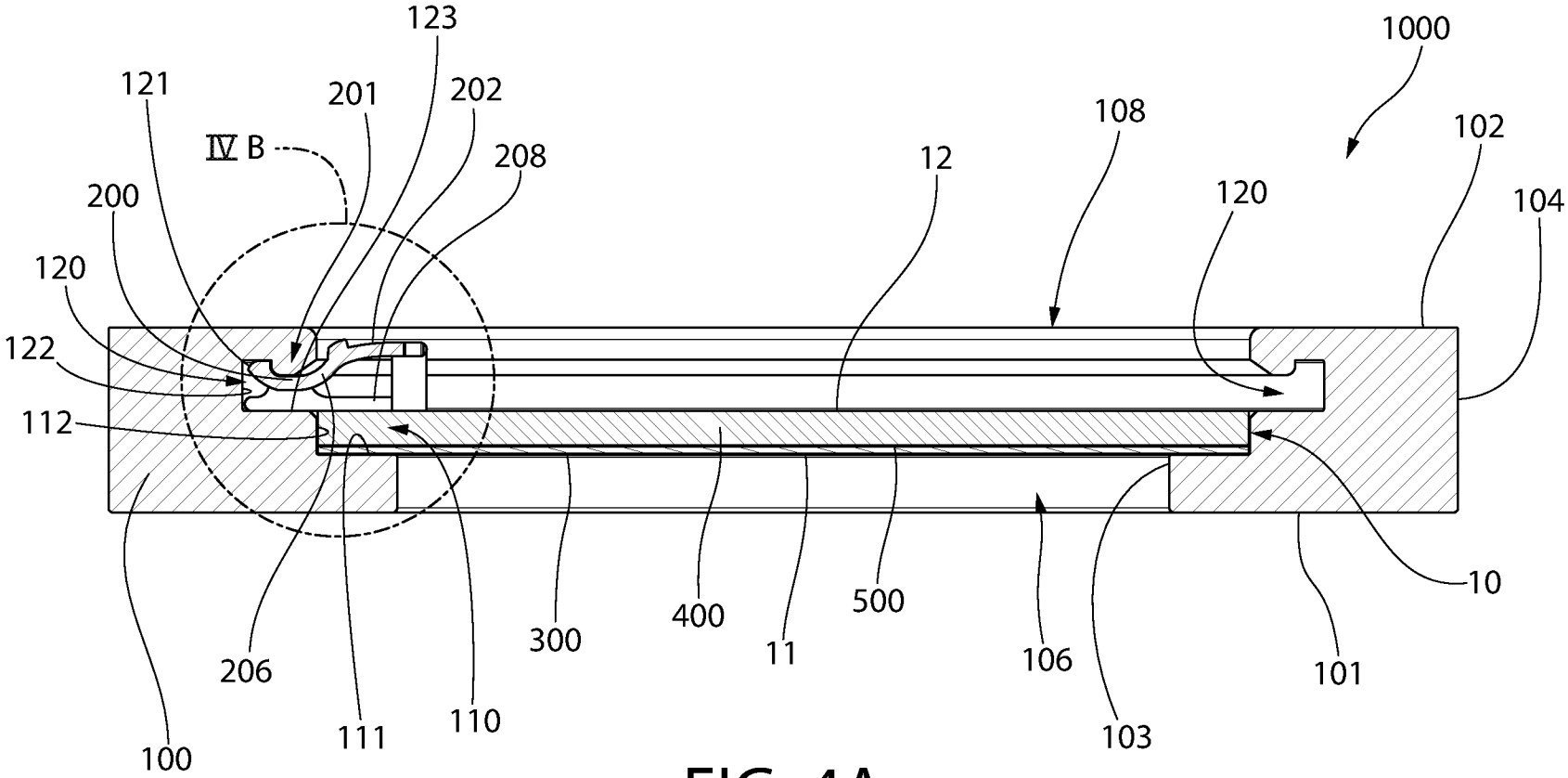
FIG. 4A is a cross-sectional view taken along line IVA-IVA of FIG. 1A.
Figure 4B:
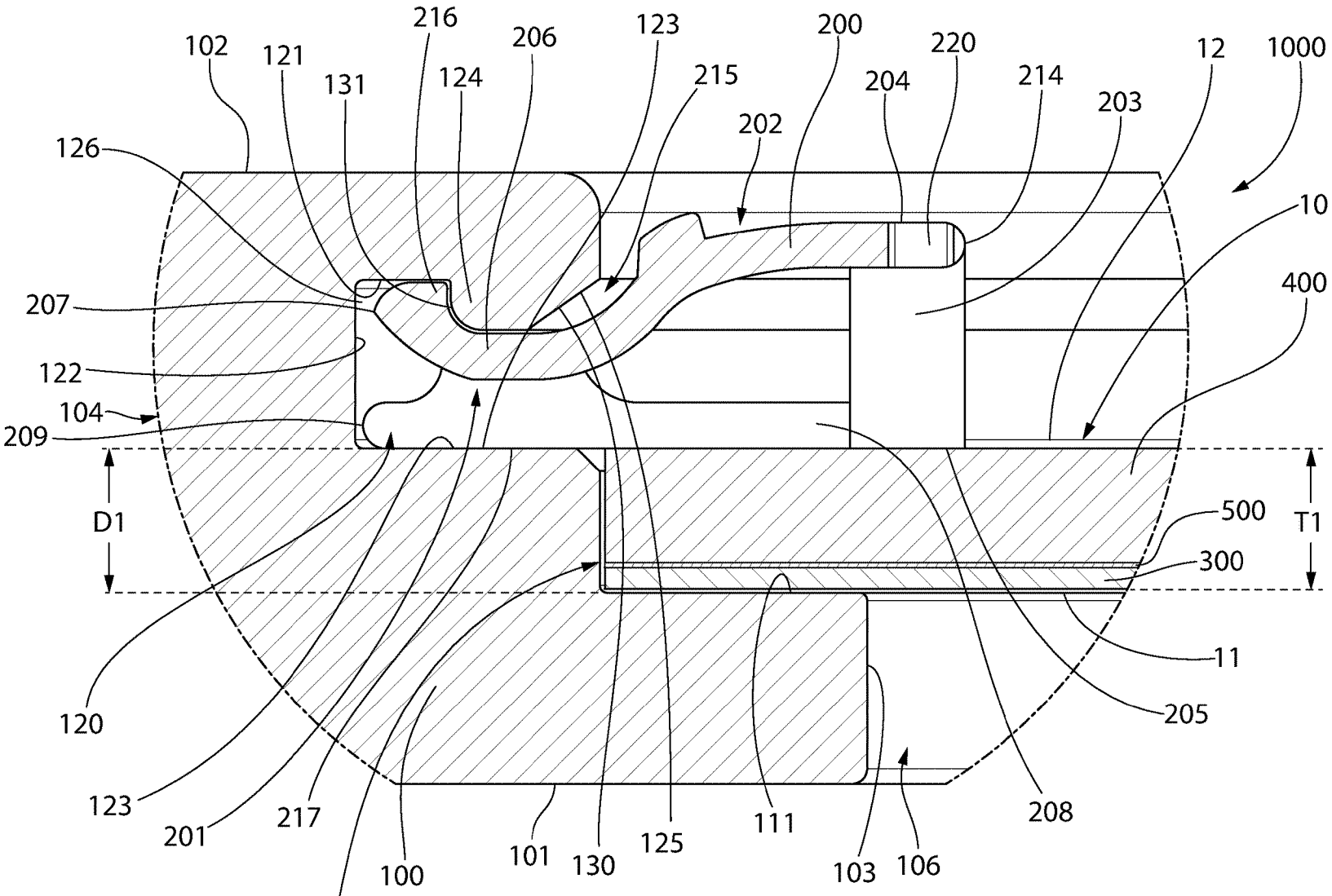
FIG. 4B is a close-up view of area IVB of FIG. 4A.

Referring now to FIGS. 4A and 4B concurrently, the fully assembled frame apparatus 1000 is illustrated in cross-section and close-up, respectively. The stack 10 comprising the glazing 300, the article 500, and the backer panel 400 are positioned within the rabbet 110. The clip member 200 is mounted to the frame 100 with the first portion 201 of the clip member 200, which comprises portions of the first and second legs 206, 208, disposed within the channel 120 of the frame 100, and with the second portion 202 of the clip member 200 protruding from or located external to the channel 120. As can be seen, it is the distal portions of the first and second legs 206, 208 that include the free, unattached distal ends 207, 209 thereof that are inserted into the channel 120 when coupling the clip member 200 to the frame 100.

When the clip member 200 is coupled to the frame 100 as illustrated, the bottom portion 205 of the base portion 203 of the clip member 200 and a bottom surface 217 of the second leg 208 (and also a bottom surface of the third leg 210, although not illustrated) is in contact with the rear surface 12 of the stack 10 (i.e., the rear surface of the backer panel 400 in the exemplified embodiment). This contact between the clip member 200 and the backer panel 400 (or any other rear-most positioned element of the stack that is disposed on the rabbet 110) secures the stack 10 within the rabbet 110. Specifically, the stack 10 is trapped/sandwiched between the clip member 200 and the floor 111 of the rabbet 110, thereby preventing the stack or portions thereof from being removed from the rabbet 110 while the clip member 200 is coupled to the frame 100. As discussed below, in order to insert layers of the stack into the rabbet 110 or remove layers of the stack from the rabbet 110, the clip member(s) 200 must first be detached from the frame 100. Thus, the clip member 200 takes the place of standard turn buttons, flex tabs, and glazier points and renders their use unnecessary.

In certain embodiments, the clip member 200 applies a compression force onto the stack 10 to tightly secure the stack 10 within the rabbit 110. Specifically, in certain embodiments the stack 10 is compressed between the second portion 202 of the clip member 200 and the floor 111 of the rabbet 110. Such compression may be desirable to ensure that the article 500 is not able to slide or move in the fully assembled frame apparatus 1000. In some embodiments, a portion of the rabbet 110 defined between the floor 111 of the rabbet 110 and the bottom surface 123 of the channel 120 has a depth D1 and the stack 10 has a thickness T1. In some embodiments, the thickness T1 of the stack 10 may be equal to or greater than the depth D1 of the portion of the rabbet 110. This will ensure that the clip member 200 compresses the stack 10 in the fully assembled frame apparatus 1000, thereby substantially preventing movement of the article 500.

As noted above, the clip member 200 is coupled to the frame 100 via interaction between the protrusion 124 of the channel 120 and the depression 215 and distal portion 216 of the first leg 206 of the clip member 200. As noted above, the leading edge 130 of the protrusion 124 comprises the chamfer 125 that interacts with the distal end 207 of the first leg 206 of the clip member 200 to deflect the first leg 206 from the non-flexed state to the flexed state during coupling of the clip member 200 to the frame 100. Once the distal portion 216 of the first leg 206 passes beyond the protrusion 124, the protrusion 124 nests with the depression 215 of the first leg 206 of the clip member 200 to securely couple the clip member 200 to the frame 100 within the channel 120. Furthermore, the distal portion 216 of the first leg 206 of the clip member 200 engages or abuts against the trailing edge 131 of the protrusion 124 when the first portion 201 of the clip member 200 is positioned within the channel 120 to prevent the clip member 200 from being detached from the frame 100 accidentally. Rather, a user must apply a force onto the clip member 200 (as described above with reference to FIGS. 3C and 3D) to transition it from its natural non-flexed state to its flexed state in order to facilitate removal of the first portion 201 of the clip member 200 from the channel 120 and detachment of the clip member 200 from the frame 100.

Although the clip member 200 is prevented from being readily separated from the frame 100 once it is coupled thereto without user involvement, the clip member 200 is configured to be slidable relative to the frame 100 within the channel 120 while remaining coupled or mounted to the frame 100. Thus, depending on which inner edge portion 115-118 of the frame 100 (or the frame components 100*a-d*) the clip member 200 is mounted to, the clip member 200 is slidable within the channel 120 along one of the axes A-A, B-B, C-C, D-D without detaching the clip member 200 from the frame 100.

Specifically, the clip member 200 is capable of sliding within the channel 120 along the axis A-A, B-B, C-C, D-D of the linear section of the channel 120 within which the first portion 201 of the clip member 200 is located while the protrusion 124 remains located within the depression 215 of the first leg 206. However, due to the biased nature of the clip member 200 being such that the first leg 206 wants to pull upwardly away from the second and third legs 208, 210, the clip member 200 does not slide freely within the channel 120, but rather some force needs to be applied to the clip member 200 relative to the frame 100 to initiate movement of the clip member 200. Specifically, friction between the first leg 206 of the clip member 200 and the top surface 121 of the channel 120 and between the second and third legs 208, 210 of the clip member 200 and the bottom surfaces 123 of the channel 120 prevents the clip member 200 from freely sliding within the channel 120 without user intervention. Thus, once hung the frame 100 will not slide incidentally along the wall from which it is hung, but it will slide along the wall from which it is hung in response to user action. This will be described in more detail below with reference to FIGS. 7A-8B.

Figure 5A:
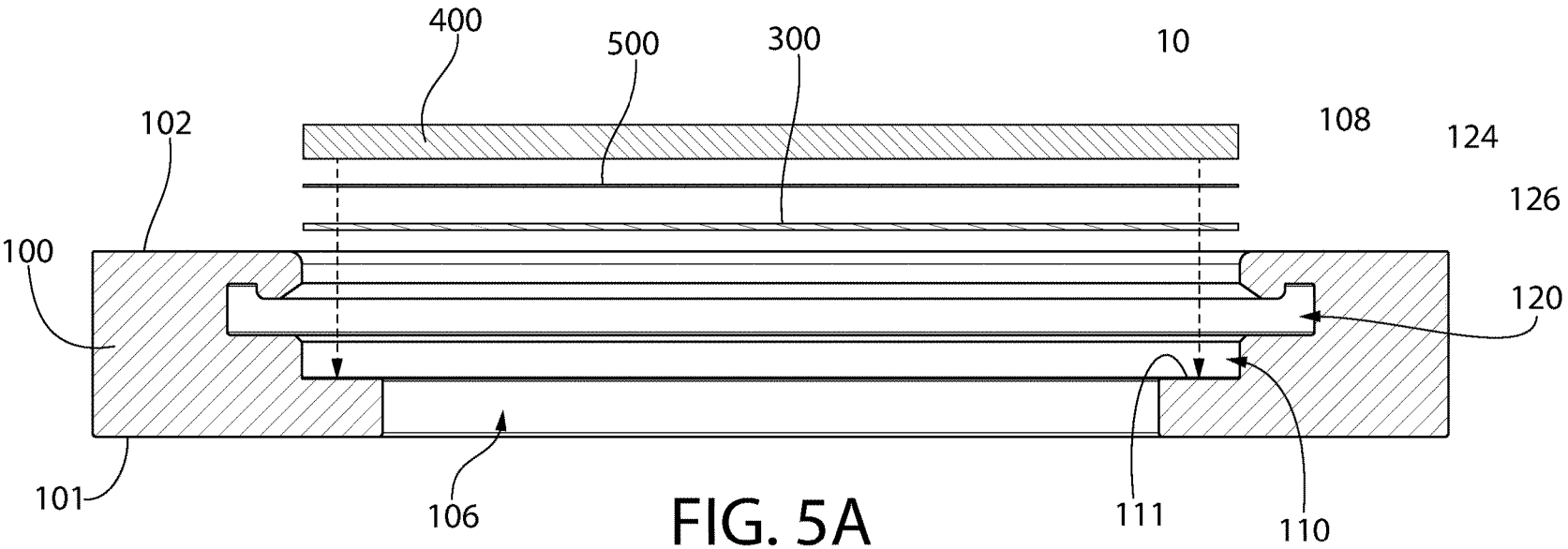
FIGS. 5A and 5B are schematic cross-sectional views of the frame apparatus of FIG. 1A illustrating the process of inserting a stack into a rabbet of the frame.

Referring to FIGS. 5A-6E, assembly of the frame apparatus 1000 will be described. Referring first to FIG. 5A, the frame 100 is illustrated with the stack 10 comprising the glazing 300, the article 400, and the backer panel 500 separate from the frame 100 but prepared for insertion into the rabbet 110 of the frame 100 via the rear opening 108. Specifically, the glazing 300, the article 400, and the backer panel 500 are positioned adjacent the rear surface 102 of the frame 100 in preparation for rear mounting of the glazing 300, the article 400, and the backer panel 500 into the frame 100. FIG. 5B illustrates the stack 10 within the frame 100. Specifically, the stack 10 is inserted through the rear opening 108 of the frame 100 and comes to rest atop of the floor 111 of the rabbet 110. The stack 10, or at least the front-most component of the stack, which in the exemplified embodiment is the glazing 300, has a width and length that is configured to ensure that a perimeter portion of the glazing 300 contacts the floor 111 of the rabbet 110 when inserted into the frame 100. This prevents the stack 10 from passing directly through the display opening 106 of the frame 100. The stack 10 is preferably configured to have a combined thickness that is approximately equal to or less than the thickness of the rabbet 110 to ensure that the stack fits properly within the rabbet 110.

After the stack 10 is disposed within the rabbet 110, the clip member 200 is mounted to the frame 100 to secure the stack 10 within the rabbet 110. Specifically, without the clip member 200 coupled to the frame 100, the stack 10 could simply fall out through the rear opening 108 of the frame 100. The clip member 200 is coupled to the frame 100 to prevent the stack 10 from falling out through the rear opening 108 of the frame 100 so long as the clip member 200, and preferably two or more of the clip members 200, remain coupled to the frame 100.

Figure 5B:
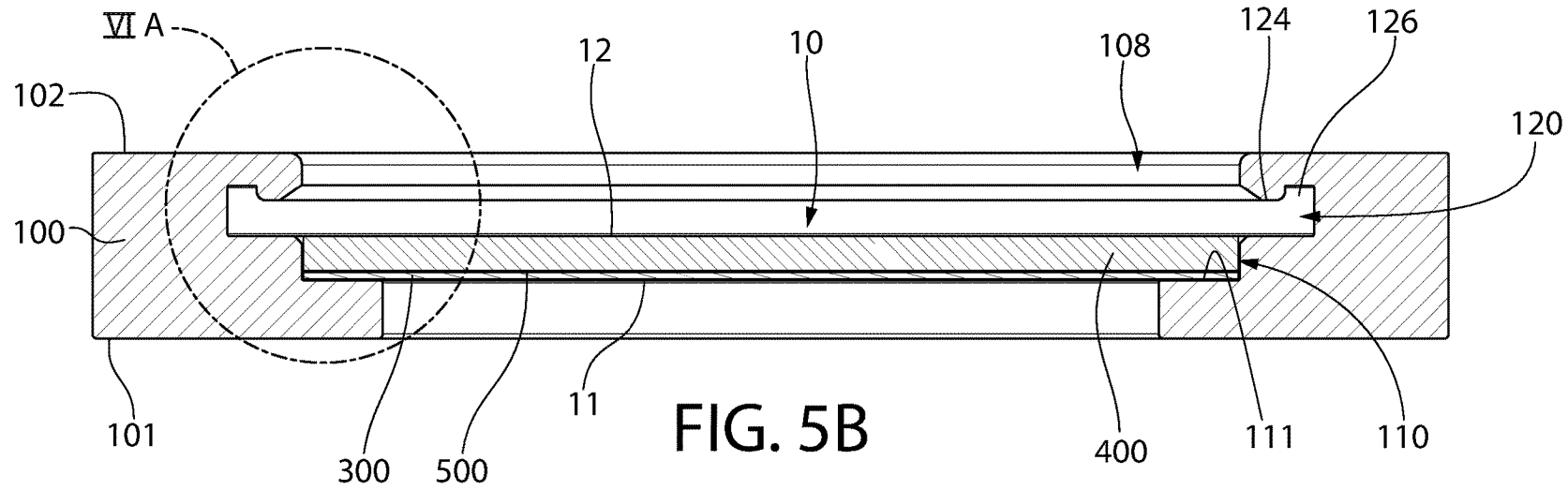
Figure 6A:
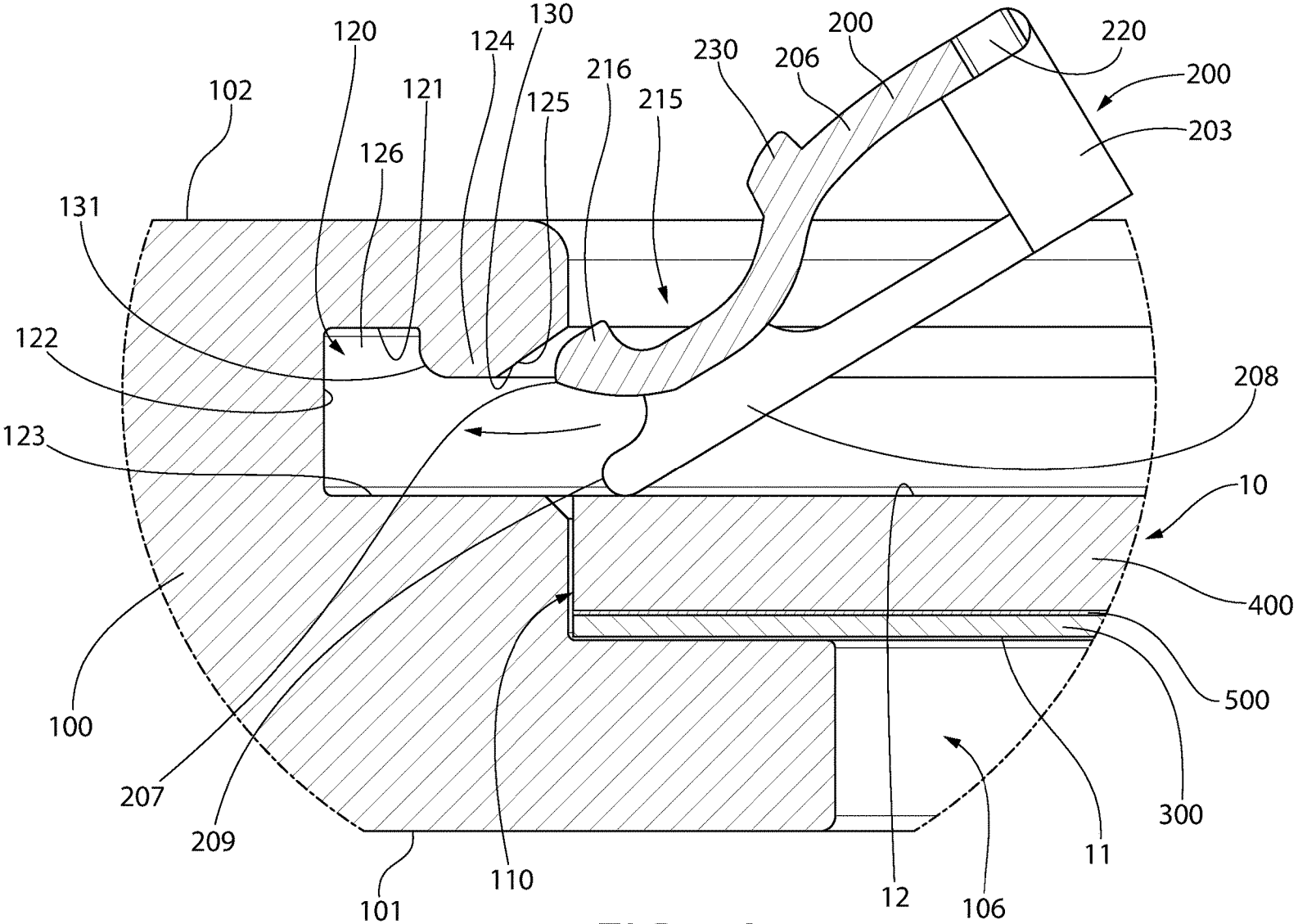
FIGS. 6A-6E are close-up schematic cross-sectional views of area VIA of FIG. 5B illustrating the process of coupling the clip member to the frame.
Figure 6B:
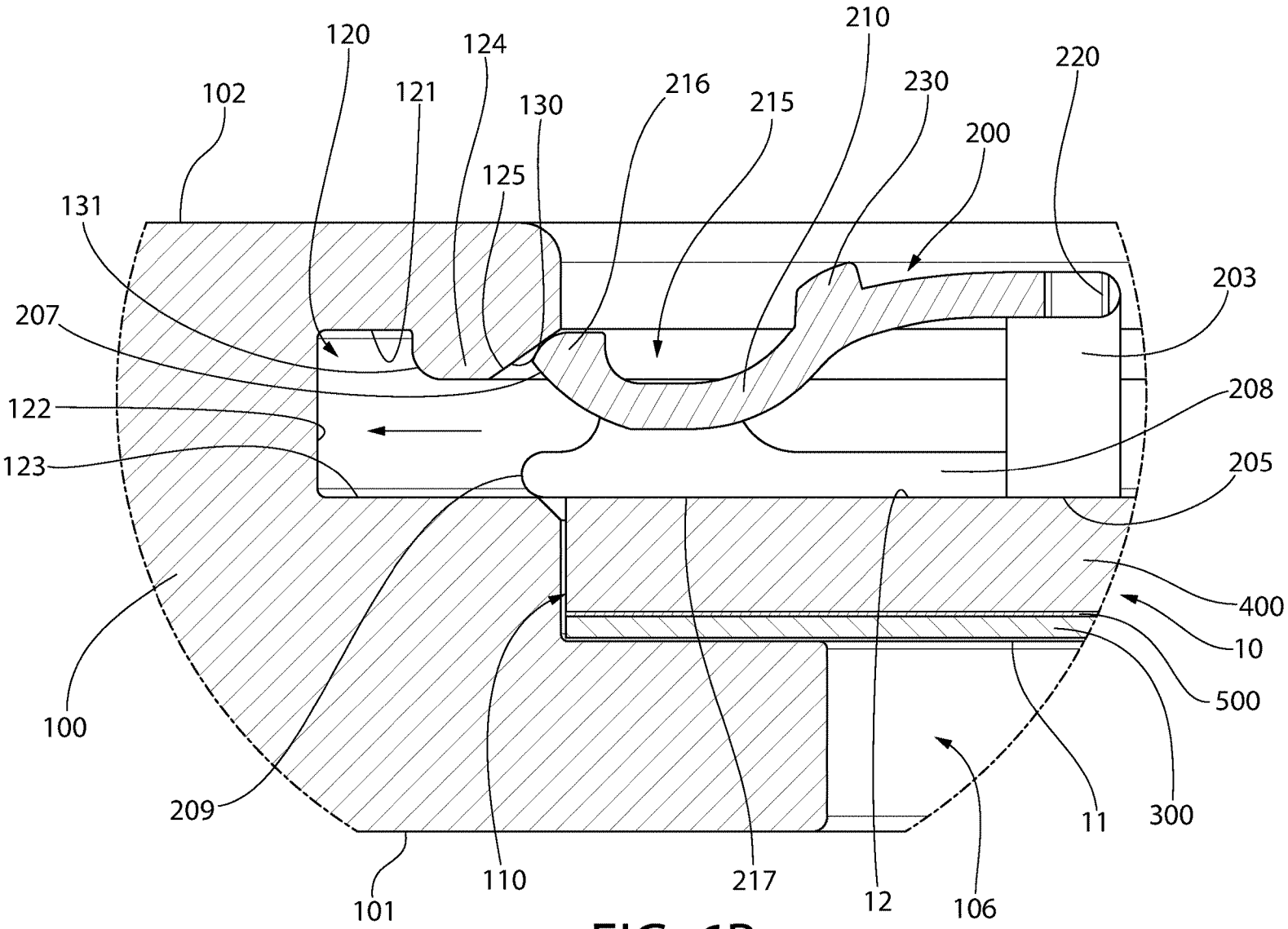

FIGS. 6A-6E are close-up illustrations of area VIA of FIG. 5B that illustrate the process of coupling the clip member 200 to the frame 100 and these figures will be described collectively. First, the clip member 200 is oriented so that the distal ends 207, 209, 211 of the first, second, and third legs 206, 208, 210 of the clip member 200 face the channel 120 of the frame 100 (FIG. 6A). Although the clip member 200 is illustrated being oriented at an angle in FIG. 6A and rotated between FIGS. 6A and 6B, this is not required. The clip member 200 may simply be translated towards the channel 120 without any rotation required as illustrated in FIGS. 6B-6E. The clip member 200 is pressed or otherwise moved towards the channel 120 until the distal portion 216 of the first leg 206 of the clip member 200 contacts the leading edge 130 of the protrusion 124 (FIG. 6B). Specifically, the clip member 200 is moved towards and into the channel 120 in a direction that is perpendicular to the axis A-A, B-B, C-C, D-D of the channel 120. During this movement of the clip member 200, the bottom surface 205 of the base portion 203 and the bottom surface 217 of the second (and third) leg 208 of the clip member 200 engage or ride along the rear surface 12 of the stack 10.

Figure 6C:
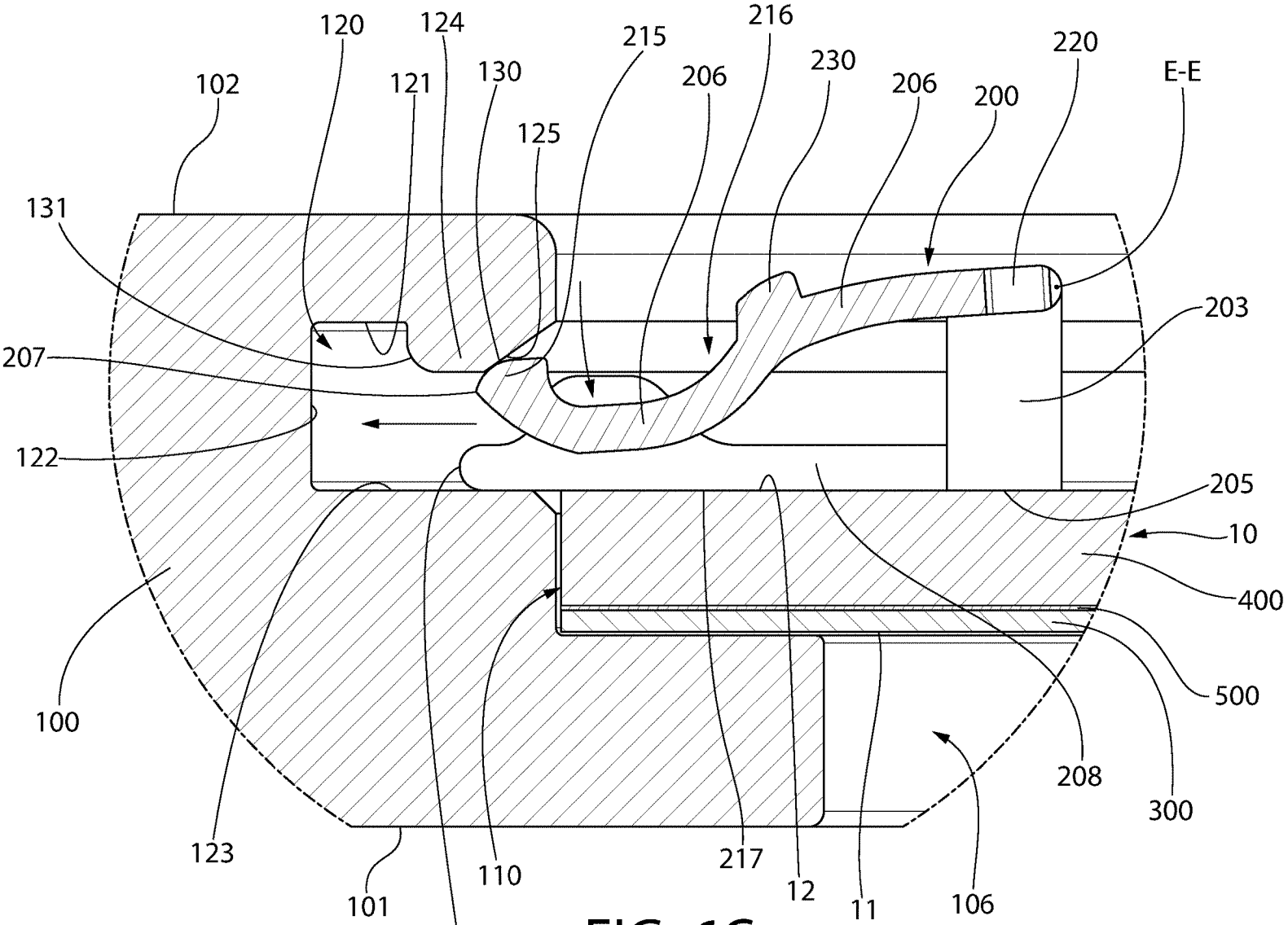

Referring to FIG. 6C, the clip member 200 is continued to be pressed into the channel 120. As the clip member 200 is continued to be pressed into the channel 120, the distal portion 216 of the first leg 206 of the clip member 200 rides along the chamfer 125 of the leading edge 130 of the protrusion 124 while the bottom surface 217 of the second (and third) leg 208 of the clip member 200 rides along the bottom surface 123 of the channel 120 and the rear surface 12 of the stack 10. Due to the downward slant of the chamfer 125, the engagement between the distal portion 216 of the first leg 206 of the clip member 200 and the leading edge 130 of the protrusion 124 causes the first leg 206 of the clip member 200 to pivot downwardly about the axis E-E and transition from the non-flexed (or biased) state into the flexed state.

Figure 6D:
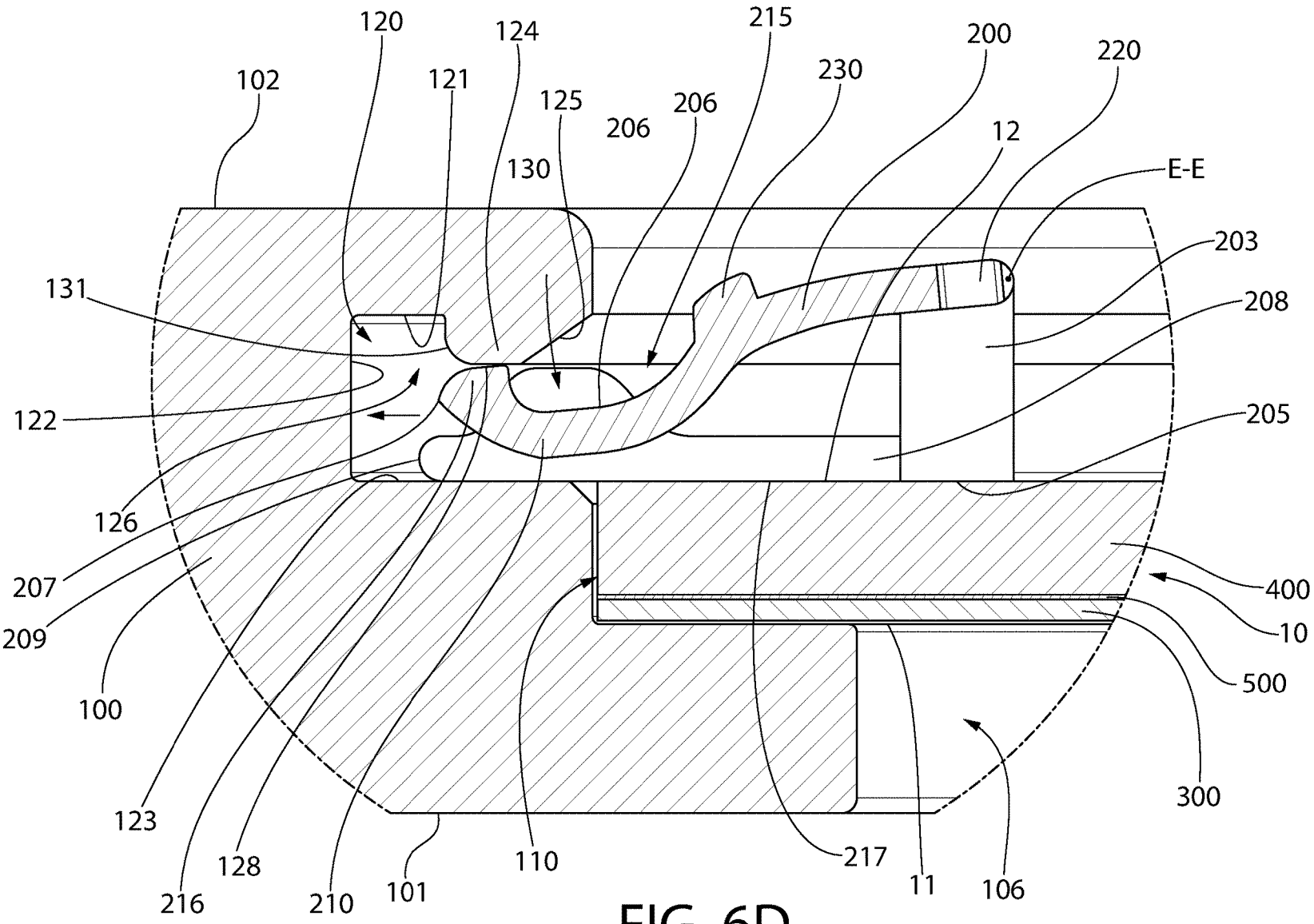
Figure 6E:
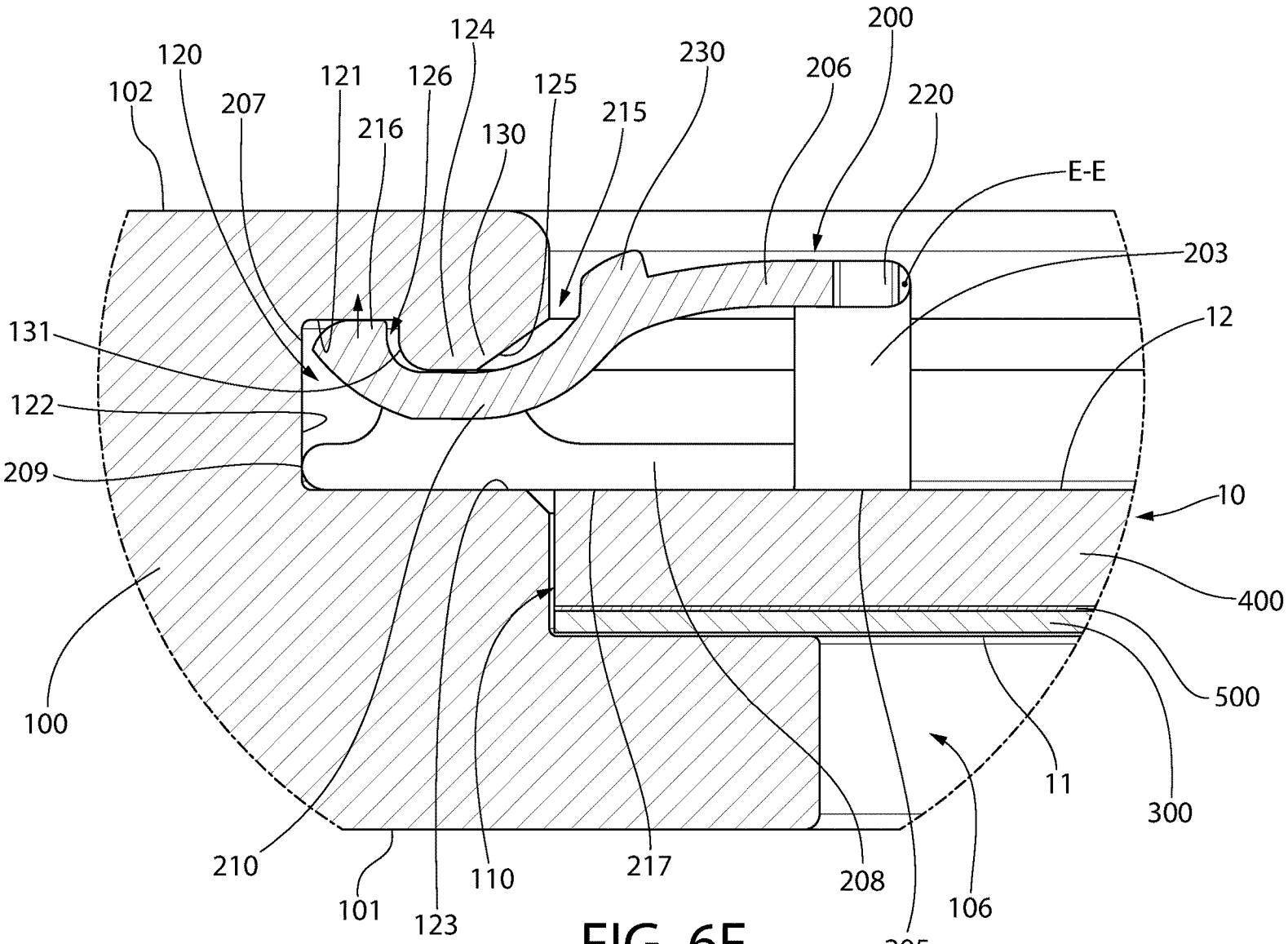

Referring to FIG. 6D, as the distal portion 216 of the first leg 206 of the clip member 200 passes by the leading edge 130 of the protrusion 124, the distal portion 216 of the first leg 206 of the clip member 200 continues to ride along a lower surface 128 of the protrusion 124 until the distal portion 216 of the first leg 206 of the clip member 200 passes beyond the protrusion 124 and enters into the gap 126 formed between the sidewall surface 122 of the channel 120 and the trailing edge 131 of the protrusion 124 (FIG. 6E). During this time, the bottom surface 217 of the second (and third) leg 208 continues to ride along and in contact with the bottom surface 123 of the channel 120 and the rear surface 12 of the stack 10. Once the distal portion 216 of the first leg 206 of the clip member 200 passes the trailing edge 131 of the protrusion 124, the first leg 206 of the clip member 200 will pivot upwardly about the axis E-E back to its biased non-flexed state. Specifically, because the protrusion 124 is no longer applying a downward force onto the first leg 206, the first leg 206 will automatically pivot back into its natural unflexed state.

As shown in FIG. 6E, when the clip member 200 is fully coupled to the frame 100 within the channel 120, the distal portion 216 of the first leg 206 is located within the gap 126 between the trailing edge 131 of the protrusion 124 and the sidewall surface 120 of the channel 120 and the protrusion 124 nests within the depression 215 of the first leg 206. Furthermore, the bottom surface 217 of the second (and third) leg 208 is in contact with the bottom surface 123 of the channel 120 and the rear surface 12 of the stack 10. An attempt to pull the clip member 200 out of the channel 120 will result in the distal portion 216 of the first leg 206 abutting against the trailing edge 131 of the protrusion 124. Thus, in order to remove the clip member 200 from the channel 120, the first leg 206 must first be flexed downwardly about the axis E-E until the distal portion 216 of the first leg 206 is located below the protuberance 124 so that the clip member 200 can be pulled away from the channel 120 without the distal portion 216 of the first leg 206 contacting the protrusion 124. As mentioned above, with the clip member 200 coupled to the frame 100, the bottom surface 205 of the base portion 203 and the bottom surface 217 of the second leg 208 (and third leg although not illustrated) of the clip member 200 are adjacent to, and preferably in contact with, the rear surface 12 of the stack 10 thereby trapping the stack 10 between the clip member 200 and the floor 111 of the rabbet 110. In this manner, the clip member 200 takes the place of turn buttons, flex tabs, and glazier points that are typically used to retain the stack 10 within the rabbet 110.

Figure 7B:
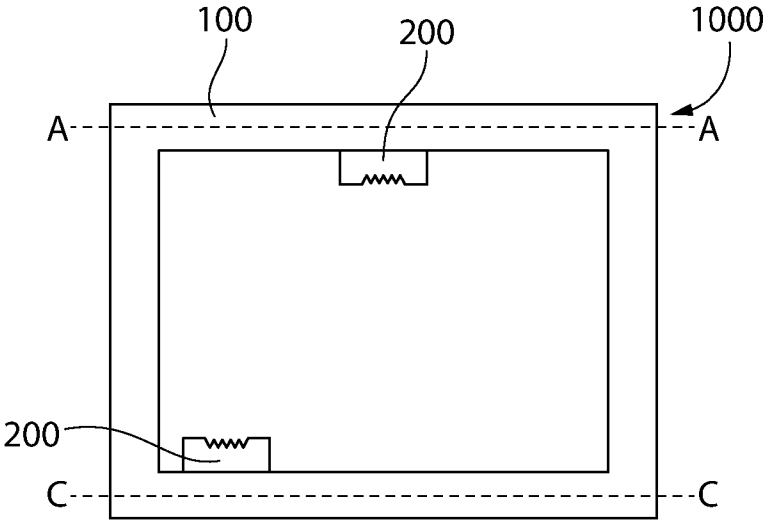
FIGS. 7A-7C are schematic rear views of the frame apparatus of FIG. 1A illustrating the slidability of the clip members relative to the frame when the clip members are coupled to the frame.
Figure 7A:
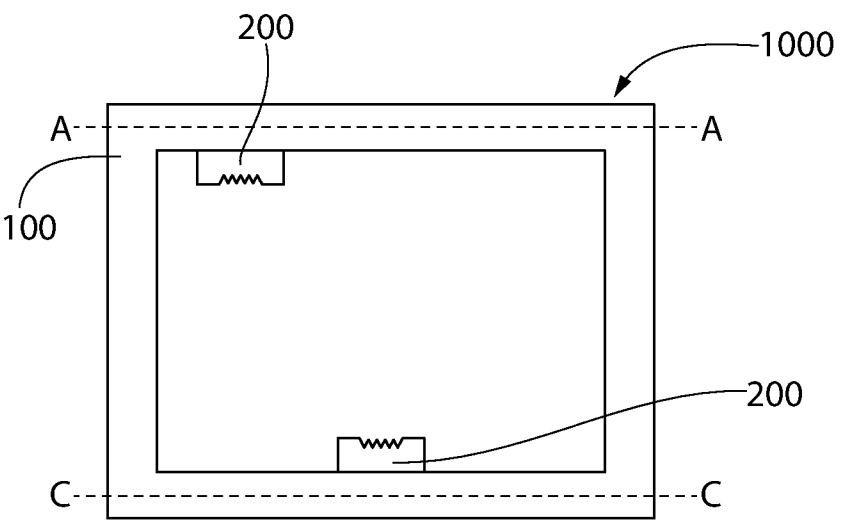
Figure 7C:
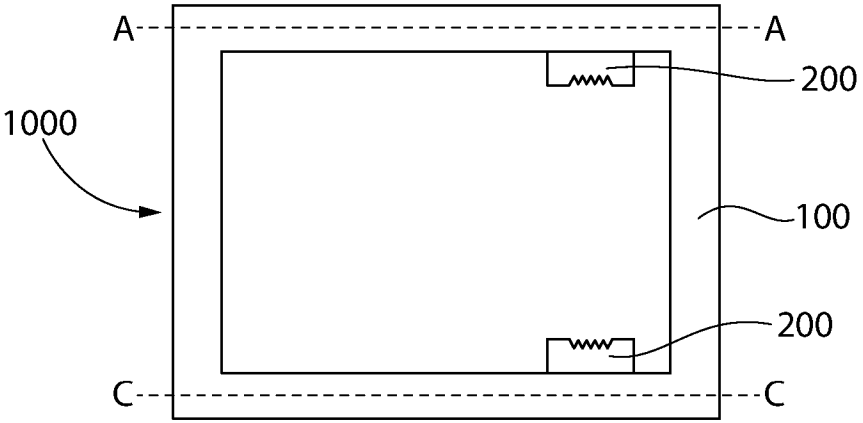

Referring to FIGS. 7A-7C, the slidability of the clip member 200 when the clip member 200 is coupled to the frame 100 will be described. As noted above, the clip member 200 can slide relative to the frame 100 within the channel 120 while remaining coupled to the frame 100. FIGS. 7A-7C schematically illustrates the frame apparatus 1000 with two of the clip members 200 coupled thereto on opposing sides of the channel 120. Specifically, a first one of the clip members 200 is coupled to a first linear section of the channel 120 that extends along the axis A-A and a second one of the clip members 200 is coupled to a second linear section of the channel 120 that extends along the axis C-C. FIGS. 7A-7C are intended to show that the clip members 200 can move from side-to-side relative to the frame 100 along the axis A-A, C-C of the linear section of the channel 120 to which they are coupled while the clip member 200 remains coupled to the frame 100. Stated another way, without disengaging the clip member 200 from the frame 100 and while the first portion 201 of the clip member 200 is located within the channel 120 of the frame 100, the clip member 200 can slide or move relative to the frame 100. Furthermore, the frame apparatus 1000 could include four of the clip members 200 (i.e., one or more coupled to each linear section of the channel 120), all of which are movable/slidable as illustrated described herein. Furthermore, more than one clip member 200 may be coupled to one of the linear sections of the channel 200, as discussed below with reference to FIGS. 9A and 9B.

Figure 8A:
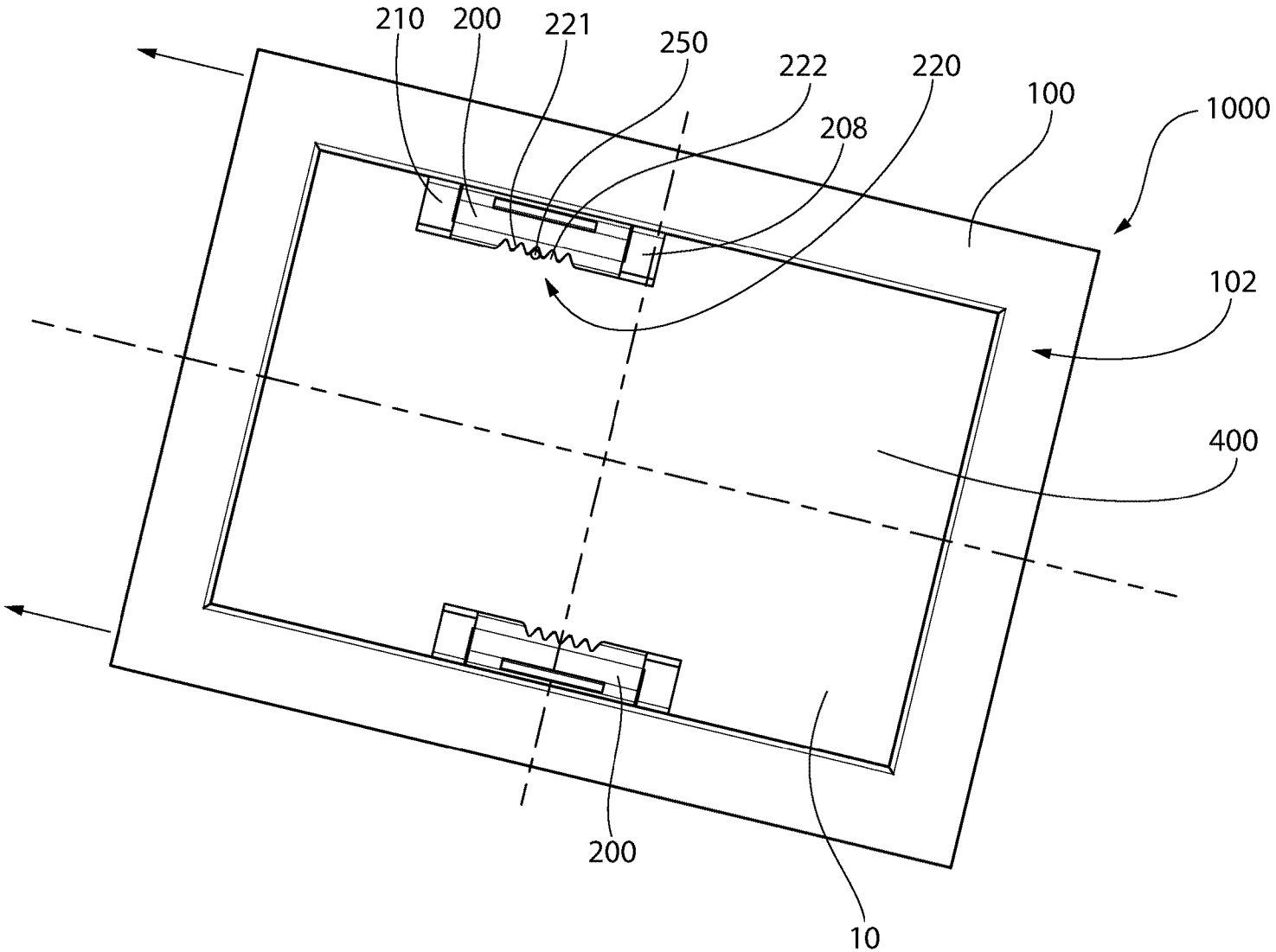
FIGS. 8A and 8B are rear views of the frame apparatus of FIG. 1A illustrating a self-leveling feature in accordance with one embodiment.
Figure 8B:
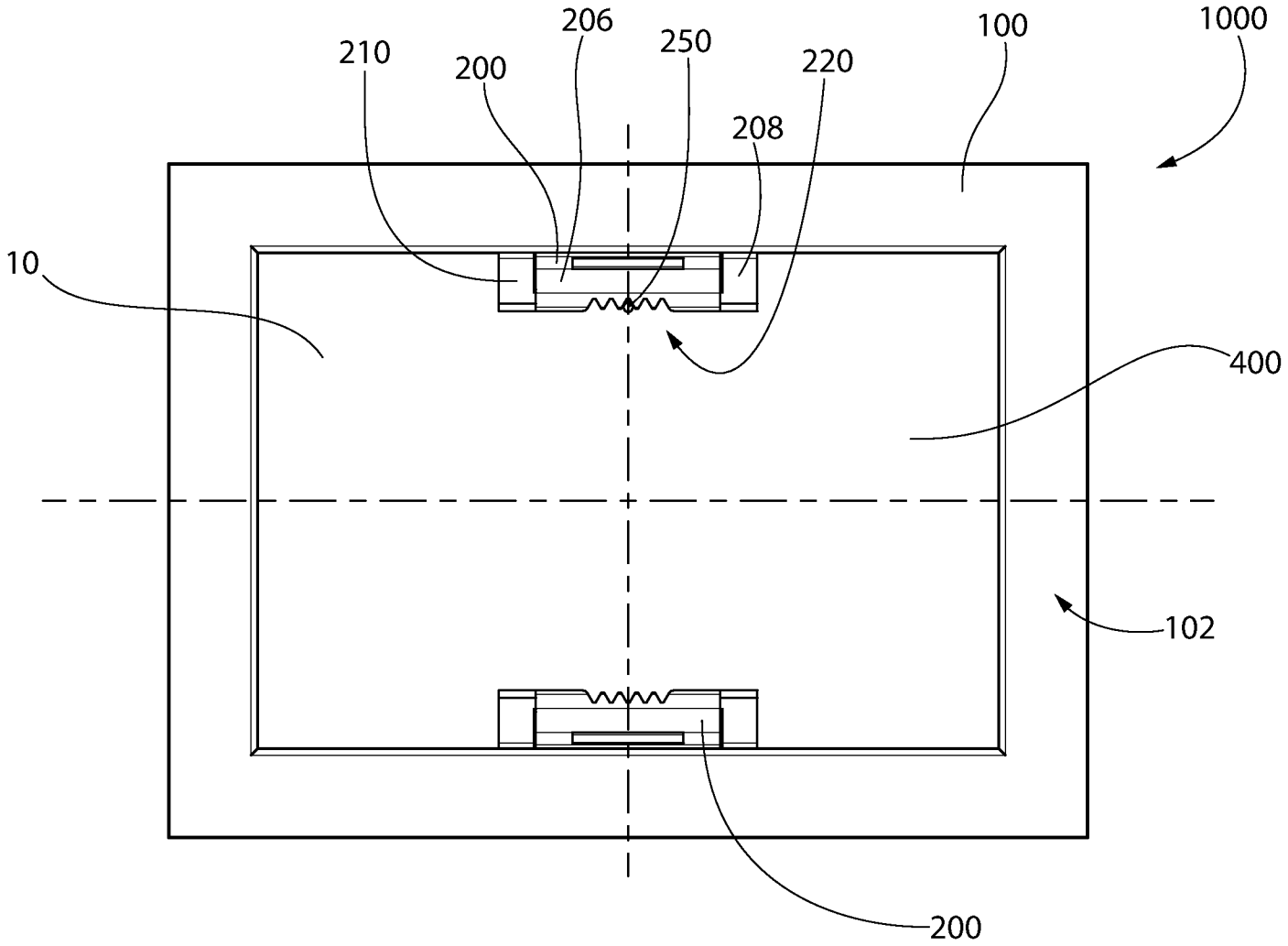

Referring to FIGS. 8A and 8B, the sliding movement of the clip members 200 facilitates ensuring that the frame 100 is hung in a level manner. Ensuring a level hang from a wall is an important consideration in frame hanging. There are many devices in existence which are intended to assist a user in ensuring that frames hung from a wall are level. However, the clip members 200 are an advancement in that the same component that is used to secure the article within the frame 100 is also used to easily ensure that the frame 100 is hung in a level manner.

FIG. 8A illustrates the frame 100 hung from a wall as seen through the wall (the wall is not illustrated in the drawings to enable the frame 100 to be seen). A hanging element 250 is illustrated protruding from the wall. The hanging element 250 may be a screw, a nail, or any other component commonly used to hang frames, particularly frames that use a sawtooth-style hanger, from a wall. The hanging feature 220 of the clip member 200 is made to engage the hanging element 250. More specifically, the hanging element 250 is located within one of the notches 222 between adjacent ones of the teeth 221 of the hanging feature 220 of the clip member 200. At first, the frame 100 is not level in that the two side surfaces of the frame 100 are not perpendicular to the plane of the floor and the top and bottom surfaces are not parallel with the plane of the floor (FIG. 8A). However, with the clip member 200, this can be easily remedied.

Specifically, in order to level the frame 100, a user can grip the frame 100 and move it along the wall to one side or the other while the hanging feature 220 of the clip member 200 remains engaged or coupled to the hanging element 250 protruding from the wall so that the clip member 200 moves relative to the frame 100 (or the frame 100 moves relative to the clip member 200). During this movement of the frame 100, the clip member 200 slides within the channel 120 relative to the frame 100, which assists in leveling the frame 100 as it hangs from the wall. The location of the clip member 200 relative to the wall does not change, but rather the location of the frame 100 relative to the wall changes during this leveling process. As can be seen in FIG. 8B, the clip member 200, and more specifically the hanging element 250, is centered within the frame 100. This centering levels the frame 100 as it is hung from the wall, and this leveling is achieved without removing the frame 100 from the wall.

Figure 9A:
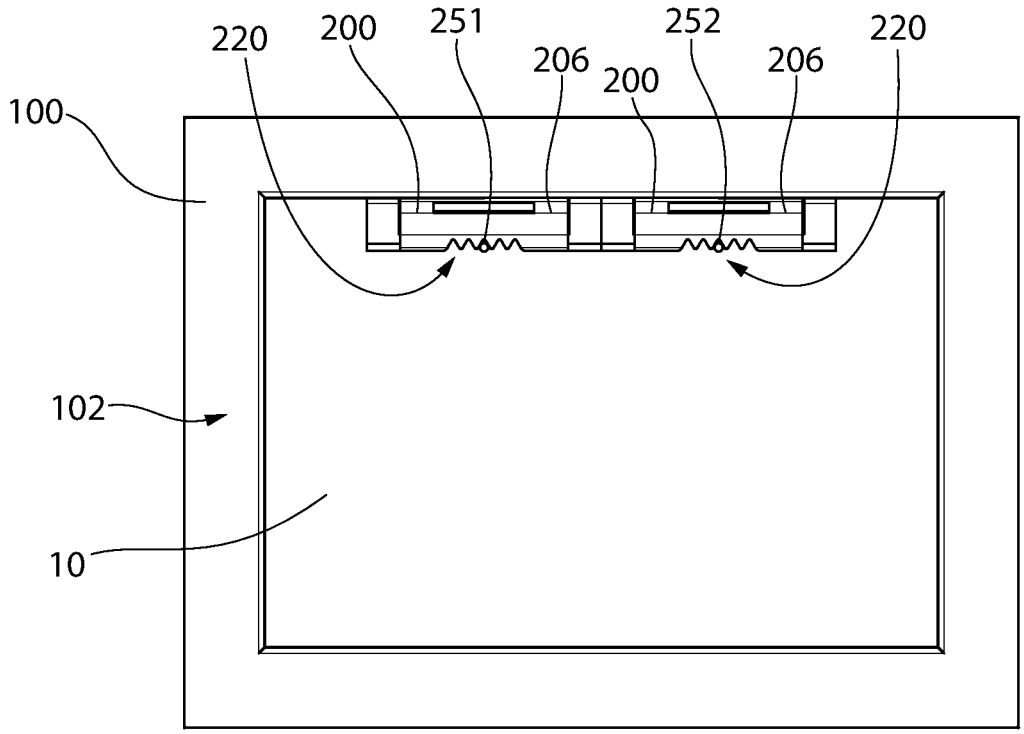
FIGS. 9A and 9B are rear views of the frame apparatus of FIG. 1A illustrating a self-leveling feature in accordance with another embodiment.
Figure 9B:
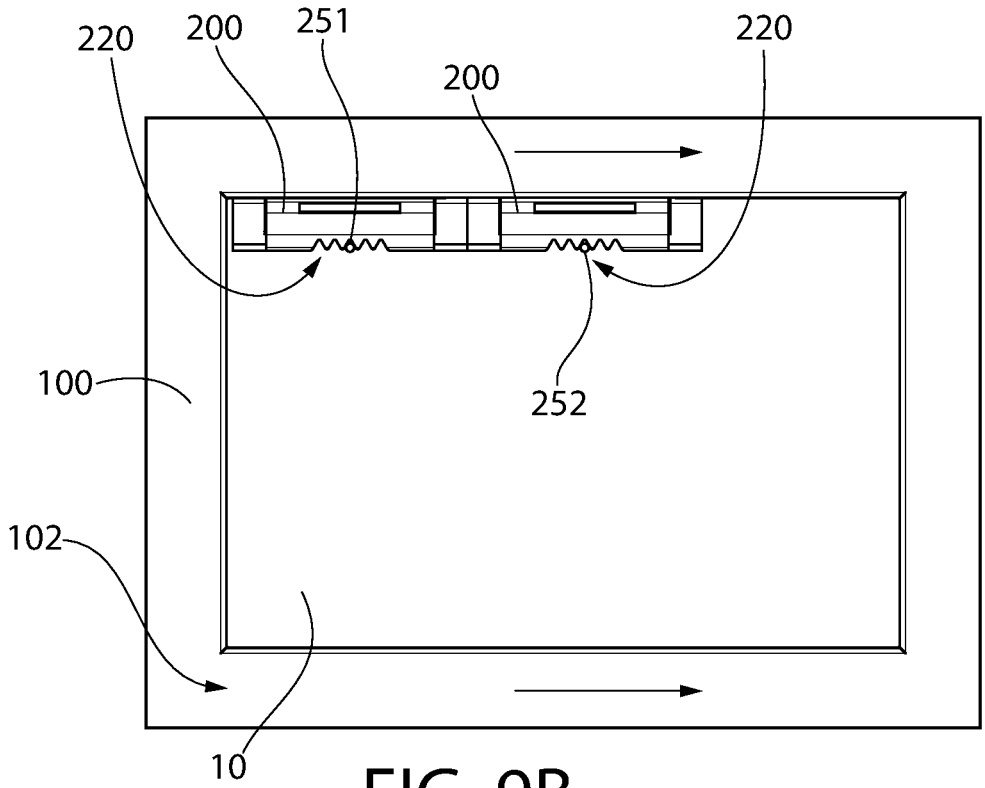

Referring to FIGS. 9A and 9B, the frame apparatus 1000 is illustrated with two of the clip members 200 coupled to the frame 100 within the same linear section of the channel 120. Although the channel 120 is not visible in FIGS. 9A and 9B, the details of its structure and location described above are applicable here. Similar to FIGS. 8A and 8B, FIGS. 9A and 9B is a view of the frame 100 hung from a wall as seen through the wall (the wall is not illustrated in the drawings to enable the frame 100 to be seen). In this embodiment, there are two hanging elements 251, 252 (i.e., screws, nails, or the like) protruding from the wall to which it is desired to hang the frame 100. The hanging feature 220 of each of the clip members 200 is coupled to one of the hanging elements 251, 252.

The benefit of having two of the clip members 200 mounted in one of the linear sections of the channel 200 is as follows. As described in FIGS. 8A and 8B, when only one clip member 200 is used for hanging, the tilt/orientation of the frame 100 on the wall will change as the frame is slid side-to-side along the wall. By using two of the clip members 200 in one of the linear sections of the channel 200, the frame 100 can be slid side-to-side along the wall without changing the orientation at which it is hung from the wall. Specifically, because there are two hanging features 220 (one on each clip member 200), there are two contact points between the hanging elements 251, 252 and the frame apparatus 1000. Thus, as long as the hanging elements 251, 252 are located on the wall in an aligned manner (such that a plane parallel to the floor of the room intersects both of the hanging elements 251, 252), the frame 100 will remain at a level hanging orientation. This is true regardless of the movement of the frame 100 along the wall, which is shown in FIG. 9B compared to FIG. 9A.

Referring to FIG. 10, an alternative embodiment of a frame 600 is illustrated. The frame 400 is identical to the frame 100 except for the frame profile. Specifically, rather than having straight perpendicular sides, the frame 600 has a curved front profile, which may be used depending on the desired aesthetic. Basically, many different frame profiles can be used with the inventive features described herein. Thus, FIG. 10 is intended to portray that different frame profiles may be used with the clip member 200. The frame 600 simply needs to include a channel (such as the channel 120) that is capable of or configured to interact with the first portion 201 of the clip member 200 to facilitate coupling of the clip member 200 to the frame 600. The rabbet 110 and the stack 601 therein may be similar to that which has been described in detail above.

Figure 11:
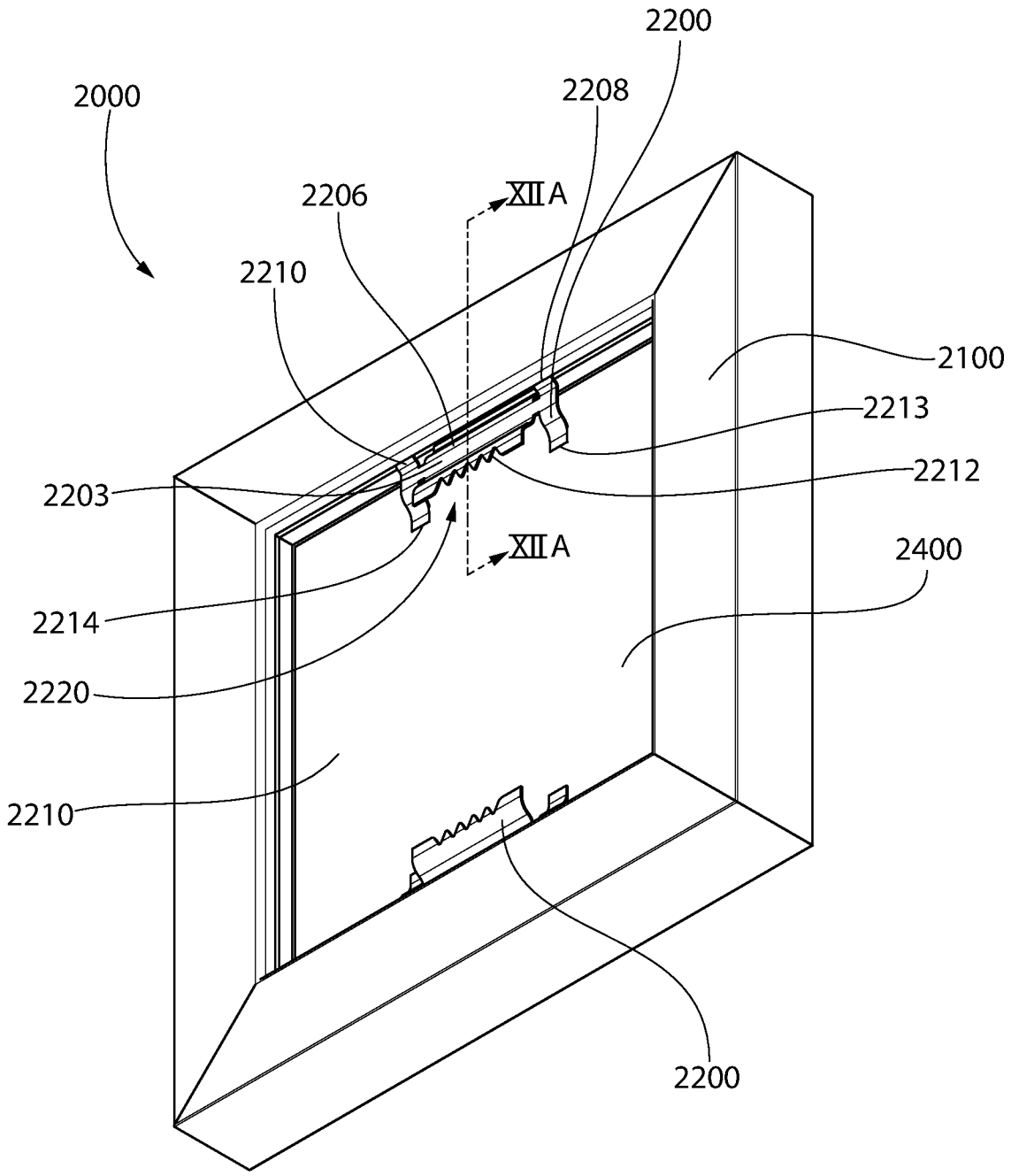
FIG. 11 is a rear perspective view of a frame apparatus having a frame and a clip member coupled thereto in accordance with another embodiment of the present invention.
Figure 11A:
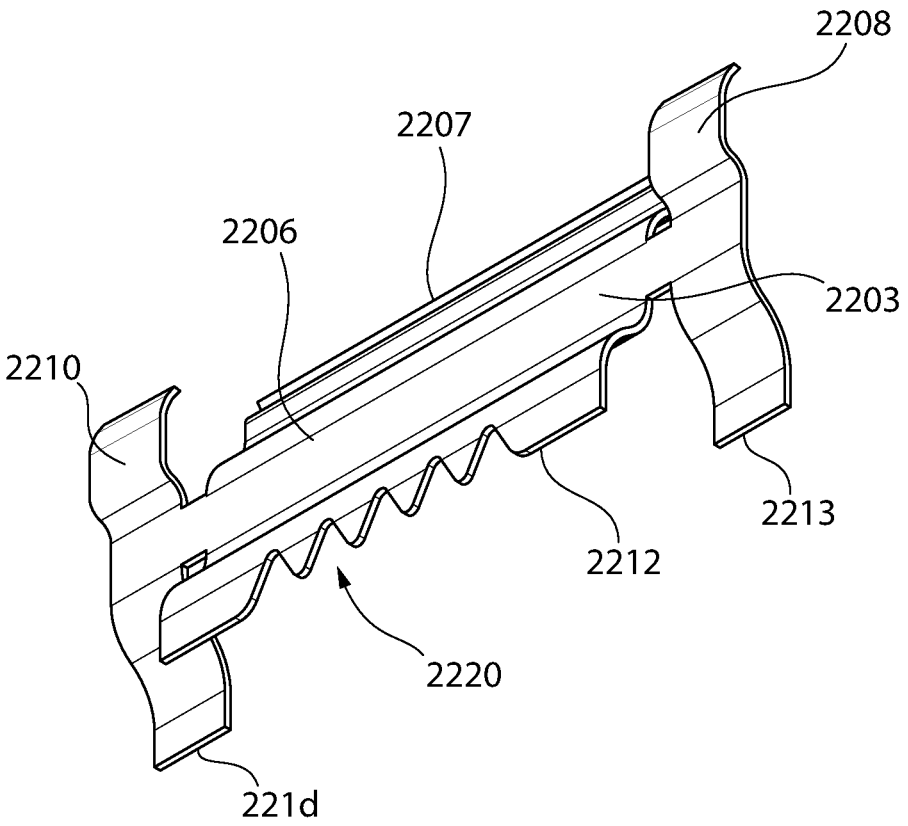
FIG. 11A is a perspective view of the clip member of FIG. 11.
Figure 12A:
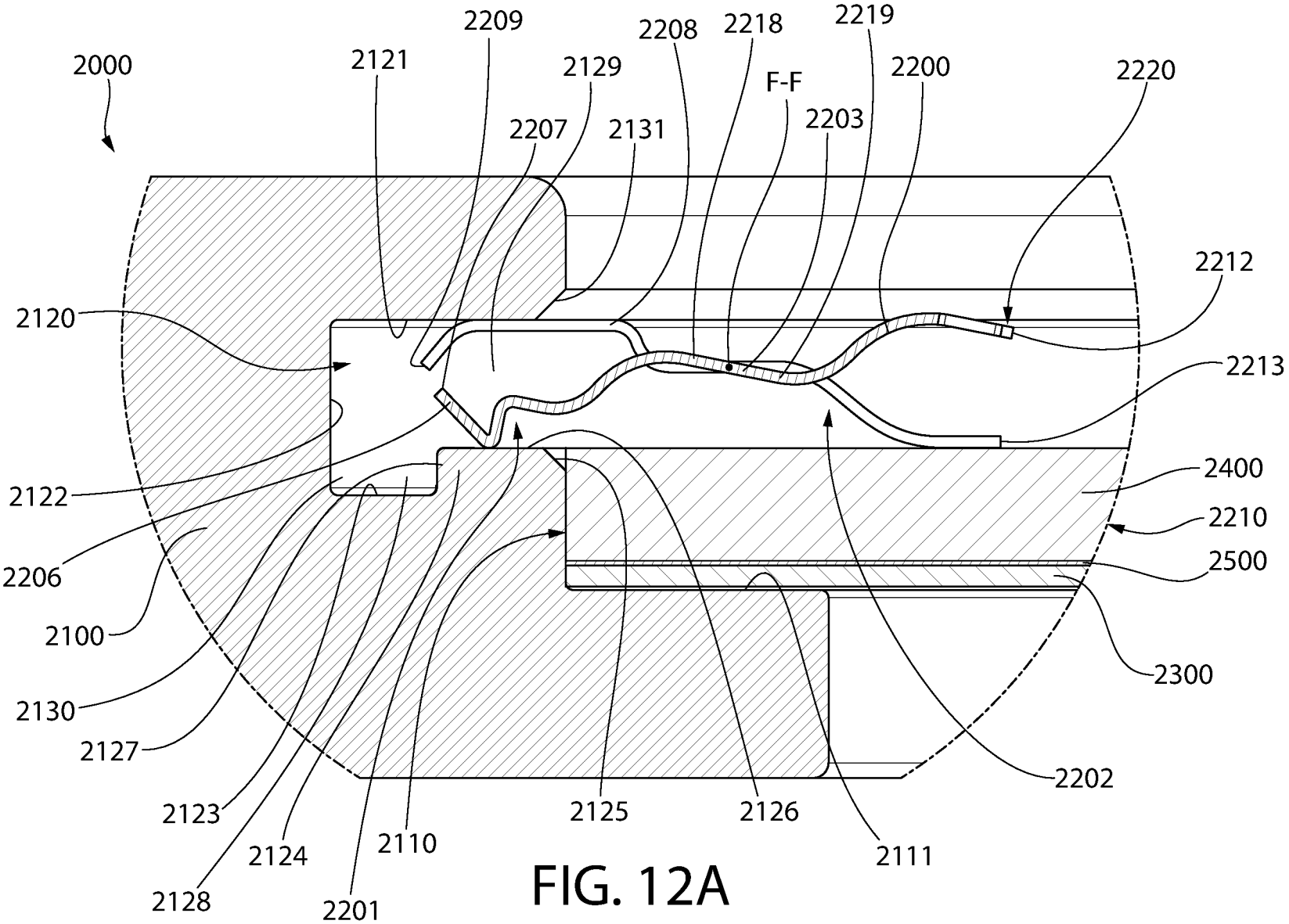
FIGS. 12A and 12B are cross-sectional views taken along line XIIA-XIIA of FIG. 11 illustrating the process of coupling the clip member to the frame.
Figure 12B:
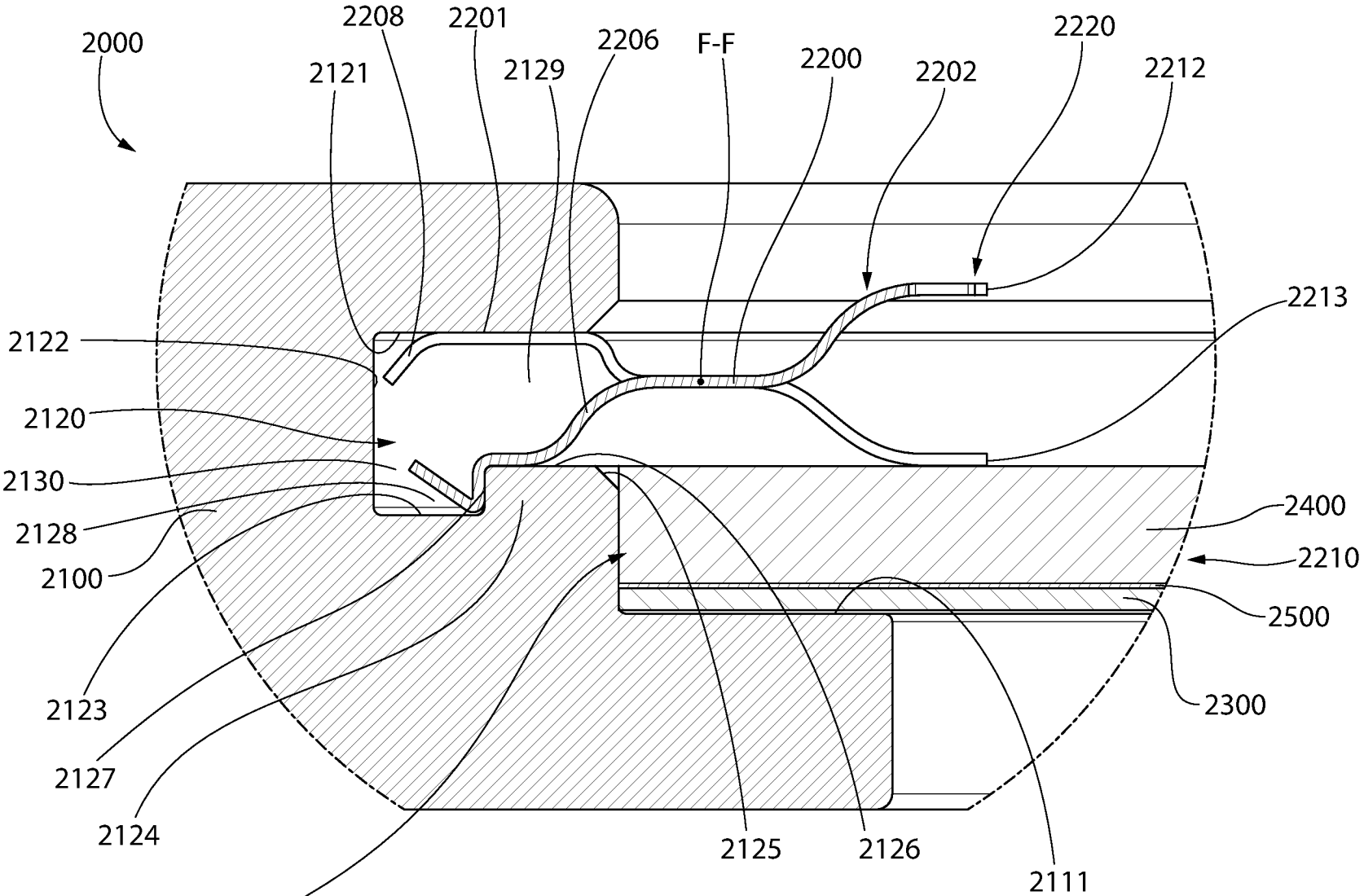

FIGS. 11-12B illustrate an alternative embodiment of a frame apparatus 2000 in accordance with the present invention. Many of the features of the frame apparatus 2000 are similar to the frame apparatus 1000 and such features will not be described herein below, it being understood that the description above applies. Thus, only the new features or different features of the frame apparatus 2000 relative to the frame apparatus 1000 will be described with reference to FIGS. 11-12B.

The frame apparatus 2000 generally comprises a frame 2100, a clip member 2200, and a stack 2210 comprising a glazing 2300, a backer panel 2400, and an article 2500 (although the stack 2210 may omit the glazing 2300 and/or the backer panel 2400 and in other embodiments the stack 2210 may be a mirror or other article). The frame 2100 has a rabbet 2110 defined by a floor 2111 and a sidewall 2112 of the frame 2100. Furthermore, a channel 2120 is formed into the sidewall 2112 of the rabbet 2110. The channel 2120 is defined by a top surface 2121, a sidewall surface 2122, and a bottom surface 2123. In this embodiment, a protrusion 2124 extends from the bottom surface 2123 into the channel 2120 towards the top surface 2121. The protrusion 2124 comprises a leading edge 2125 having a chamfer, a top surface 2126, and a trailing edge 2127. The trailing edge 2127 of the protrusion 2124 is spaced apart from the sidewall surface 2122 of the channel 2120 by a gap 2128. Furthermore, the top surface 2121 also has a chamfered portion 2131 that facilitates insertion of the clip member 2200 into the channel 2120.

The stack is positioned within a rabbet 2110 of the frame 2100 and is secured within the rabbet 2110 by being sandwiched between a floor 2111 of the rabbet 2110 and the clip member 2200 similar to the previously described embodiment. The main differences between the frame apparatus 2000 and the frame apparatus 1000 is the shape/configuration of the channel 2120 and the shape/configuration of the clip member 2200, the details of which will be described below.

In this embodiment the clip member 2200 is a metal clip, although it is not to be limited as such in all embodiments. The clip member 2200 has a first portion 2201 and a second portion 2202. More specifically, the clip member 220 comprises a base portion 2203, a first leg 2206, a second leg 2208, and a third leg 2210. In this embodiment, each of the first, second, and third legs 2206, 2208, 2210 extends from both opposing sides of the base portion 2203. Specifically, within the first portion 2201, the first leg 2206 extends from a first side 2218 of the base portion 2203 to a distal end 2207, the second leg 2208 extends from a first side 2218 of the base portion 2203 to a distal end 2209, and the third leg 2210 extends from a first side 2218 of the base portion 2203 to a distal end 2211. Within the second portion 2202, the first leg 2206 extends from a second side 2219 of the base portion 2203 to a proximal end 2212, the second leg 2208 extends from a second side 2219 of the base portion 2203 to a proximal end 2213, and the third leg 2219 extends from a second side 2219 of the base portion 2203 to a proximal end 2214.

The first portion 2201 of the clip member 2200 is inserted into the channel 2120 to couple the clip member 2200 to the frame 2100 and the second portion 2202 of the clip member 2200 is located outside of the channel 2120 and is used to secure the stack 2210 within the rabbet 2110 and to hang the frame 2100 from a wall. In that regard, in the exemplified embodiment the portion of the first leg 2206 that extends from the second side 2219 of the base portion 2203 comprises a hanging feature 2220. More specifically, the hanging feature 2220 is formed into the proximal end 2212 of the first leg 2206 of the clip member 2200. In the exemplified embodiment, the hanging feature 2220 is a sawtooth hanger as with the previously described embodiment of the clip member 200.

The clip member 2200 is biased into an expanded state as illustrated in FIG. 12B and is configured to be capable of flexing into a flexed state as illustrated in FIG. 12A. Thus, as the clip member 2200 begins to be inserted into the channel 2120, the width of the channel 2120 at an entryway section 2129 of the channel 2120 (where the protrusion 2124 is located) causes the clip member 2200 to flex and shrink in height by pivoting about an axis F-F. Specifically, as the clip member 2200 is translated into the channel 2120, the first leg 2206 rides along the stack 2210 and the top surface 2126 of the protrusion 2124 and the distal end 2209 of the second leg 2208 (and also the distal end 2211 of the third leg 2210 although not shown in the drawings) engage the chamfer 2131 of the top surface 2121 of the channel 2120. The chamber 2131 causes the clip member 2200 to flex such that the second and third legs 2208, 2210 pivot about the axis F-F downwardly towards the first leg 2206. The clip member 2200 continues to be translated into the channel 2120 with the first leg 2206 riding along the top surface 2126 of the protrusion 2124 and the second and third legs 2208, 2210 abutting against the top surface 2121 of the channel 2120.

As the first portion 2201 of the clip member 2200 passes beyond the protrusion 2124, the first leg 2106 pivots downwardly about the axis F-F and enters into a nesting section 2130 of the channel 2120. This is because the nesting section 2130 has a greater height than the height of the entryway section 2129. Due to the biasing nature of the clip member 2200, as soon as the height of the channel 2120 increases, the clip member 2200 pivots back into its normal biased state by the first leg 2206 pivoting about the axis F-F while the second and third legs 2208, 2210 remain in contact with the top surface 2121 of the channel 2120.

Thus, the functionality and assembly of the frame apparatus 2000 is similar to the frame apparatus 1000 except there are minor differences in the structure of the various components, which will be better understood from reviewing the drawings which form a part hereof. The clip member 2200 retains the stack within the rabbet 2110 in much the same way as described above. Specifically, the second and third legs 2208, 2210 within the second portion 2202 of the clip member 2200 compress the stack 2210 within the rabbet 2110. The hanging feature 2220 at the proximal end 2212 of the first leg 2206 is accessible for hanging the frame apparatus 2000 from a hanging element protruding from a wall. Furthermore, the clip member 2200 is configured to slide within the channel 2120 while mounted to the frame 2000 to assist in level hanging of the frame apparatus 2000 in a similar manner to that described above with regard to the frame apparatus 1000.

Figure 13A:
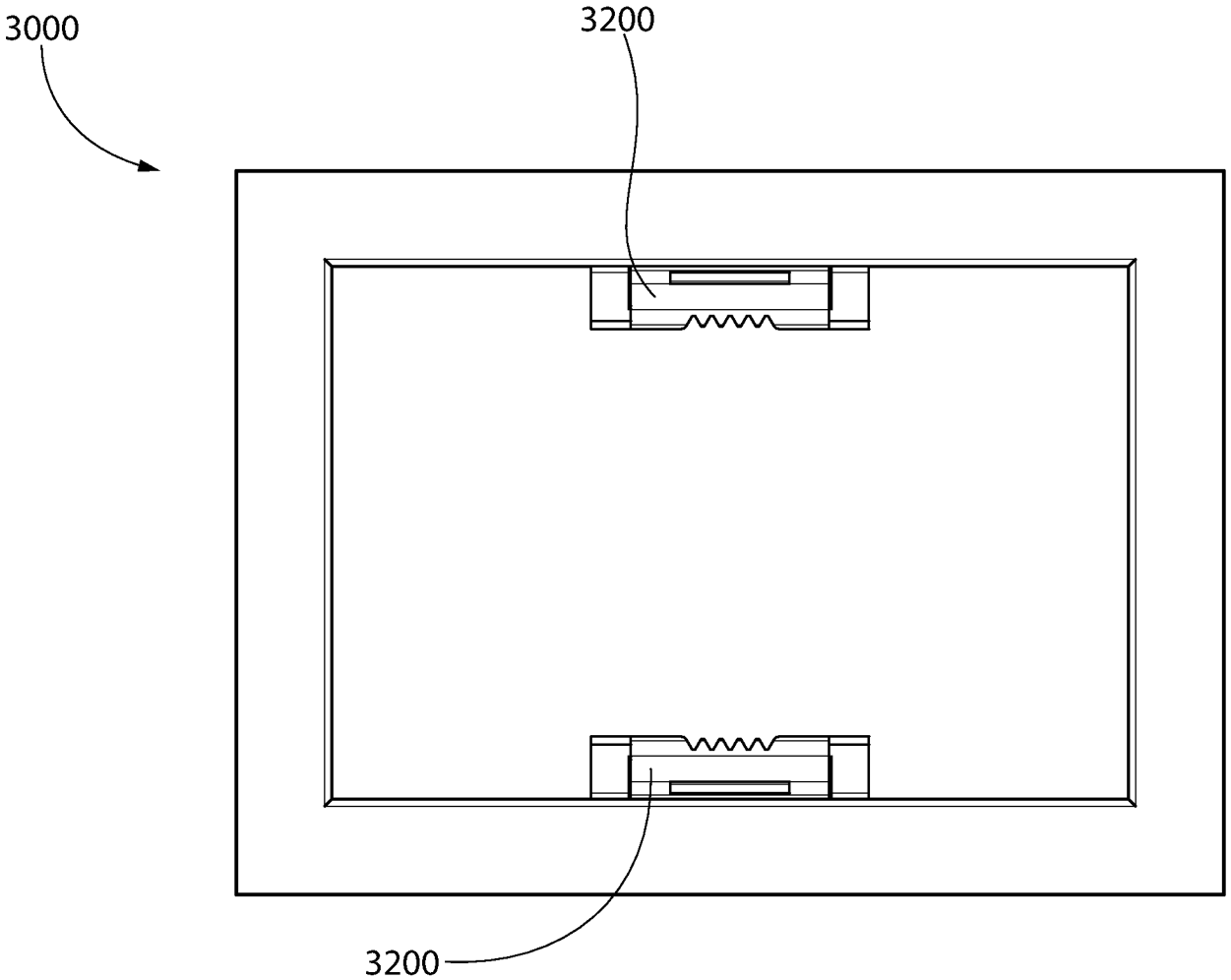
FIG. 13A is a rear view of a frame apparatus illustrating the frame in a landscape orientation.
Figure 13B:
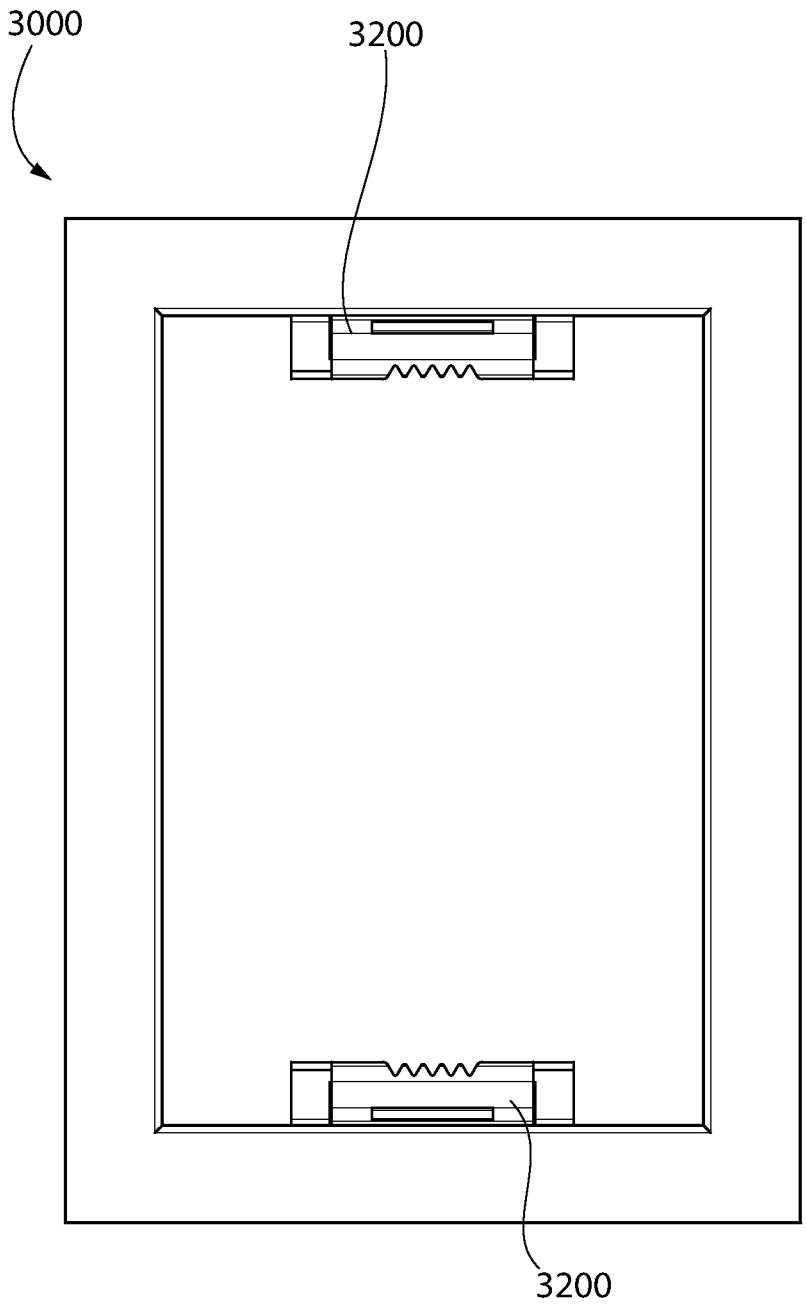
FIG. 13B is a rear view of the frame apparatus of FIG. 13A illustrating the frame in a portrait orientation.

Referring to FIGS. 13A and 13B, a frame apparatus 3000 is illustrated. FIG. 13A illustrates the frame apparatus 3000 in a landscape orientation and FIG. 13B illustrates the same frame apparatus 3000 in a portrait orientation. FIGS. 13A and 13B are intended to show that the clip members 3200 may be moved to different portions or linear sections of the channels as needed. Specifically, when in the landscape orientation of FIG. 13A, the clip members 3200 are on the top and bottom portions of the frame 3100. When in the portrait orientation in FIG. 13B, the clip members 3200 are on the top and bottom portions of the frame 3100 even though these are different portions than in FIG. 13A.

In certain embodiments, it is desirable that two of the clip members 200, 2200, 3200 (the numeral 200 is used for the remainder of this discussion for the clip members, it being understood that the same description applies to all of the clip members) are used in any of the frame assemblies described herein. Furthermore, such clip members 200 should be located on opposite sides of the channel rather than adjacent sides of the channel to ensure that the clip members 200 adequately retain the stack within the rabbet of the frame. The top and bottom are the preferable locations so that the top clip member 200 can also be used to hang the frame apparatus from a wall as described herein.

Figure 13C:
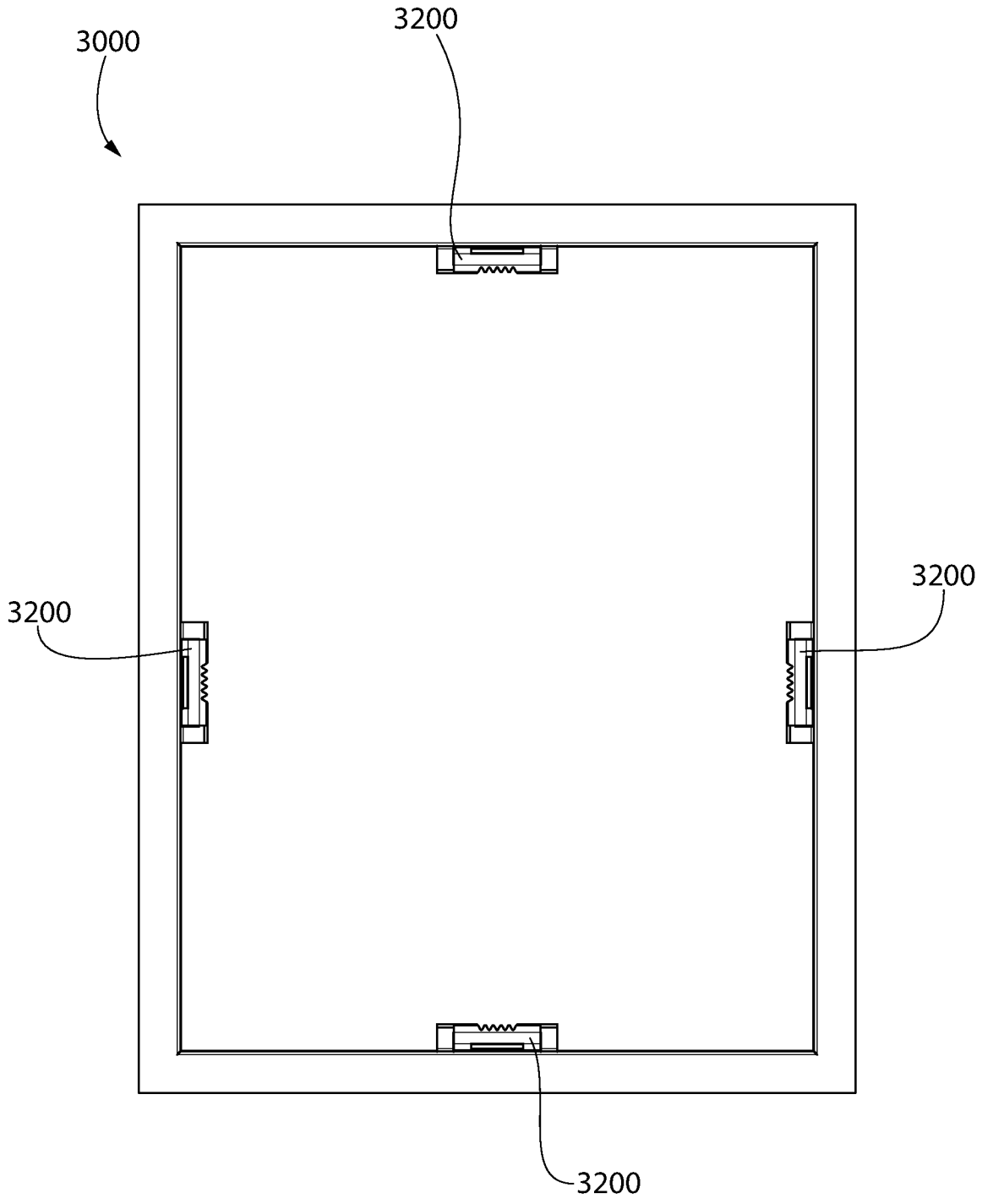
FIG. 13C is a rear view of a frame apparatus illustrating four of the clip members coupled to the frame.

FIG. 13C illustrates an alternative embodiment in which the frame apparatus 3000 includes four of the clip members 3200, one on each of the sides or linear sections of the channel. In other embodiments, for example as discussed above with reference to FIGS. 9A and 9B, more than one of the clip members may be located within one or more of the linear sections of the channel. Although any number of the clip members 3200 may be used, it is preferable that at least two are used. Although the maximum number illustrated is four of the clip members 3200, more than four of the clip members 3200 may be used depending on the dimensions of the frame to which they are coupled or mounted.

Figure 14:
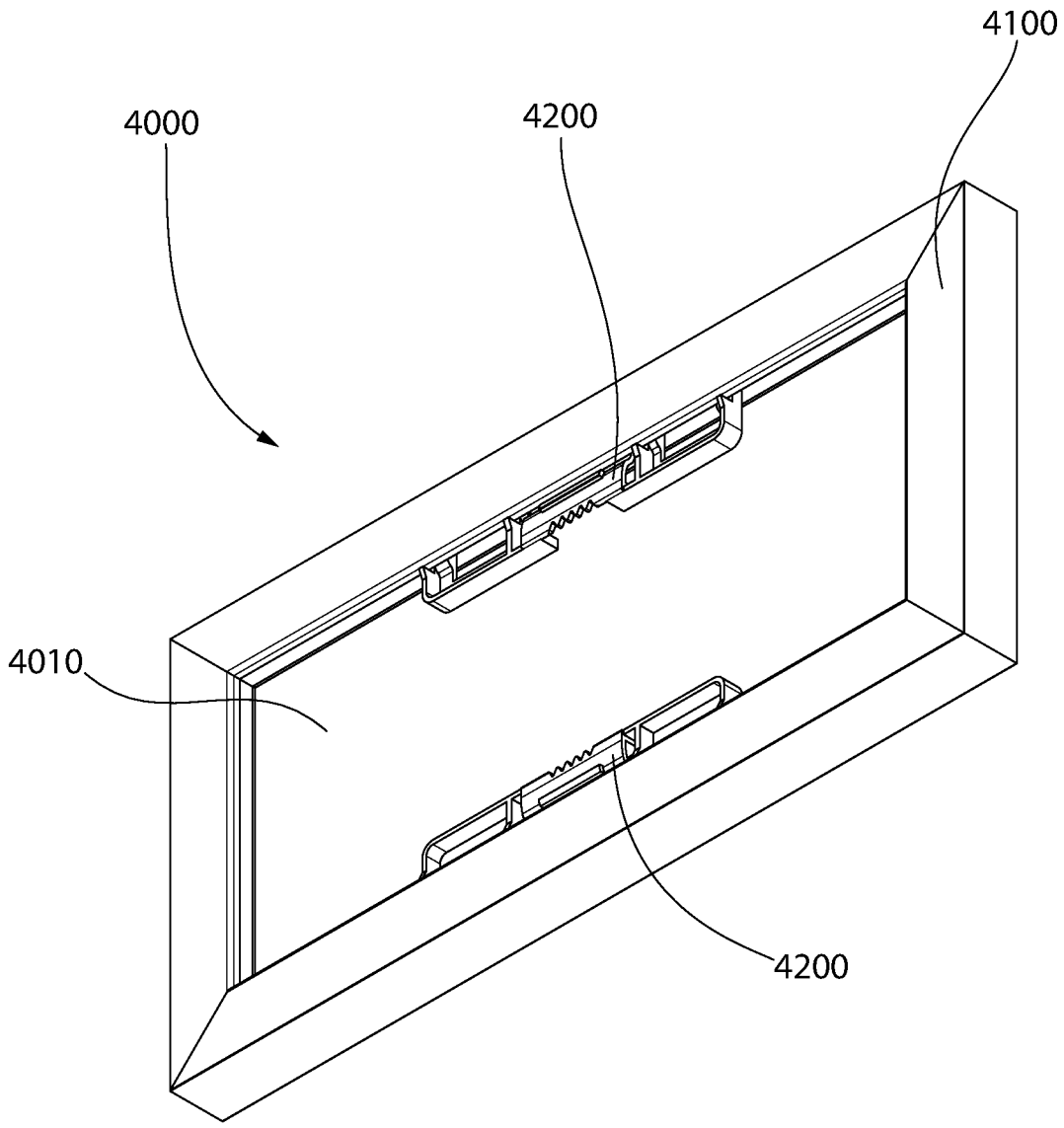
FIG. 14 is a rear perspective view of a frame apparatus having a frame and a clip member coupled thereto in accordance with another embodiment of the present invention.
Figure 15:
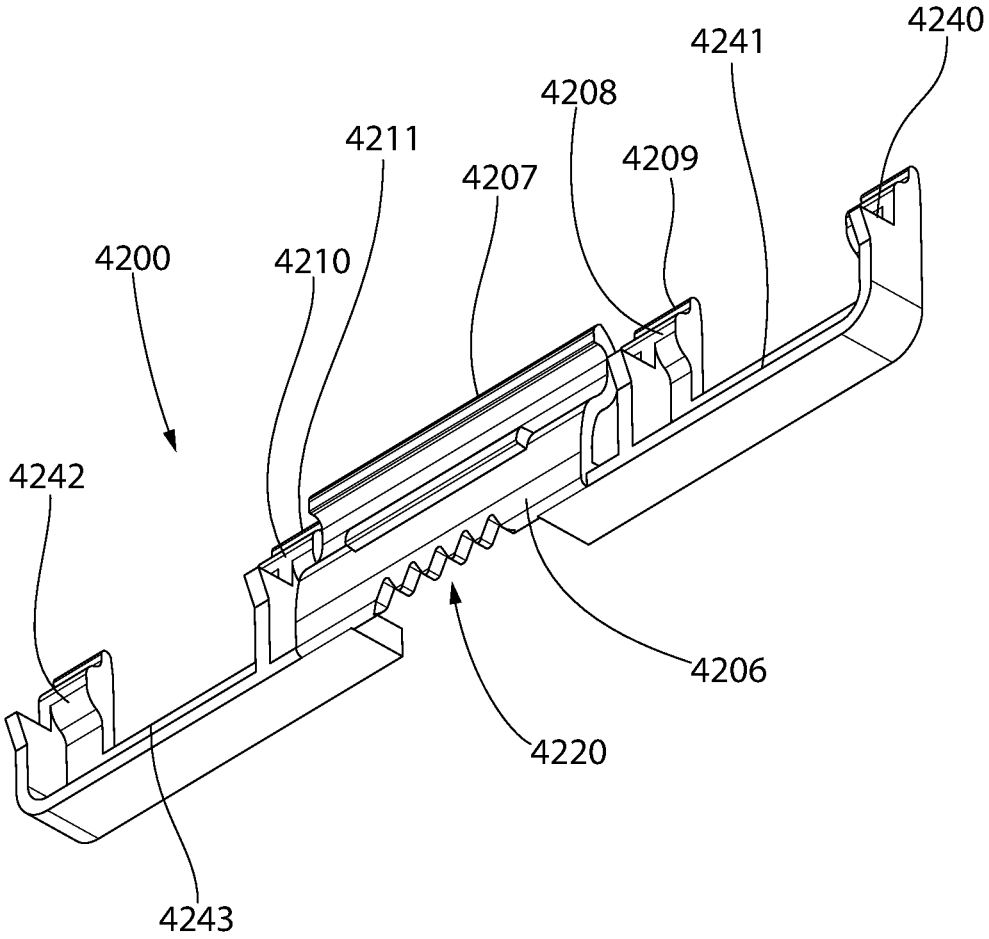
FIG. 15 is a top perspective view of the clip member of FIG. 14.
Figure 16:
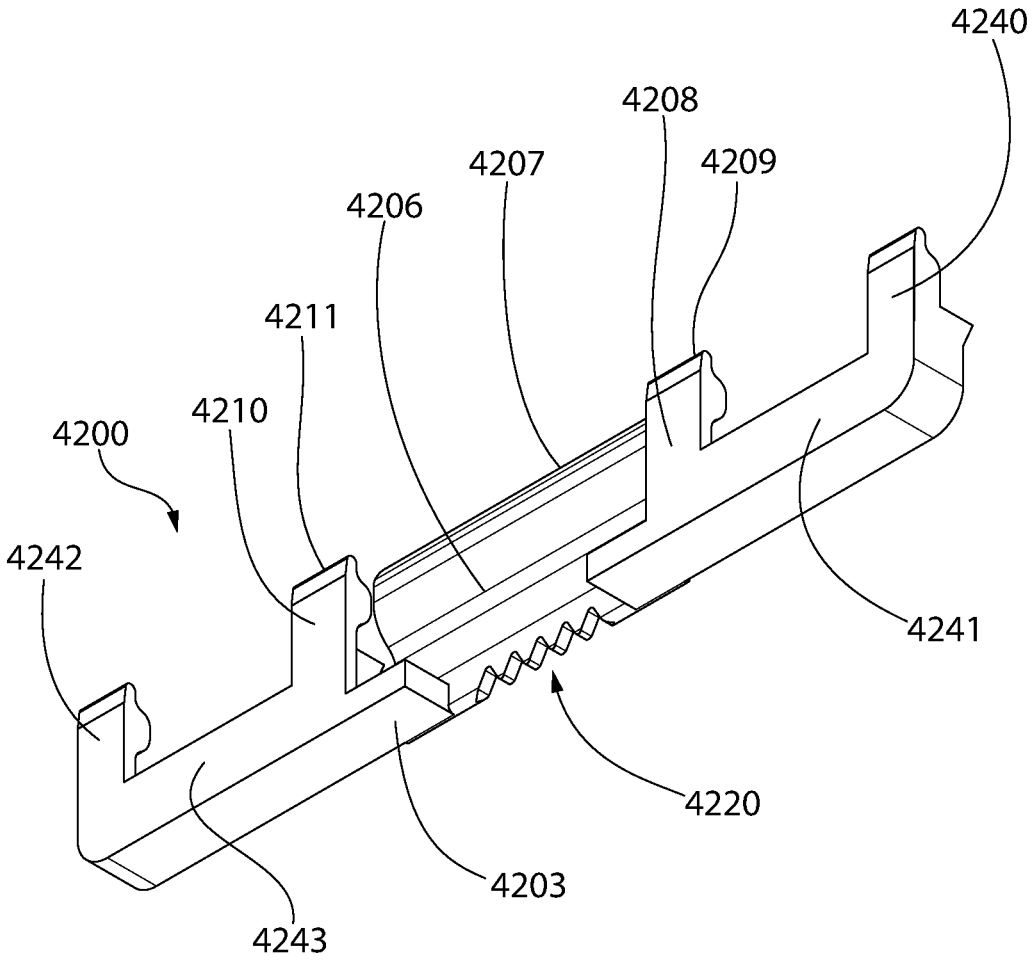
FIG. 16 is a bottom perspective view of the clip member of FIG. 14.

Referring to FIGS. 14-16, a frame apparatus 4000 and a clip member 4200 thereof is illustrated. The frame apparatus 4000 generally comprises a frame 4100 that retains a stack 4010 and one or more of the clip members 4200 detachably coupled to the frame 4100 such that the clip members 4200 are slidable within the channel of the frame 4100 when the clip members 4200 are coupled thereto. The structural details of the frame 4100 are essentially identical to those of the frame 100 described above, and thus it will not be repeated herein for brevity it being understood that the description of the frame 100 provided above is applicable. The difference between the frame apparatus 4000 and the frame apparatus 1000 is in the structure of the clip members 4200 as described below.

The clip members 4200 are similar to the clip members 200 except that they have an extended length so that they take up more of the linear length of the linear section of the channel within which they are mounted. This enables the clip members 4200 to be better suited for retaining the stack 4010 within the rabbet of the frame 4100. Thus, the clip member 4200 still has a first leg 4206 similar to the first leg 206 of the clip member 100. The first leg 4206 extends from a base portion 4203 to a distal end 4207. The edge of the first leg 4206 opposite the distal end 4207 forms a hanging feature 4220 for hanging the frame 4100 from a wall. Furthermore, the clip member 4200 has a second leg 4208 extending from the base portion 4203 to a distal end 4209 and a third leg 4210 extending from the base portion 4203 to a distal end 4211. However, in this embodiment the second leg 4208 is connected to a fourth leg 4240 via an extender 4241 and the third leg 4209 is connected to a fifth leg 4242 via an extender 4243. The second and fourth legs 4208, 4240 and the third and fifth legs 4210, 4242 collectively form the stack retaining feature of the clip members 4200 because those legs contact the rear of the stack 4010 and secure it within the rabbet when the clip members 4200 are coupled to the frame 4100 as has been described herein above.

Figure 17:
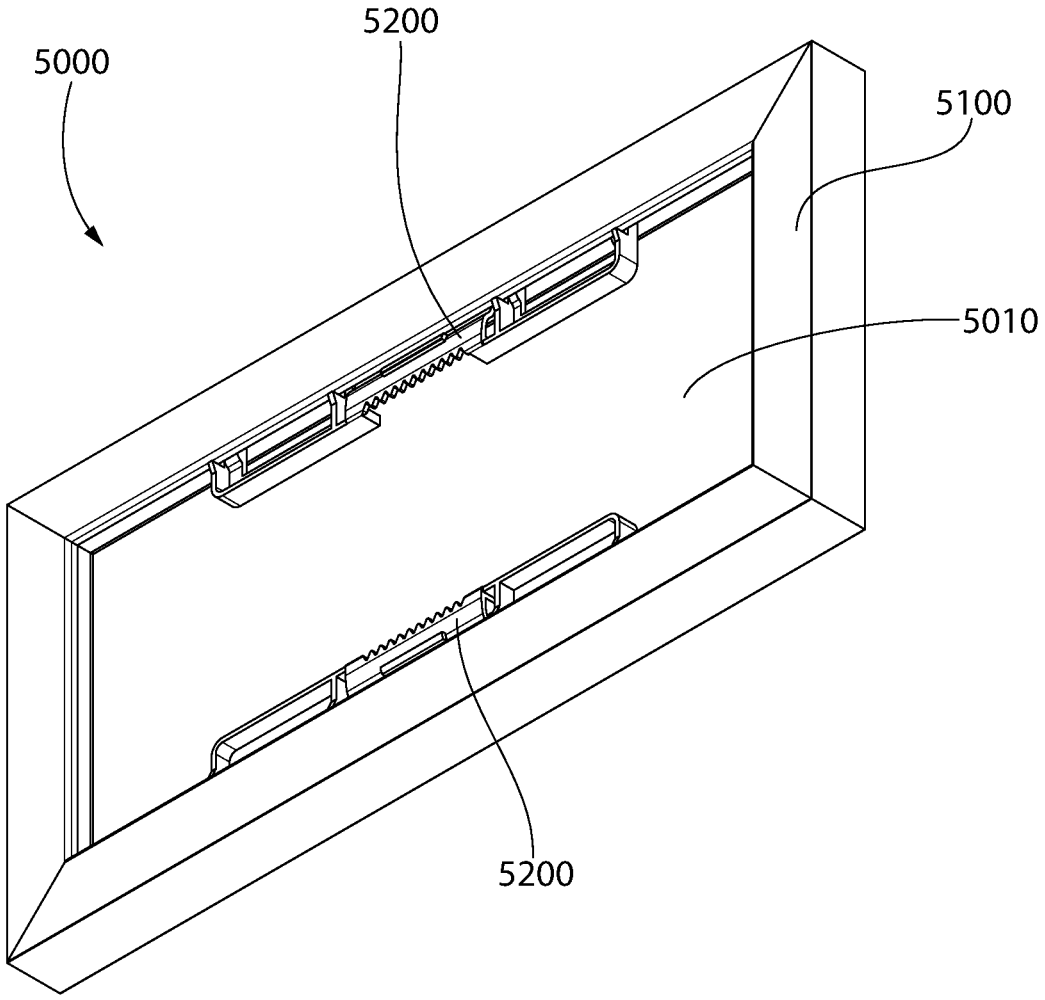
FIG. 17 is a rear perspective view of a frame apparatus having a frame and a clip member coupled thereto in accordance with another embodiment of the present invention.
Figure 18:
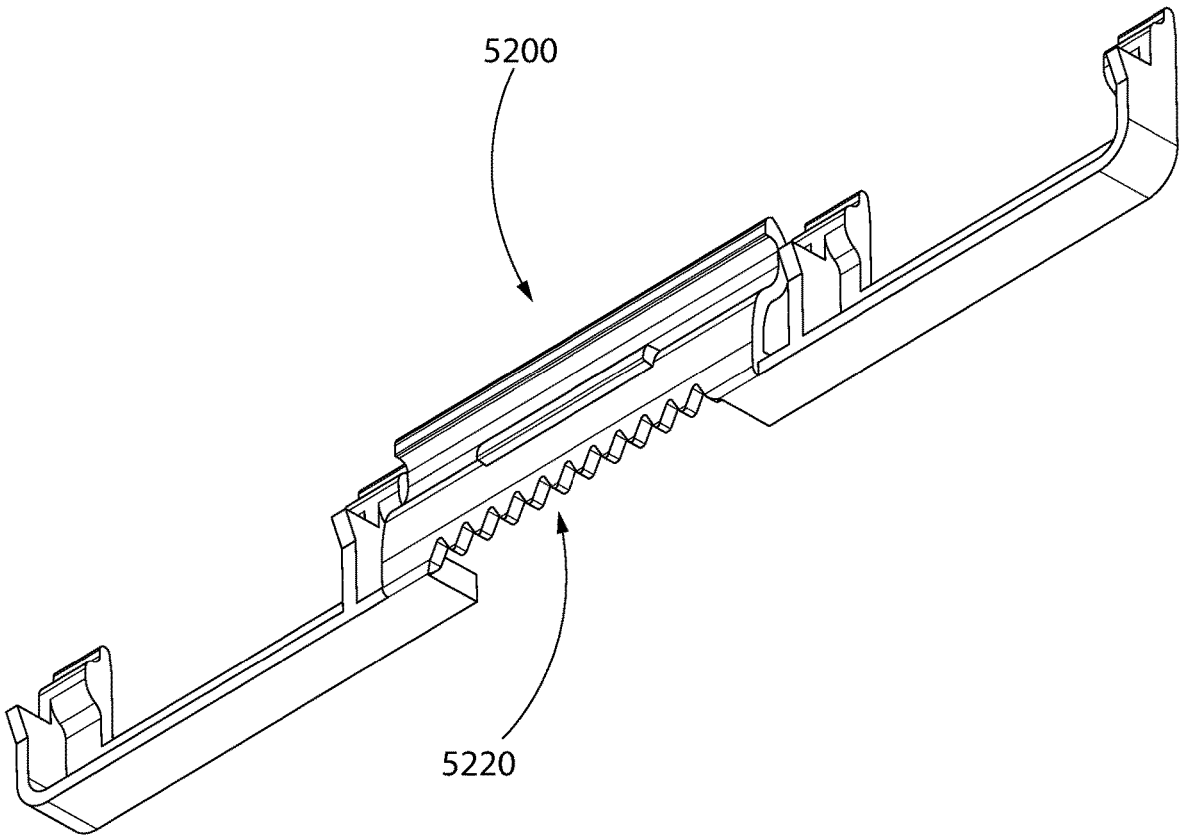
FIG. 18 is a top perspective view of the clip member of FIG. 17.
Figure 19:
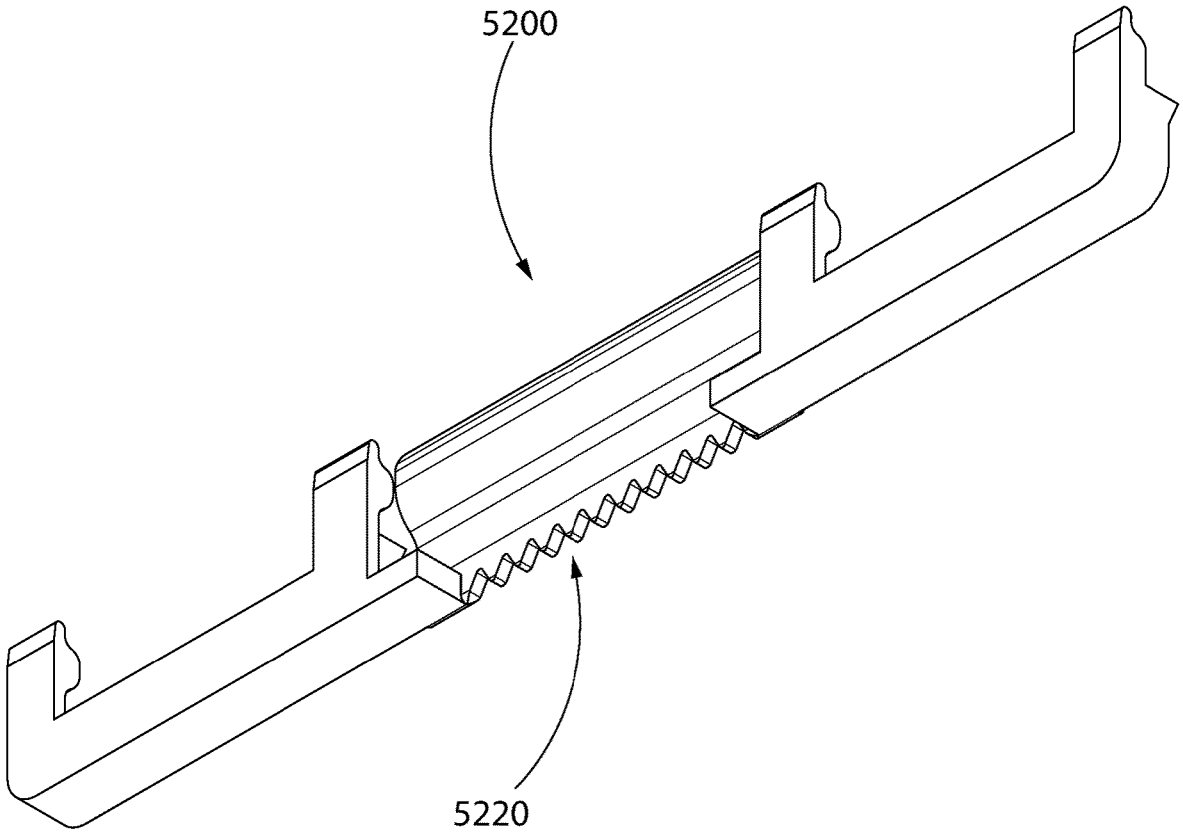
FIG. 19 is a bottom perspective view of the clip member of FIG. 17.
Figure 20:
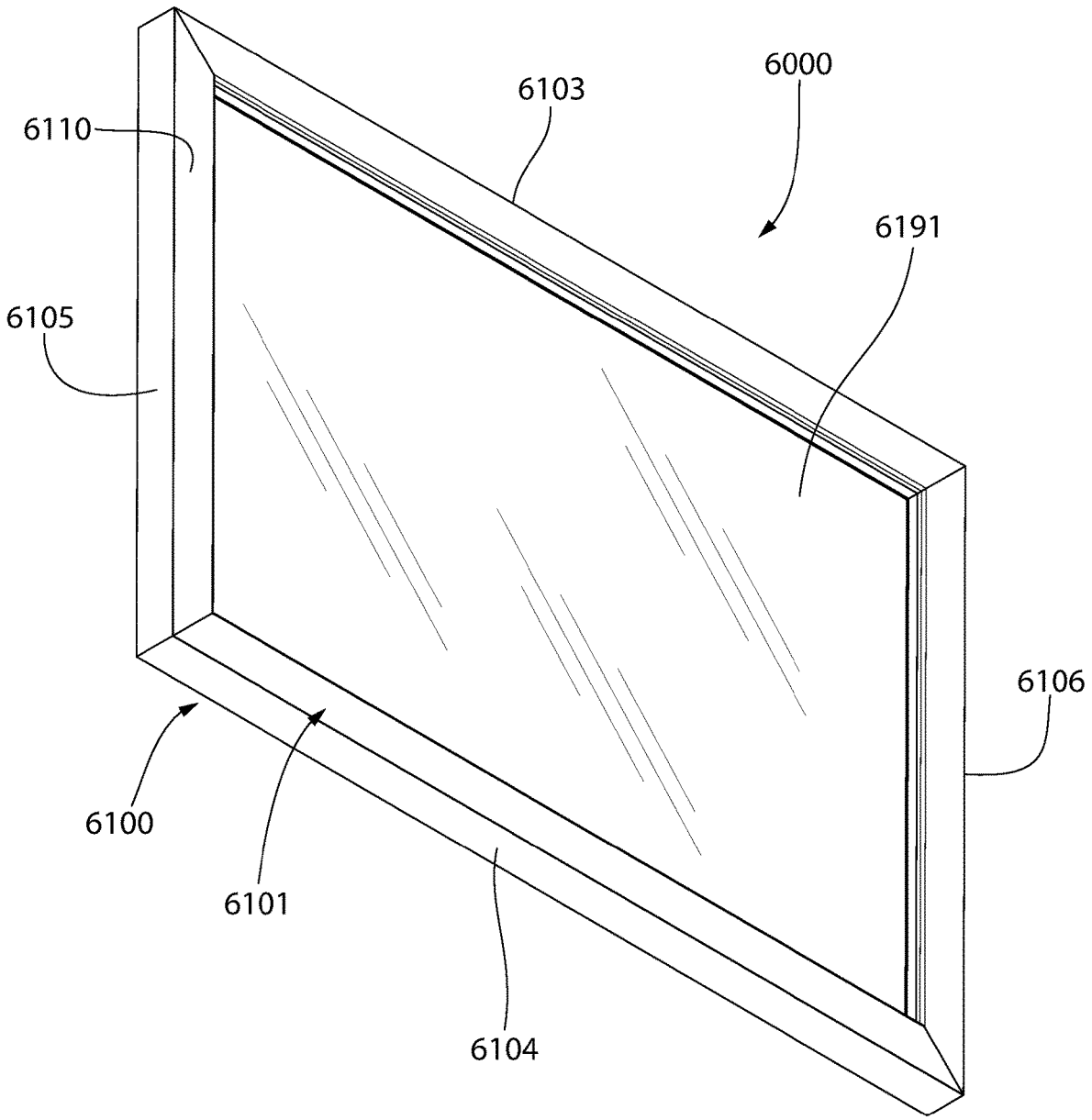
FIG. 20 is a front perspective view of a frame apparatus in accordance with another embodiment of the present invention.

Referring to FIGS. 17-19, another embodiment of a frame apparatus 5000 and a clip member 5200 thereof is illustrated in accordance with the present invention. The frame apparatus 5000 generally comprises a frame 5100 that retains a stack 5010 and one or more of the clip members 5200 detachably coupled to the frame 5100 such that the clip members 5200 are slidable within the channel of the frame 5100 when the clip members 5200 are coupled to the frame 5100. The frame apparatus 5000 is identical to the frame apparatus 4000 previously described except for a minor variation in the structure of the clip members 5200, as described below.

The difference between the clip members 5200 and the clip members 4200 is that the length of each of the legs is increased. Thus, the structure of the clip member 5200 is identical to the structure of the clip member 4200, except each feature is longer. This again provides a potential for increased retention of the stack 5010 within the rabbet of the frame 5100. Furthermore, this increases the length of the hanging feature 5220 which better enables a user to ensure that a part of the hanging feature 5220 comes into contact with a hanging element protruding from a wall when it is time to hang the frame apparatus 5000 from a wall.

Although described herein as being a frame (such as one that is used to protect and display photographs or the like), the concepts described herein may also be applicable to a mirror. Thus, the stack 10 may simply be a mirror in some embodiments. Specifically, a mirror may be hung from a wall or vertical surface using one of the clip members described herein to facilitate a level hanging of the mirror. Such a mirror might be placed within a frame, and the clip members would be coupled to the frame in a similar manner to that which has been described herein above. Furthermore, any other apparatus aside from frames and mirrors, including without limitation shelves, storage boxes, cabinets, or the like that may be desirable to hang from a wall may be used in conjunction with the clip members described herein to facilitate a level hanging of that apparatus or object.

FIGS. 20-40B illustrate a frame apparatus 6000 and related accessories in accordance with an embodiment that is distinct from the description of FIGS. 1-19 provided herein above. It is possible that the same term or phrase may be used to describe different features of the invention of FIGS. 20-40B as compared with the invention(s) of FIGS. 1-19. Thus, for FIGS. 20-40B, the below description applies such that if a term is used in a way that conflicts with how that same term was used above to describe features of FIGS. 1-19, it should be appreciated that the definition provided below is applicable. Nonetheless, certain details of some of the structural components will not be repeated herein below in the interest of brevity, it being understood that the description above may be applicable. For example, the description above with regard to the manufacture and materials of the frame 100 is equally applicable to the frame described below. Thus, reliance on the above description for some features of the invention(s) described below should be permitted to the extent that the description above does not conflict with the description below.

Referring to FIGS. 20-23, the frame apparatus 6000 is illustrated in accordance with an embodiment of the present invention. The frame apparatus 6000 generally comprises a support structure 6100 and at least one hanging element 6200 that is slidably coupled to the support structure 6100 and is configured to mount the support structure 6100 from a support surface such as a wall or the like. Specifically, the hanging element 6200 comprises features that permit hanging of the frame apparatus 6000 from a support surface. For example, the hanging element 6200 may include notches or the like that receive a screw, nail, or other fastener that is coupled to and protruding from the support surface (i.e., a wall). Thus, as will be appreciated from the description provided below, the hanging element 6200 can slide relative to the support structure 6100 while remaining coupled to the support structure 6100. This enables the support structure 6100 to move side-to-side along a support surface (such as a wall or the like) while the hanging element 6200 remains coupled to the support structure 6100 and while the hanging element 6200 remains coupled to the support surface via a fastener.

The support structure 6100 comprises a frame 6110 and a backer panel 6150. Furthermore, the support structure 6100 comprises a front surface 6101, a rear surface 6102, a top edge 6103, a bottom edge 6104, a first lateral edge 6105, and a second lateral edge 6106. In the exemplified embodiment, the support structure 6100 comprises a conventional-type frame 6110 that has a rabbet for retaining the stack that includes the backer panel 6150. However, the invention is not to be so limited in all embodiments and the support structure 6100 may comprise a frame upon which canvas is stretched and may also include a backer panel. In yet another embodiment, the support structure 6100 may comprise a frame that supports a mirror and may also include a backer panel.

The support structure 6100 comprises a longitudinal axis A-A extending between the top and bottom edges 6103, 6014 and a transverse axis B-B extending between the first and second lateral edges 6105, 6106. The longitudinal axis A-A may be generally parallel to the first and second lateral edges 6105, 6106 and the transverse axis B-B may be generally parallel to the top and bottom edges 6103, 6104. Furthermore, the longitudinal axis A-A may be located equidistant from the first and second lateral edges 6105, 6106 and the transverse axis B-B may be located equidistant from the top and bottom edges 6103, 6104. The longitudinal and transverse axes A-A, B-B are orthogonal or perpendicular to one another and intersect along a center-point CP of the support structure 6100. In the exemplified embodiment, the support structure 6100 is square or rectangular shaped, although the invention is not to be so limited and the support structure 6100 may take on any desired shape in other embodiments, including circular, hexagonal, pentagonal, irregular, or the like.

The frame 6110 comprises an inner surface 6111, an outer surface 6112, a front surface 6113 and a rear surface 6114. The front surface 6113 of the frame 6110 forms an entirety of the front surface 6101 of the support structure 6100 and the rear surface 6114 of the frame 6110 forms a portion of the rear surface 6102 of the support structure 6100 (the remainder of the rear surface 6102 of the support structure 6100 being formed by the backer panel 6150). In other embodiments the rear surface 6114 of the frame 6110 may not form any part of the rear surface 6102 of the support structure 6100, which may instead be formed entirely by the backer panel 6150. For example, the backer panel 6150 may cover the entirety of the rear surface 6114 of the frame 6110. This may occur in situations where the frame is supporting canvas and the backer panel 6150 is affixed to the rear surface 6114 of the frame 6110 (such as by staples or other fasteners). The inner surface 6111 of the frame 6110 defines a display opening 6115 through which an article or item that is retained by the frame 6110 may be displayed for viewing. The frame 6110 also comprises a rabbet 6116 defined by a floor 6117 and a wall 6118 of the frame 6110. Specifically, the wall 6118 extends from the rear surface 6114 of the frame 6110 to the floor 6117, and the floor 6117 extends from the wall 6118 inwardly towards the display opening 6115.

The rabbet 6116 forms a ledge upon which a stack 6190 is positioned. The stack 6190 comprises the backer panel 6150, a glazing 6191, and an article or item 6192 that is intended to be displayed. The article 6192 may be a photograph, diploma, artwork, poster, print, or other flat article having a design indicia thereon or any other item that is desired to be displayed by the frame apparatus 6000. Alternatively, in some embodiments the article 6192 may be a mirror and in such embodiments the glazing 6191 may be omitted. In still other embodiments, the article 6192 may be a three-dimensional object that a person desires to frame for display. Thus, the article 6192 may be any object that is conventionally framed by persons desiring to display that article.

The glazing 6191 may be a transparent panel formed of any desired material, preferably glass or plastic, through which the article 6192 can be viewed. The glazing 6191 comprises a front surface 6194 that is exposed to a user when the frame apparatus 6000 is being displayed and a rear surface 6195 opposite the front surface 6194.

The backer panel 6150 can be formed of hard or soft plastic materials, such as any of the thermoplastics including polymers and copolymers of ethylene, propylene (i.e., polypropylene), olefins, butadiene, vinyl compounds and polyesters. The backer panel 6150 may also be formed of medium density fiberboard ("MDF"), corrugate, or the like if so desired. Alternatively, the backer panel 6150 can be formed of cardboard, wood, metal or other materials. In some embodiments, the backer panel 6150 should be sufficiently rigid and strong to support the weight of the support structure 6100 when hanging from a wall. The backer panel 6150 comprises a front surface 6151 and a rear surface 6152 opposite the front surface 6151. The backer panel 6150 may be a flat, planar structure such that the front and rear surfaces 6151, 6152 are planar and parallel to one another. As noted above, in the exemplified embodiment the rear surface 6152 of the backer panel 6150 and the rear surface 6114 of the frame 6110 collectively form the rear surface 6102 of the support structure 6100. The backer panel 6150 need not be transparent because the article 6192 is not typically viewed through the backer panel 6150.

In the exemplified embodiment, the frame apparatus 6000 includes glazier points 6193 to retain the stack 6190 in the rabbet 6116. Specifically, the glazier points 6193 are coupled to the wall 6118 of the rabbet 6116 and extend inwardly towards the display opening 6115. When the stack 619 is located in the rabbet 6116, the glazier points 6193 are bent downwardly to hold the stack 6190 in place within the rabbet 6116. Of course, alternative mechanisms may be used for this purpose, such as turn buttons, flex tabs, or the like.

In use, the stack 6190 is placed in the rabbet 6116 and secured therein using the glazier points 6193. When the stack 6190 is assembled in the frame 6110, the article 6192 is sandwiched between the rear surface 6195 of the glazing 6191 and the front surface 6152 of the backer panel 6150. Thus, the backer panel 6150 and the glazing 6191 provide a layer of protection to the front and rear surfaces of the article 6192. Because the glazing 6191 is transparent, the article 6192 can be viewed through the glazing 6191.

Although in the exemplified embodiment the backer panel 6150 is located within the rabbet 6116 of the frame 6110 so that a portion of the rear surface 6114 of the frame 6110 is exposed, this structure and assembly is not required in all embodiments. In other embodiments, the backer panel 6150 may cover the entirety of the rear surface 6114 of the frame 6110 so that the backer panel 6150 alone makes up the entirety of the rear surface 6102 of the support structure 6100. Furthermore, in the exemplified embodiment the rear surface 6114 of the frame 6110 and the rear surface 6152 of the backer panel 6150 collectively form the rear surface 6102 of the support structure 6100. However, in other embodiments there may be additional brackets or the like coupled to the rear surface 6162 of the backer panel 6150 or to the rear surface 6114 of the frame 6110, and such additional brackets would be considered to form a portion of the rear surface 6102 of the support structure 6100. Thus, if a bracket member were coupled to the rear surface 6162 of the backer panel 6150 (or even to the rear surface 6114 of the frame 6110), such bracket member would be deemed to form a portion of the rear surface 6102 of the support structure 6100.

Figure 21:
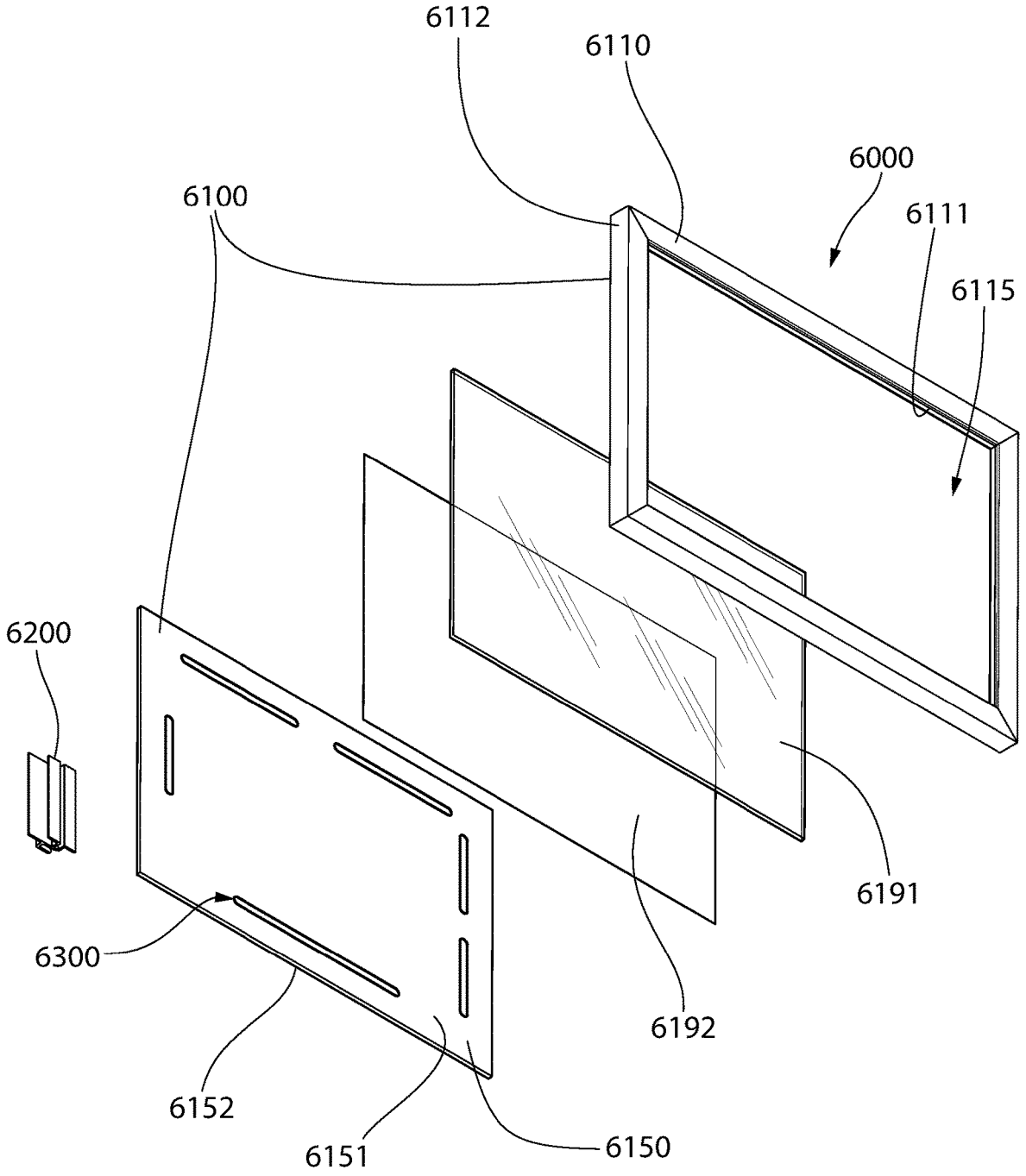
FIG. 21 is an exploded view of the frame apparatus of FIG. 20, the frame apparatus including a hanging element and a support structure that includes a frame and a backer panel.
Figure 22:
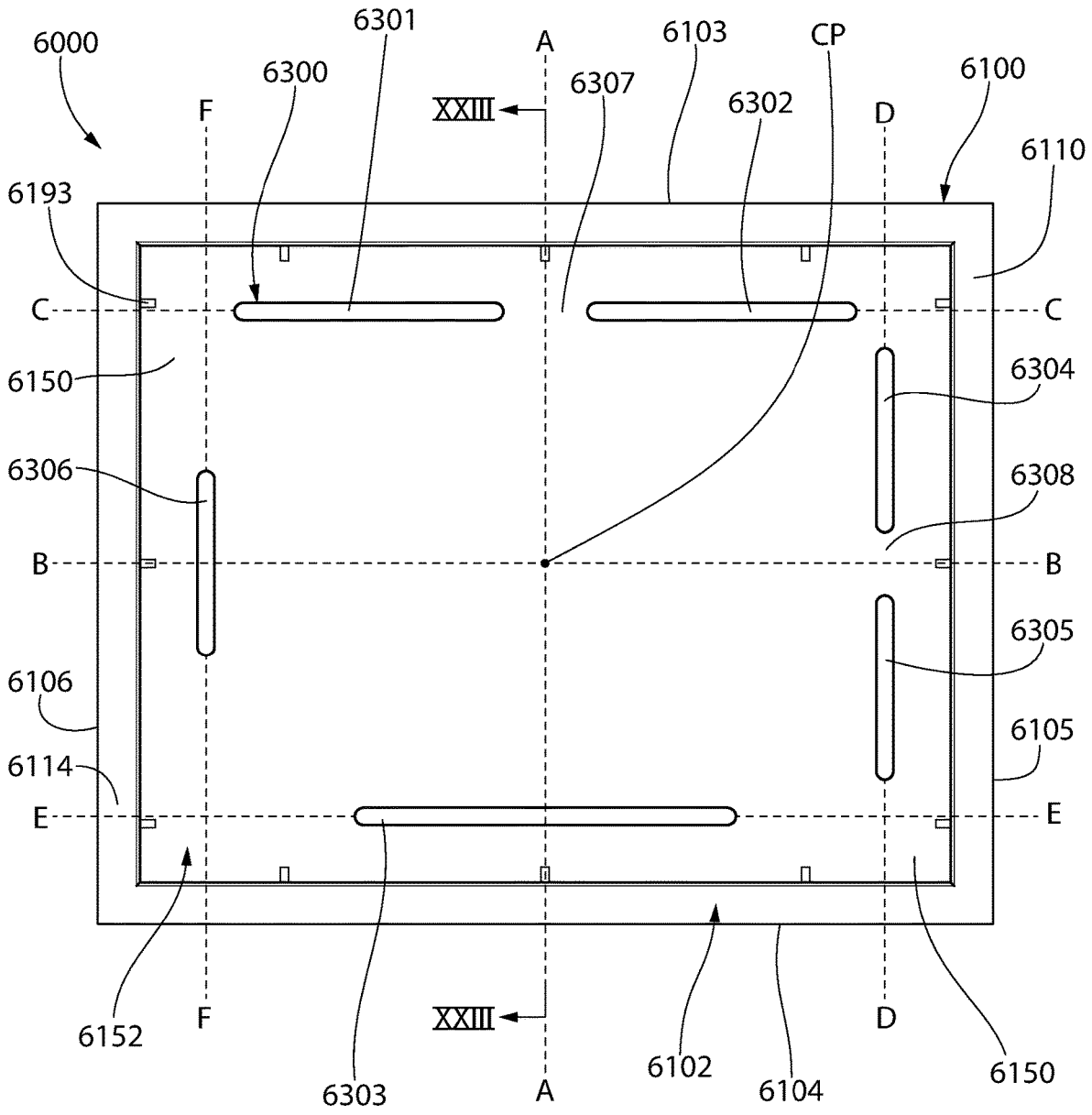
FIG. 22 is a rear view of the frame apparatus of FIG. 20 without the hanging element.
Figure 23:
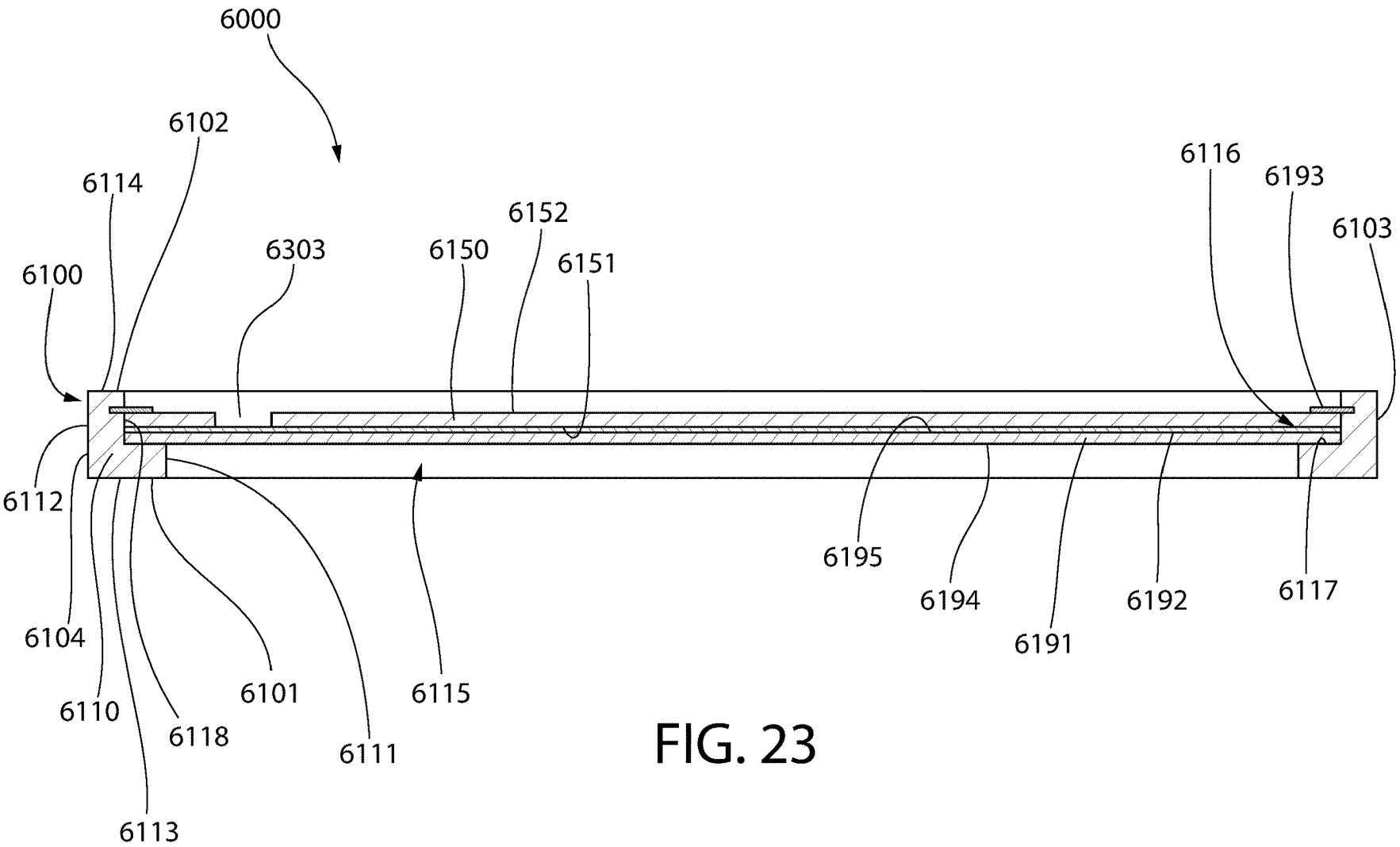
FIG. 23 is a cross-sectional view taken along line XXIII-XXIII of FIG. 22.

Referring to FIGS. 21 and 22, a plurality of slots 6300 are located along the rear surface 6102 of the support structure 6100. The slots 6300 are intended to facilitate the coupling of the hanging elements 6200 to the support structure 6100. In the exemplified embodiment, each of the slots 6300 is an aperture formed into and through the backer panel 6150. Thus, each of the slots 6300 forms an aperture or hole that extends entirely through the backer panel 6150 from the front surface 6151 of the backer panel 6150 to the rear surface 6152 of the backer panel 6150. However, the invention is not to be so limited in all embodiments. Specifically, in alternative embodiments the slots 6300 may be formed into the rear surface 6114 of the frame 6110 instead of or in addition to being formed into the backer panel 6150. Moreover, in still other embodiments a bracket may be coupled to the rear surface 6102 of the support structure 6100 (via either the backer panel 6150 or the frame 6110) and the bracket may comprise the slots 6300. In any of these embodiments, the slots 6300 are deemed to be located on the rear surface 6102 of the support structure 6100.

Moreover, although in the exemplified embodiment the slots 6300 are illustrated and described for coupling the hanging elements 6200 to the support structure 6100, in other embodiments the slots 6300 may be replaced with protuberances that are configured to engage the hanging elements 6200 for coupling the hanging elements 6200 to the support structure 6100. In still other embodiments, the slots 6300 may be formed by a space between two protuberances that protrude from the rear surface 6102 of the support structure 6100 rather than being formed by an aperture. Thus, in some embodiments the slots 6300 may merely be described as mounting elements, without being limited to a specific type of mounting element, such that the mounting elements located on the rear surface 6102 of the support structure 6100 could be slots/apertures, protuberances, or any other type of feature that will achieve the desired function of coupling the hanging elements 6200 to the support structure 6100 such that the hanging elements 6200 are slidable relative to the support structure 6100 when coupled thereto.

In the exemplified embodiment, the plurality of slots 6300 comprises a first slot 6301, a second slot 6302, a third slot 6303, a fourth slot 6304, a fifth slot 6305 and a sixth slot 6306. While the drawings illustrate one possible configuration of the slots 6301-6306, the slots 6301-6306 may be positioned in other locations or in other patterns along the rear surface 6102 of the support structure 6100 in other embodiments. Thus, although two spaced apart slots are illustrated along the top of the rear surface 6102 of the support structure 6100, this may be formed by a single slot or more than two slots. The same is true of the slots that are located along the sides and bottom of the rear surface 6102 of the support structure 6100. Furthermore, although slots are illustrated as being located along each of the top, bottom, and opposing sides of the rear surface 6102 of the support structure 6100, in other embodiments there may only be slots along one or two of these regions. Thus, there is a significant amount of variation possible within the scope of the teachings set forth herein.

The size and dimensions of the slots 6300 may be dependent on the size of the support structure 6200 on which they are located and each support structure 6200 may have slots 6300 of different size thereon. In some embodiments each of the slots 6300 may have the same width (measured in a direction transverse to its length), which may be between 0.2 and 0.3 inches. Furthermore, the lengths of the slots (measured along the respective axis of each slot) may be between 3.25 inches and 7 inches, depending on the size of the support structure 6200. For example, if the support structure 6200 comprises a 12×18 or 16×20 inch frame, the slots may have a length between 3.25 and 3.5 inches, whereas if the support structure 6200 comprises a 24×36 or 27×40 inch frame, the slots may have a length between 3.25 and 7 inches. Of course, these provided lengths are merely examples and the lengths of the slots 6300 could be outside of the noted ranges in other embodiments. Furthermore, the slots 6300 will be described herein as being located adjacent to a particular edge of the support structure 6100 (i.e., top, bottom, or lateral edge). In some embodiments the slots 6300 may be spaced apart from the edge that it is adjacent to by between 2 and 4 inches, or more particularly between 2.5 and 3 inches.

In the exemplified embodiment, the first and second slots 6301, 6302 are located adjacent to the top edge 6103 of the support structure 6100 and are elongated along a first axis C-C. Although the first and second slots 6301, 6302 are spaced apart from the top edge 6103, they are closer to the top edge 6103 than any of the other slots and extend in the same direction as the top edge 6103. Thus, in the exemplified embodiment, the first axis C-C is parallel to the top edge 6103 of the support structure 6100. Furthermore, in the exemplified embodiment the first and second slots 6301, 6302 are spaced apart from one another along the first axis C-C by a gap 6307. However, the first and second slots 6301, 6302 could be combined into a single elongated slot in other embodiments rather than being formed from two distinct spaced apart slots. The third slot 6303 is located adjacent to the bottom edge 6104 of the support structure 6100 and is elongated along a third axis E-E that may be parallel to the bottom edge 6104 of the support structure 6100. In the exemplified embodiment, the third axis E-E is parallel to the first axis C-C. Although the third slot 6303 is spaced apart from the bottom edge 6104, it is closer to the bottom edge 6104 than any of the other slots and extends in the same direction as the bottom edge 6104. Although the third slot 6303 is illustrated as being a singular slot, it may be formed from multiple spaced apart slots (similar to the first and second slots 6301, 6302) in other embodiments. In the exemplified embodiment, the first and second slots 6301, 6302 are located on a first side of the transverse axis B-B and the third slot 6303 is located on a second side of the transverse axis B-B.

The third slot 6303 is positioned so that it is aligned with the first and second slots 6301, 6302 and also with the gap 6307. Stated another way, an axis that is parallel to the longitudinal axis A-A exists that intersects the third slot 6303 and the first slot 6301, another axis that is parallel to the longitudinal axis A-A exists that intersects the third slot 6303 and the second slot 6302, and yet another axis that is parallel to the longitudinal axis A-A (or that is the longitudinal axis A-A) exists that intersects the third slot 6303 and the gap 6307. Of course, different arrangements for the first, second, and third slots 6301, 6302, 6303 are possible without affecting the function of the frame apparatus 6000.

The fourth and fifth slots 6304, 6305 are located adjacent to the first lateral edge 6105 of the support structure 6100 and are elongated along a second axis D-D that may be parallel to the first lateral edge 6105. Although the third and fourth slots 6304, 6305 are spaced apart from the first lateral edge 6105, they are closer to the first lateral edge 6105 than any of the other slots and extend in the same direction as the first lateral edge 6105. In the exemplified embodiment, the fourth and fifth slots 6304, 6305 are spaced apart from one another along the second axis D-D by a gap 6308. However, the fourth and fifth slots 6304, 6305 could be combined into a single elongated slot in other embodiments rather than being formed from two distinct spaced apart slots. The sixth slot 6306 is located adjacent to the second lateral edge 6106 of the support structure 6100 and is elongated along a fourth axis F-F that may be parallel to the second lateral edge 6106. Although the sixth slot 6306 is spaced apart from the second lateral edge 6106, it is closer to the second edge 6106 than any of the other slots and extends in the same direction as the second lateral edge 6106. Of course, the sixth slot 6306 could be formed from multiple spaced apart slots rather than being a singular slot in other embodiments. In the exemplified embodiment, the fourth axis F-F is parallel to the second axis D-D. Furthermore, in the exemplified embodiment the first and third axes C-C, E-E are orthogonal/perpendicular to the second and fourth axes D-D, F-F. In the exemplified embodiment, the fourth and fifth slots 6304, 6305 are located on a first side of the longitudinal axis A-A and the sixth slot 6306 is located on a second side of the longitudinal axis A-A.

The sixth slot 6306 is positioned so that it is aligned with the fourth and fifth slots 6304, 6305 and also with the gap 6308. Stated another way, an axis that is parallel to the transverse axis B-B exists that intersects the sixth slot 6306 and the fourth slot 6304, another axis that is parallel to the transverse axis B-B exists that intersects the sixth slot 6306 and the fifth slot 6305, and yet another axis that is parallel to the transverse axis B-B (or that is the transverse axis B-B) exists that intersects the sixth slot 6306 and the gap 6308. Of course, different arrangements for the fourth, fifth, and sixth slots 6304, 6305, 6306 are possible without detracting from the function of the frame apparatus 6000.

Each of the plurality of slots 6300 has a length measured in a direction of the axis upon which it is elongated. Some of the slots 6300 may have the same length as some of the other slots, but this is not required. In the exemplified embodiment, it appears that the first and second slots 6301, 6302 have the same length and the fourth and fifth slots 6304, 6305 have the same length (although it is a different length than the first and second slots 6301, 6302). Furthermore, the third and sixth slots 6303, 6306 appear to have different lengths relative to one another and relative to each of the other slots. As will be described in more detail below, each of the slots 6301-6306 should have a length that is greater than a length of the hanging element 6200 to enable the hanging element 6200 to slide side-to-side within any of the slots 6301-6306 within which it is located when it is coupled to the support structure 6100. There may also be different hanging elements 6200 with different lengths so that an appropriate hanging element 6200 may be selected to be coupled to the support structure 6100 depending on which of the plurality of slots 6300 that it will be positioned within.

Although there are slots located adjacent to each of the top, bottom, and first and second lateral edges 6103, 6104, 6105, 6106 of the support structure 6100 in the exemplified embodiment, this is not required in all embodiments. Thus, in some embodiments there may be one or more slots located adjacent to one of the top and bottom edges 6103, 6104 and one or more slots located adjacent to one of the first and second lateral edges 6105, 6105. This will enable the support structure 6100 to be hung in either a portrait or landscape orientation. Thus, in some embodiments the frame apparatus 6000 may include at least one slot that is elongated along the first axis C-C and at least one slot that is elongated along the second axis D-D. However, incorporating slots into the rear surface 6102 of the support structure 6100 adjacent to each of the edges thereof provides a greater degree of flexibility in the hanging of the support structure 6100 from a support surface.

As noted above, one of the hanging elements 6200 may be coupled to the support structure 6100 within any of one or more of the slots 6301-6306. For example, first and second hanging elements 6200 may be coupled to the support structure 6100 such that one of the first and second hanging elements 6200 extends into and through each of the first and second slots 6301, 6302. Alternatively, a single hanging element 6200 may be coupled to the support structure 6100 along/within the third slot 6303. The same is true of the fourth and fifth slots 6304, 6305 or the sixth slot 6306 depending on whether the support structure 6100 is being hung in a portrait or landscape orientation.

Figure 24A:
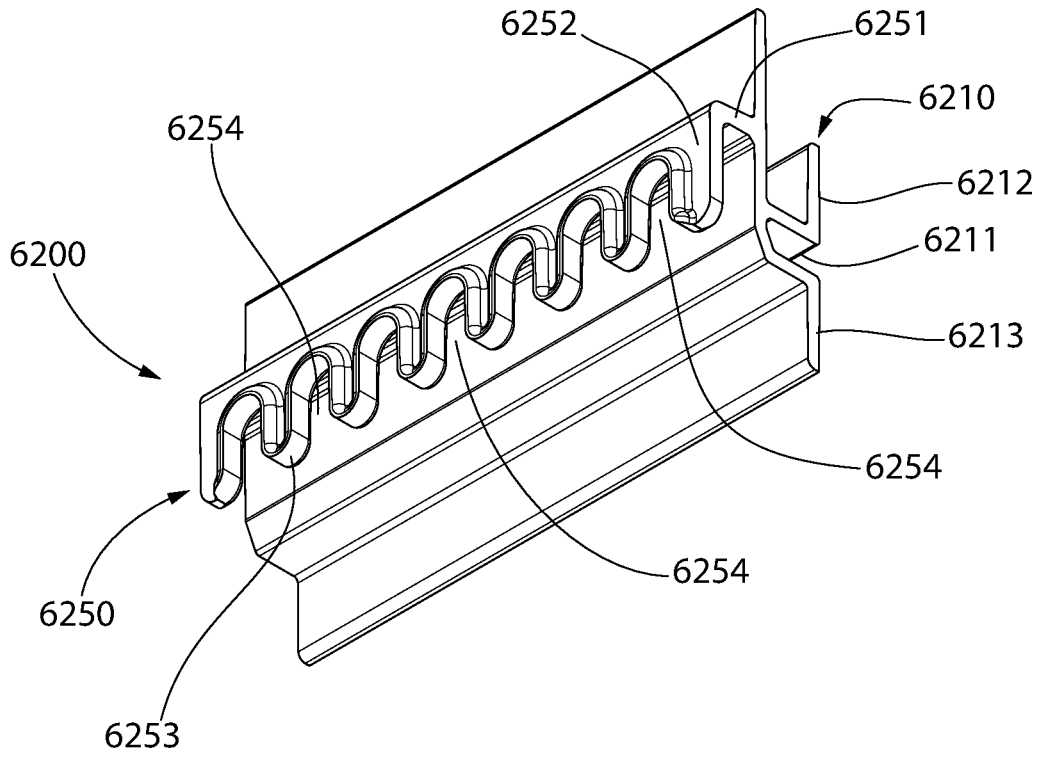
FIG. 24A is a front perspective view of the hanging element of the frame apparatus of FIG. 20.
Figure 24B:
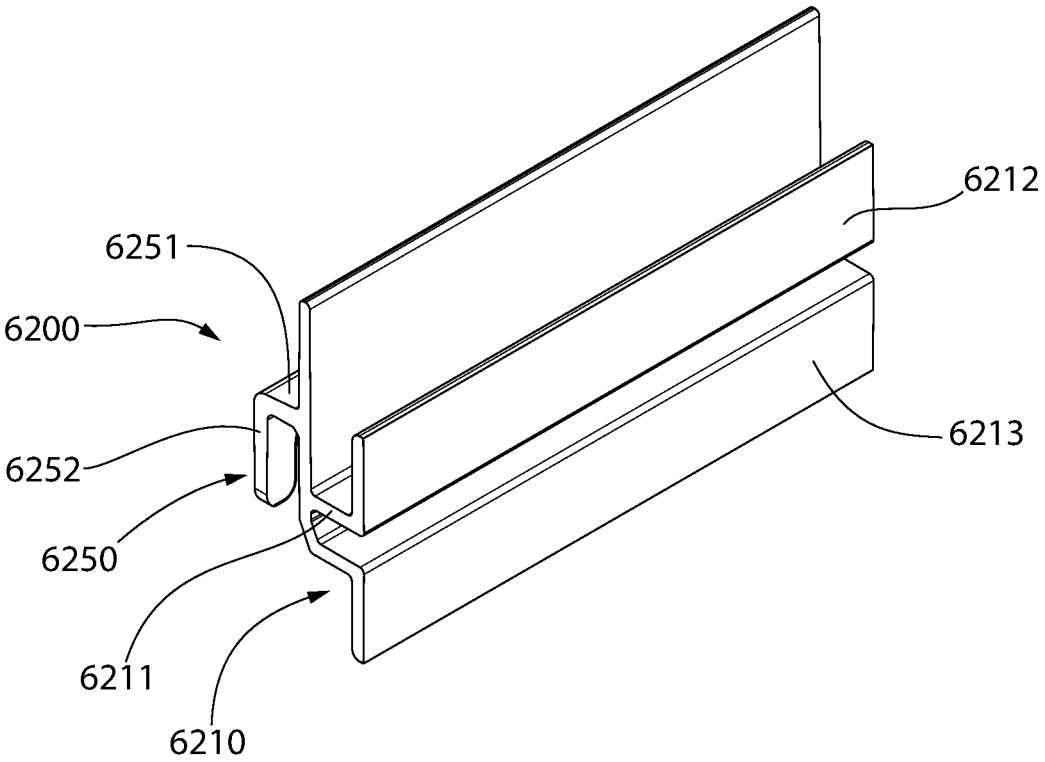
FIG. 24B is a rear perspective view of the hanging element of FIG. 24A.
Figure 24C:
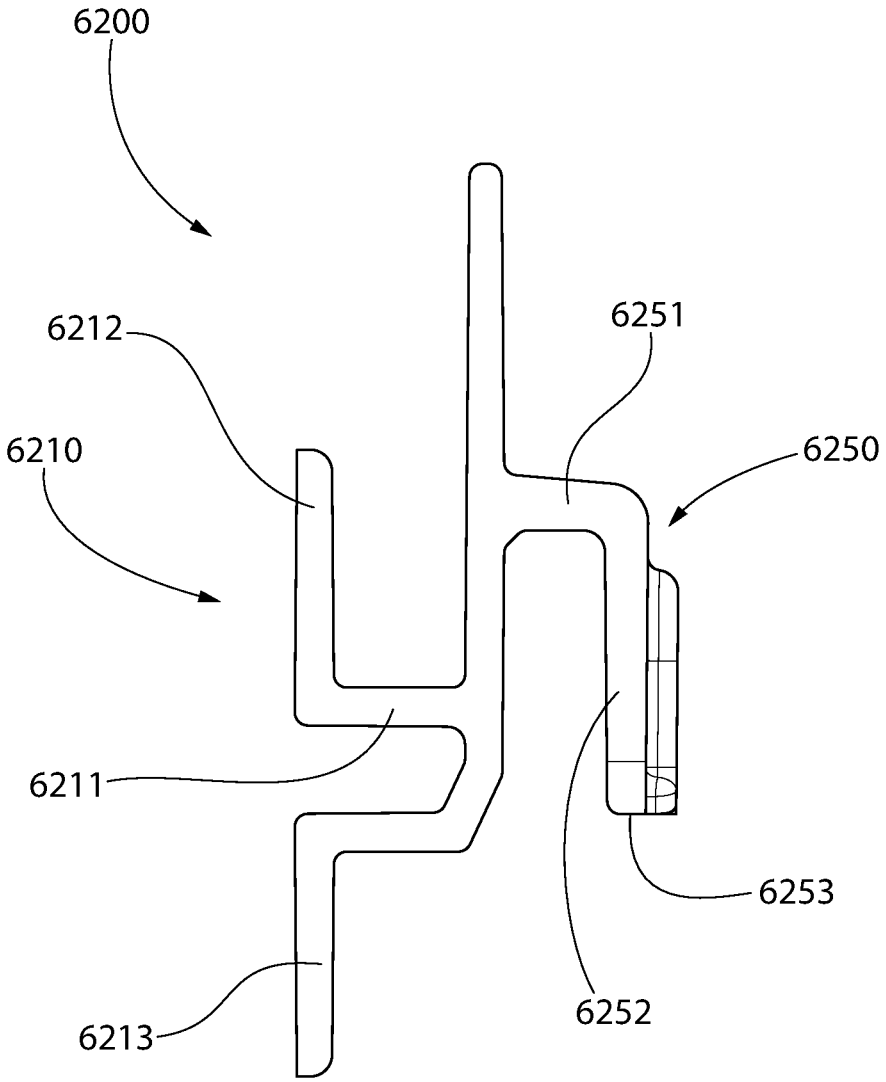
FIG. 24C is a side view of the hanging element of FIG. 24A.

Referring to FIGS. 24A-24C, the hanging element 6200 is illustrated in accordance with an embodiment of the present invention. The hanging element 6200 generally comprises a coupling portion 6210 for coupling the hanging element 6200 to the support structure 6100 and a mounting portion 6250 for coupling the hanging element 6200 to a fastener (i.e., nail, screw, etc.) on the support surface. To couple the hanging element 6200 to the support structure 6100, the coupling portion 6210 is inserted into one of the plurality of slots 6300. Once the hanging element 6200 is coupled to the support structure 6100, the mounting portion 6250 of the hanging element 6200 protrudes from the rear surface 6102 of the support structure 6100 so that it can be mounted to/hung from a fastener. The hanging element(s) 6200 may be formed of any desired rigid material that is capable of supporting the weight of the support structure 6100, such as without limitation plastic, wood, metal, or the like.

The coupling portion 6210 of the hanging element 6200 comprises a first portion 6211 and second and third portions 6212, 6213 that extend from the first portion 6211 in opposite directions. Specifically, in the exemplified embodiment the second portion 6212 extends upwardly from the first portion 6211 and the third portion 6213 extends downwardly from the first portion 6211. In the exemplified embodiment, the second and third portions 6212, 6213 each extend perpendicularly from the first portion 6211. When the hanging element 6200 is coupled to the support structure 6100, the first portion 6211 of the coupling portion 6210 is at least partially located in one of the plurality of slots 6300 and the second and third portions 6212, 6213 are in contact with the front surface 6151 of the backer panel 6150. The second and third portions 6212, 6213 operate to prevent the hanging element 6200 from being readily decoupled from the support structure 6100 because it requires some angling, twisting, and turning of the hanging element 6200 to pull the second and third portion 6212, 6213 through the slot that the hanging element 6200 is located within.

The mounting portion 6250 comprises a first portion 6251 and a second portion 6252 that extends downwardly from the first portion 6251 in a substantially perpendicular manner. The second portion 6252 terminates in a distal edge 6253 that has an undulating or wave-like appearance. Specifically, the distal edge 6253 comprises a plurality of spaced apart receiving notches 6254, each of which is configured to receive a portion of a fastener (i.e., screw, nail, etc.) to mount the hanging element 6200 to a support surface. Of course, the configuration/structure of the distal edge 6253 is merely exemplary and the distal edge 6253 could be in the form of a sawtooth hanger or the like in other embodiments without affecting its function. Alternatively, the distal edge 6253 could be a planar edge (or non-planar but without the receiving notches 6254) intended to cooperate with a bracket that is mounted to the support surface.

Referring sequentially to FIGS. 25A-25E, the manner in which the hanging element 6250 is coupled to the support structure 6100 will be described. As noted above, in the exemplified embodiment the plurality of slots 6300 are openings or apertures formed through the backer panel 6150, and thus the description regarding the coupling of the hanging element 6250 to the support structure 6100 will be provided with regard to this exemplary embodiment. However, it should be appreciated that the plurality of slots 6300 need not be formed as openings in the backer panel 6150 in all embodiments and the hanging elements 6200 may be coupled to the support structure 6100 using techniques that differ from that which is described herein. Specifically, the slots 6300 may be cutouts or channels formed into the frame 6110 or they may be openings formed into a bracket that is coupled to the frame 6110 or the backer panel 6150.

Figure 25A:
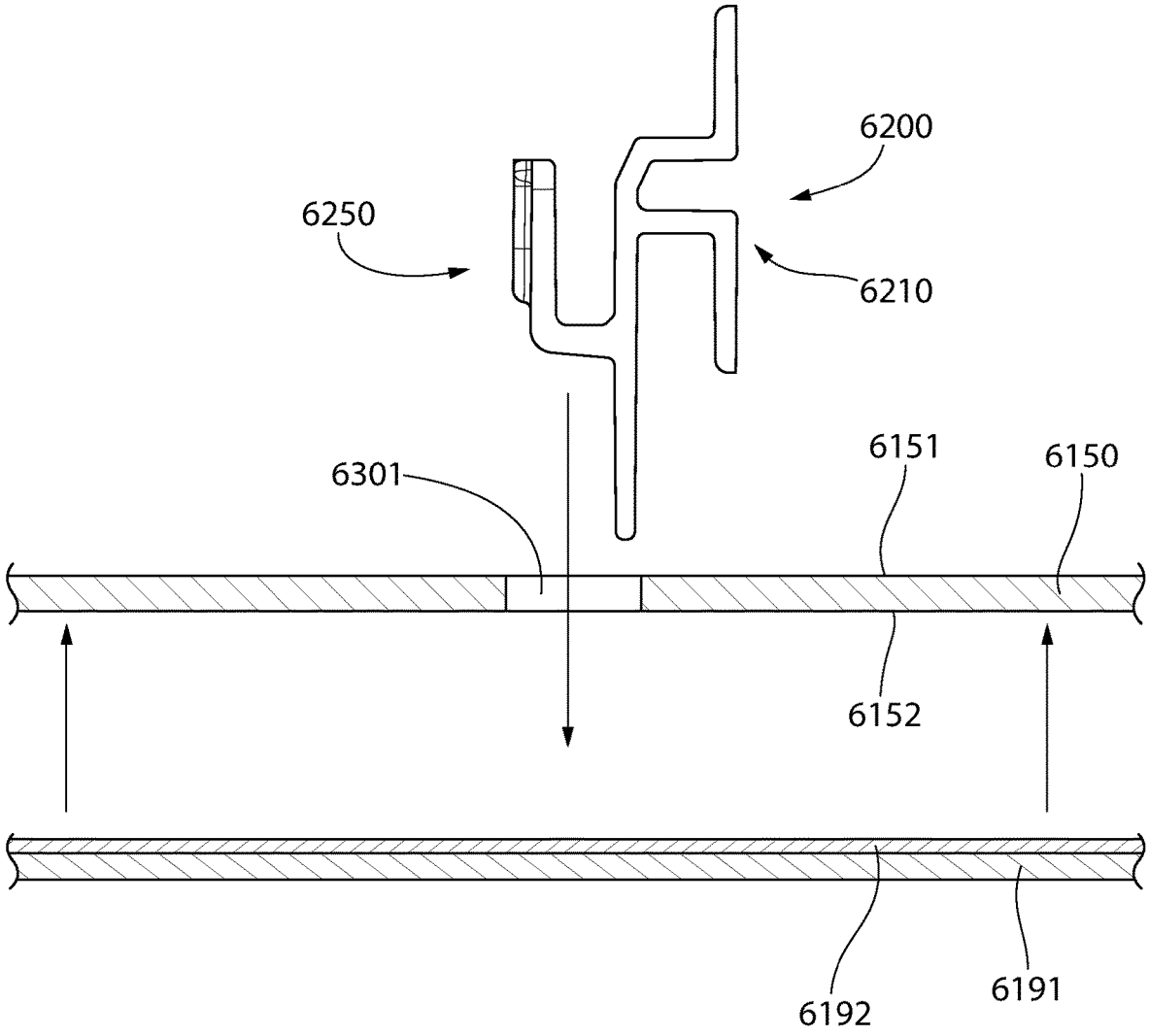
FIGS. 25A-25E illustrate the process of coupling one of the hanging elements to the support structure.
Figure 25B:
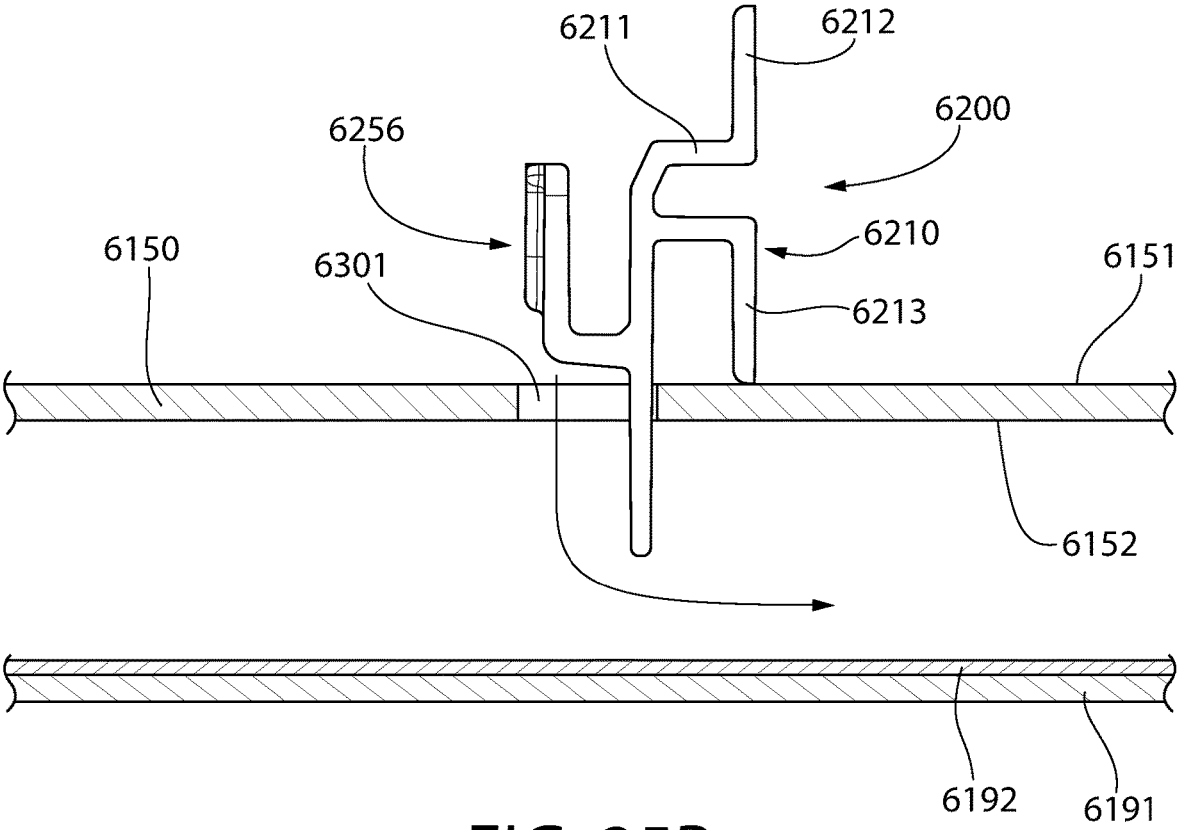
Figure 25C:
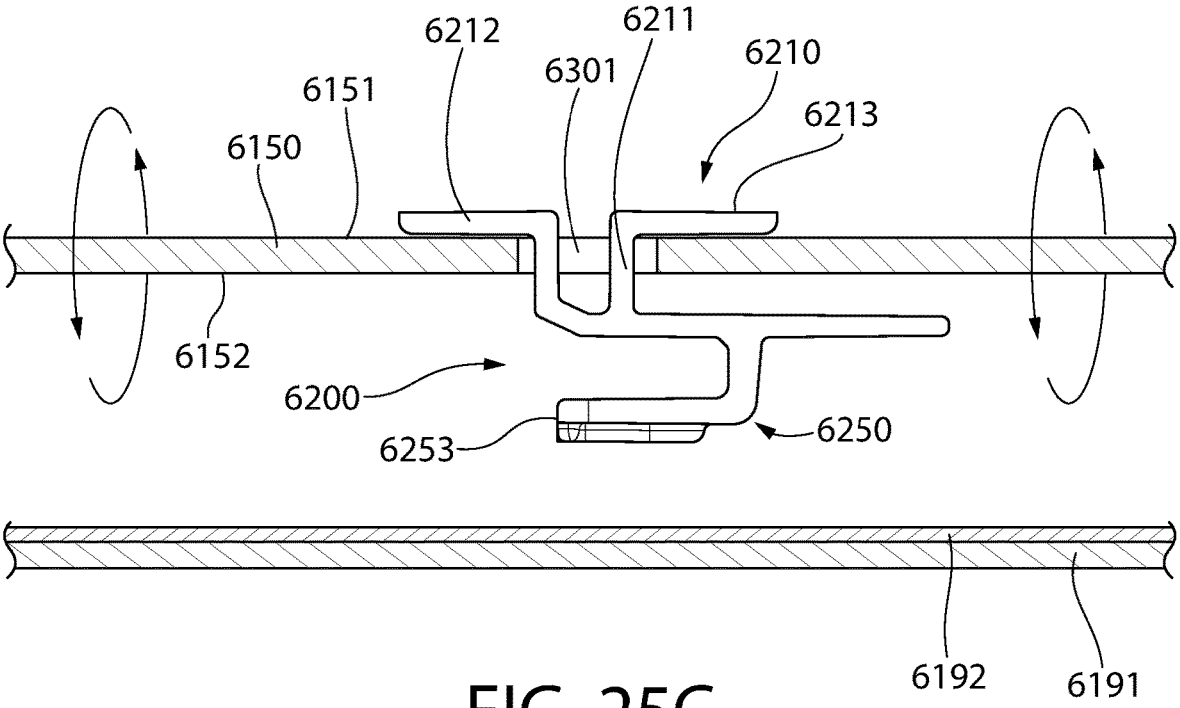

The backer panel 6150 will generally not be located within the rabbet 6116 of the frame 6110 during the process of coupling the hanging elements 6200 to the support structure 6100 because the process requires adequate spacing on both opposing sides of the backer panel 6150. This is depicted in FIG. 25A with the backer panel 6150 spaced apart from the article 6192 and glazing 6191. As shown in FIGS. 25A and 25B, the hanging element 6200 is aligned with one of the slots (the first slot 6301 is being used in the figures, but this same process would be used to couple the hanging element 6200 to any one of the slots) and then moved towards the first slot 6301 until a portion of the hanging element 6200 extends into the first slot 6301. Next, the hanging element 6200 is pivoted/rotated until the first portion 6211 of the coupling portion 6210 is located within the first slot 6301, the second and third portions 6212, 6213 of the coupling portion 6210 are located adjacent to the front surface 6151 of the backer panel 6150, and the mounting portion 6250 extends from the rear surface 6152 of the backer panel 6150, as shown in FIG. 25C.

Figure 25D:
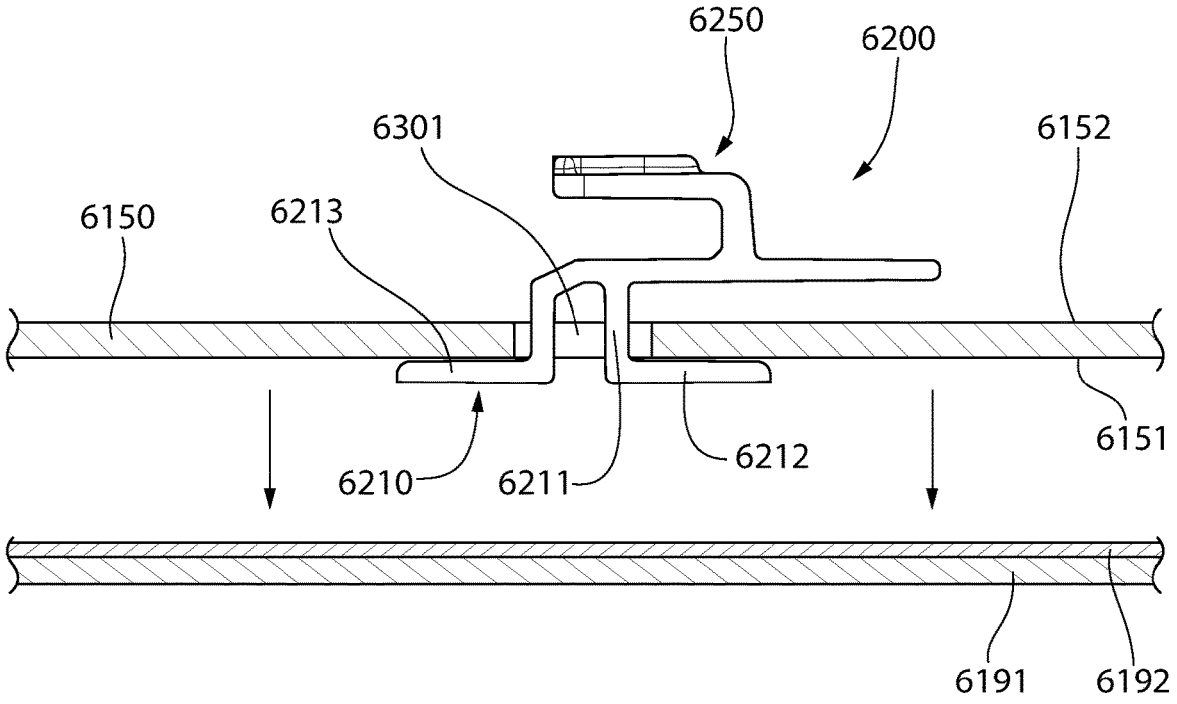
Figure 25E:
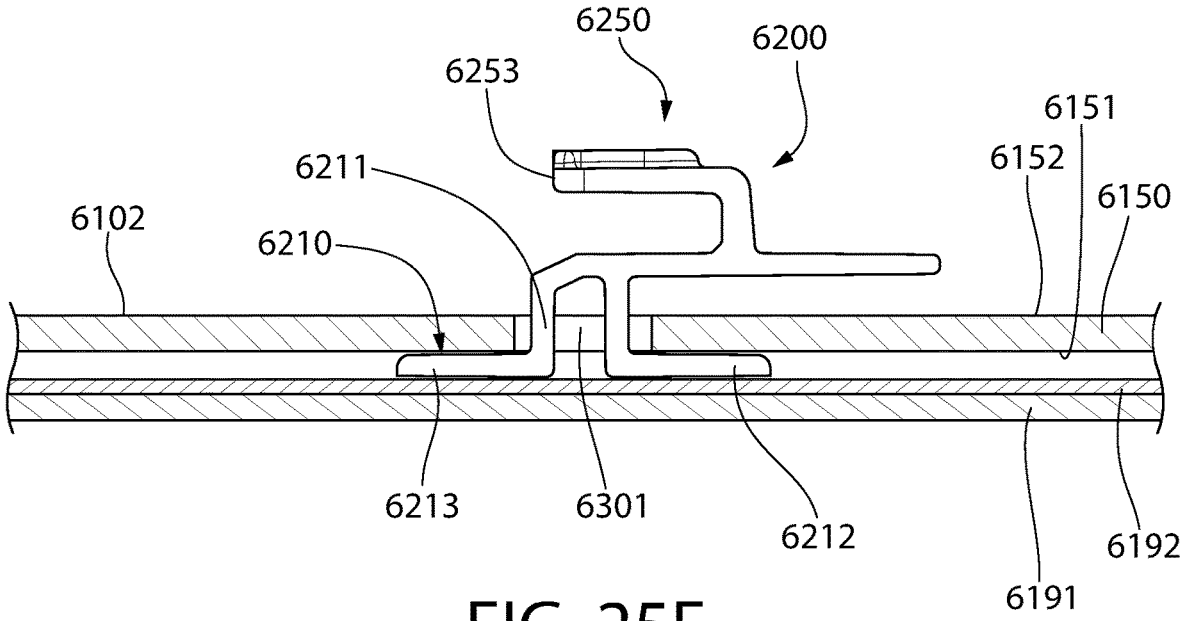

Next, referring to FIG. 25D, the backer panel 6150 with the hanging element 6200 coupled thereto is flipped 180° about its axis so that the front surface 6151 of the backer panel 6150 faces the article 6192 and the glazing 6191. Finally, referring to FIG. 25E, the backer panel 6150 may be move towards the glazing 6191 and article 6192 until the front surface 6151 of the backer panel 6150 is adjacent to the article 6192. Once fully assembled, the second and third portions 6212, 6213 of the coupling portion 6210 of the hanging element 6200 are positioned between the front surface 6151 of the backer panel 6150 and the article/glazing 6191, 6192. Of course, if the article 6192 is also in the rabbet 6116 (not shown in FIG. 25E), the second and third portions 6212, 6213 of the coupling portion 6210 will be located directly between the front surface 6151 of the backer panel 6150 and the article 6192, but they will also be located between the backer panel 6150 and the glazing 6191 with the article 6192 forming an intervening layer. Either way, once in this assembled state the hanging element 6200 cannot be readily separated from the backer panel 6150 without reversing the steps provided above. Furthermore, when the hanging element 6200 is coupled to the support structure 6100, the mounting portion 6250 protrudes from the rear surface 6102 of the support structure 6100.

Figure 26:
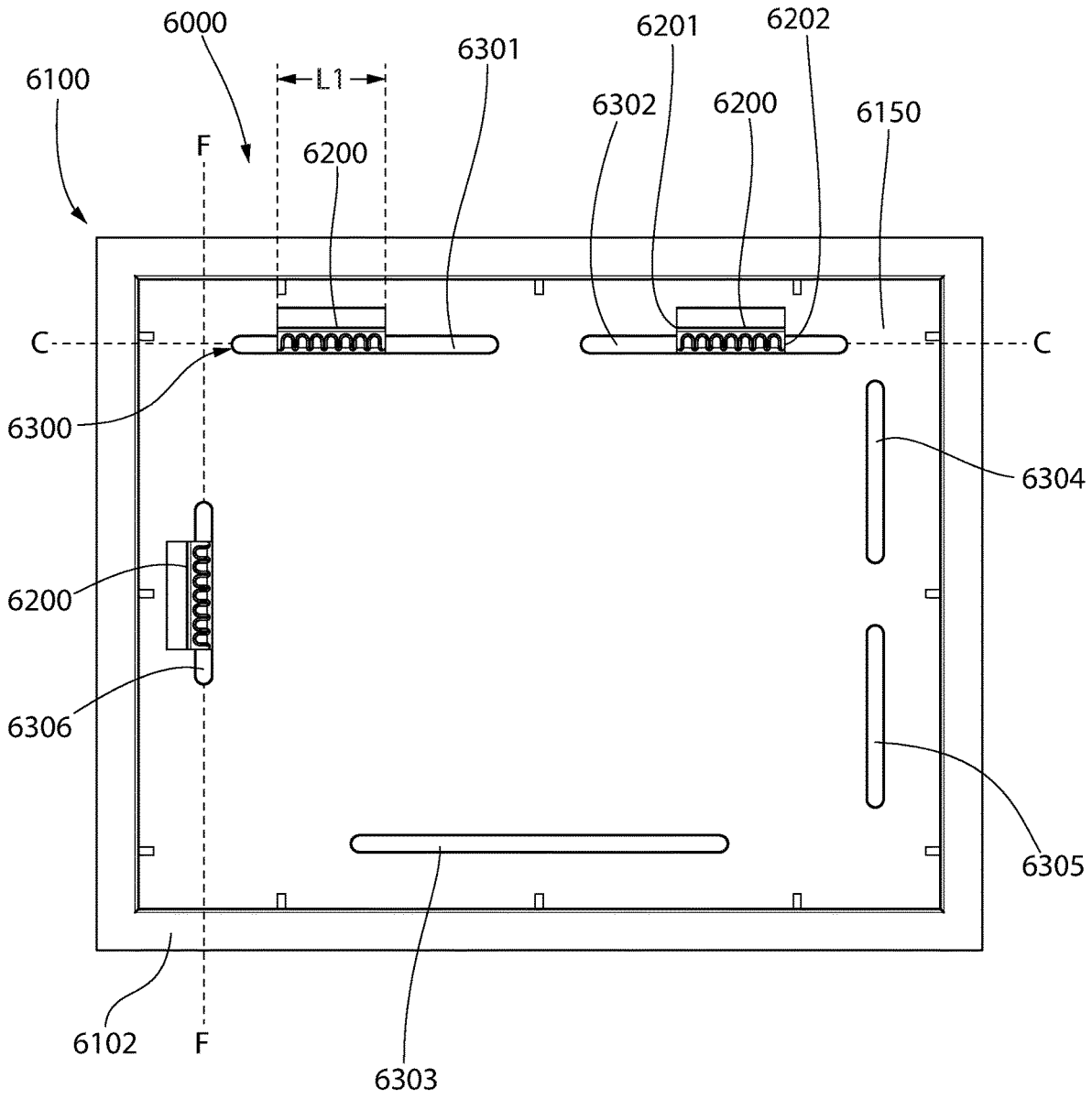
FIG. 26 is a rear view of the frame apparatus illustrating a plurality of the hanging elements coupled to the support structure.

FIG. 26 illustrates the frame apparatus 6000 with three of the hanging elements 6200 coupled to the support structure 6100 within three different ones of the plurality of slots 6300. Of course, the exact slots within which the hanging elements 6200 are located may be modified as desired. Thus, there may only be a hanging element 6200 located within the sixth slot 6306, or there may only be hanging elements 6200 in each of the first and second slots 6301, 6302, or the like. In certain embodiments, the frame apparatus 6000 is sold with three of the hanging elements 6200 already coupled to the support structure 6100 as shown in FIG. 26. A user may use the process described above in FIGS. 25A-25E to relocate one of the hanging elements 6200 to be within a different one of the slots, but at the time of purchase one or more of the hanging elements 6200 may already be coupled to the support structure 6100.

Each of the hanging elements 6200 extends from a first end 6201 to a second end 6202 and has a length L1 measured between the first and second ends 6201, 6202, the length L1 being measured in the direction of the axis of the slot within which the hanging element 6200 is positioned. The length L1 may be between 1.5 and 2 inches, and more specifically 1.875 inches in some embodiments. However, the length L1 may also be outside of the above noted range in other embodiments.

As noted above, each of the slots 6301-6306 has a length measured in the direction of its axis. The length of each of the slots 6301-6306 is greater than the length L1 of the hanging elements 6200 (the minimum slot length noted above was 3.25 inches, which is greater than the maximum hanger element length L1 of 2 inches). As a result, the slots 6301-6306 are longer than the hanging elements 6200, which provides for space within the slots 6301-6306 for the hanging elements 6200 to slide side-to-side along the respective axis of the slot 6301-6306. The difference between the slot length and the hanger element length is the distance that the support structure 6100 is able to move horizontally along the support surface. Thus, for example, the hanging element 6200 that is positioned within the first slot 6301 is able to slide side-to-side in opposing directions along the first axis C-C. Similarly, the hanging element 6200 that is positioned within the second slot 6302 is able to slide side-to-side in opposing directions along the first axis C-C. Furthermore, the hanging element 6200 that is positioned within the sixth slot 6306 is able to slide side-to-side in opposing directions along the fourth axis F-F.

The sliding of the hanging elements 6200 is achieved without detaching the hanging elements 6200 from the support structure 6100. Thus, the hanging elements 6200 remain coupled to the support structure 6100, or more specifically the backer panel 6150, and can slide side-to-side within the specific slot that they are coupled to. The advantage here is that the support structure 6100 can be moved horizontally along a support surface (i.e., a wall) while the hanging elements 6200 are coupled to a fastener protruding from the wall by simply moving the support structure 6100 horizontally, which results in the hanging elements 6200 moving within the slots 6301-6306 (by way of the support structure 6100 moving relative to the hanging elements 6200, which remain static). This horizontal movement of the support structure 6100 can be done while the hanging element 6200 remains mounted to/hanging from the fastener. This horizontal movement of the support structure 6100 may also be used to level the orientation at which the support structure 6100 is hung, particularly when only a single hanging element 6200 and a single fastener are used.

Figure 27:
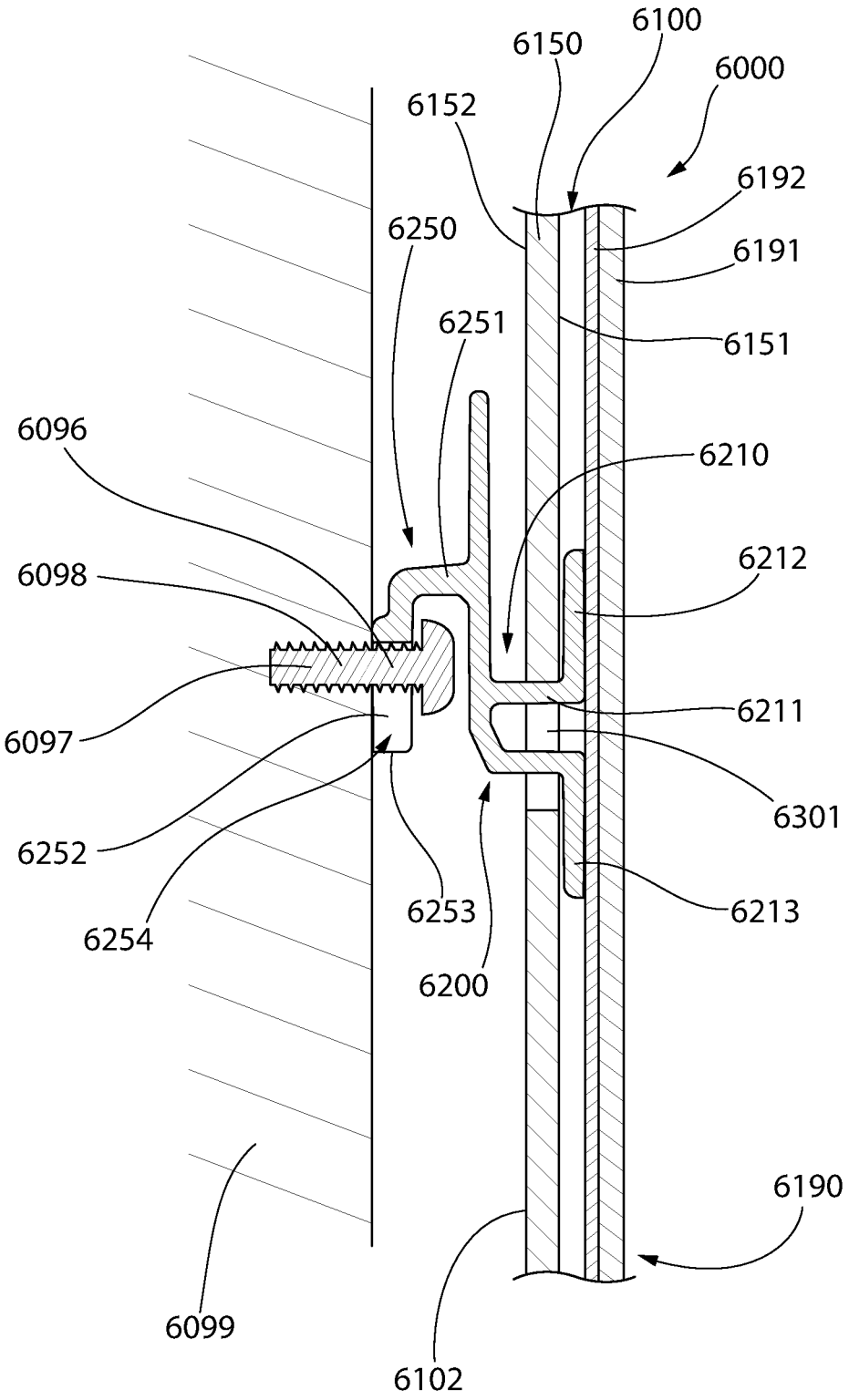
FIG. 27 is a schematic cross-sectional view illustrating the frame apparatus hanging from a support surface by a fastener.

FIG. 27 is a schematic cross-section illustrating the frame apparatus 6000 hanging from a support surface 6099. The support surface 6099 is a wall in the exemplified embodiment, but it may be any surface from which it is desired to hang the support structure 6100. The support surface 6099 may be a vertical surface, but this is not required in all embodiments. In FIG. 27 a fastener 6098 is illustrated coupled to the support surface 6099 so that a first portion 6097 of the fastener 6098 is embedded within the support surface 6099 and a second portion 6096 of the fastener 6098 protrudes from the support surface 6099. Specifically, in the exemplified embodiment the fastener 6098 is a screw, although the invention is not to be so limited and the fastener 6098 could be a nail or any other type of fastener or hardware that is generally used for hanging items from a wall. For example, the fastener 6098 could be a bracket that is coupled to the support surface 6099 and that is configured to cooperatively engage the hanging element 6200 to hang the support structure 6100 from the support surface 6099. The frame apparatus 6000 is hung from the support surface 6099 by placing the second portion 6096 of the fastener 6098 that protrudes from the support surface 6099 into one of the receiving notches 6254 of the hanging element 6200. Of course, multiple fasteners 6098 may protrude from the support surface 6099 and be placed within different ones of the receiving notches 6254 if so desired. Once hung, the support structure 6100 may be slid side-to-side along the support surface 6099 to either level the hanging orientation of the support structure 6100 (when only one fastener is used) or to change the horizontal location at which the support structure 6100 is hanging from the support surface 6099 (when two or more fasteners are used).

Figure 28A:
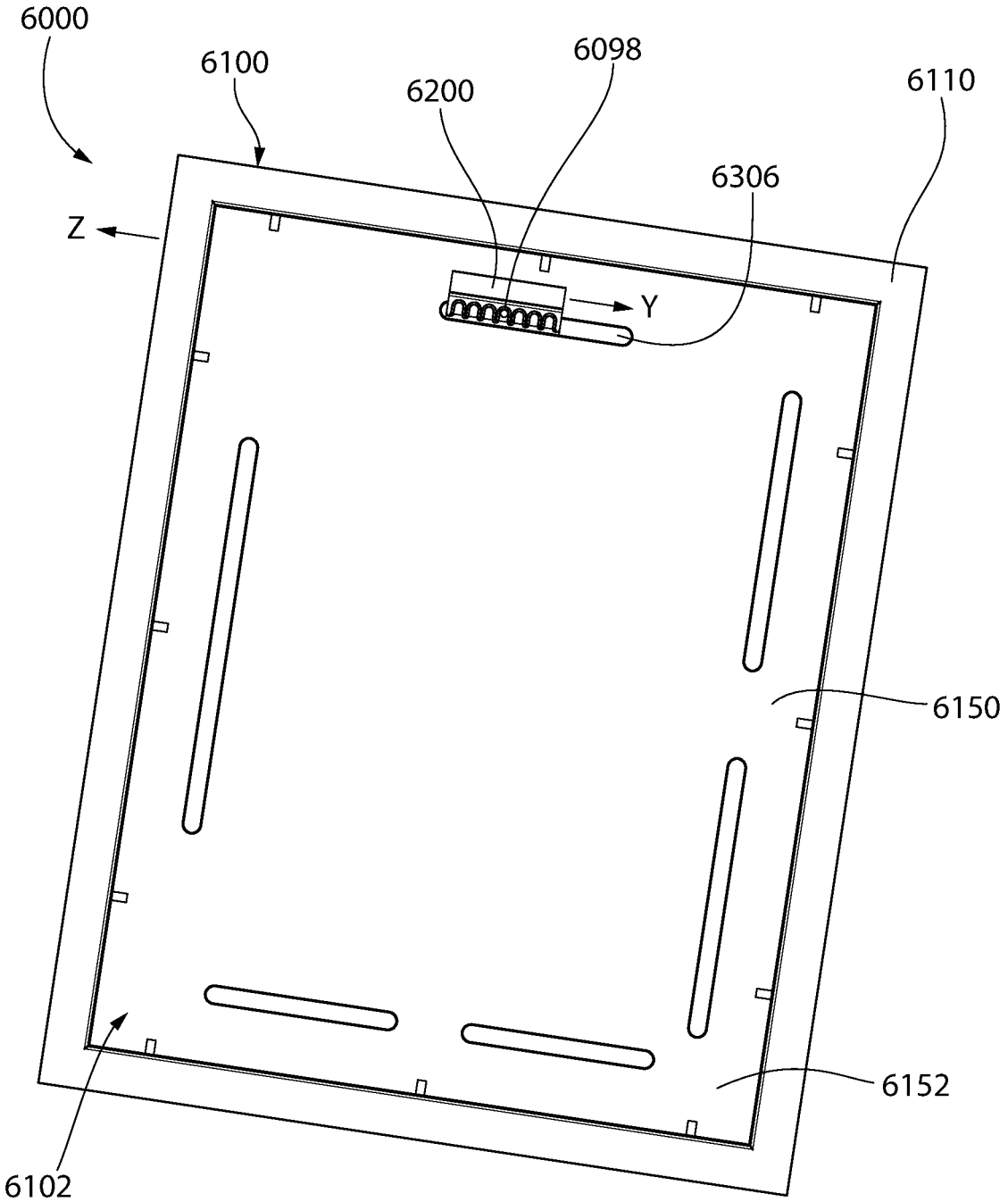
FIGS. 28A and 28B illustrate the hanging elements sliding relative to the support structure to facilitate a level hanging of the support structure from the support surface.
Figure 28B:
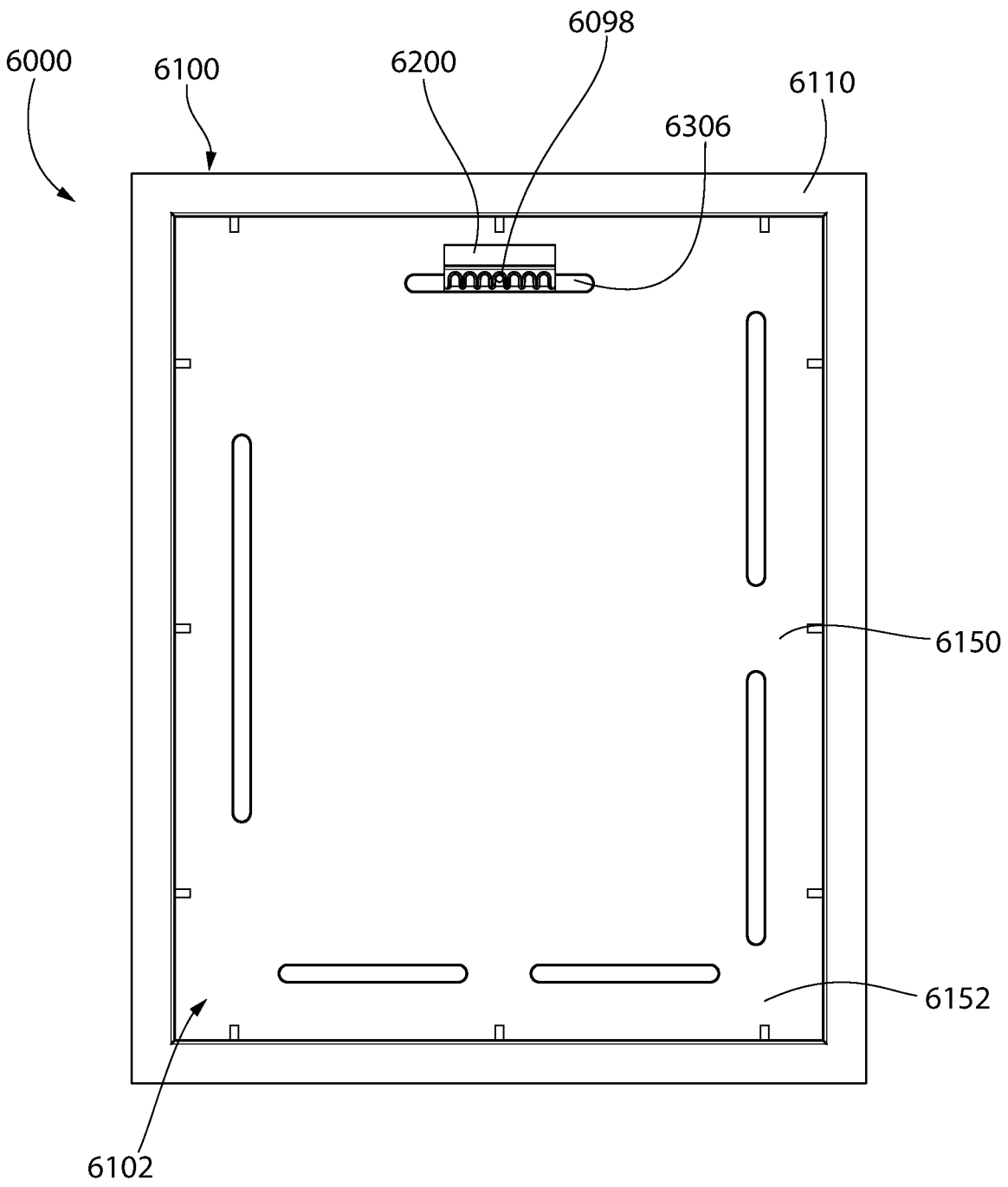

Referring to FIGS. 28A-28B, the frame apparatus 6000 is illustrated mounted to a support surface (not shown) by a single one of the fasteners 6098. In this embodiment, the support structure 6100 is in a portrait orientation and a single hanging element 6200 is used to hang the support structure 6100 from a single fastener 6098. The hanging element 6200 is slidably coupled to the support structure 6100 within the sixth slot 6306. In FIG. 28A, the support structure 6100 is not hung in a level manner, which is a common issue when hanging frames from a wall. However, because the hanging element 6200 can slide within the sixth slot 6306 without detaching the hanging element 6200 from the support structure 6100 and without detaching the hanging element 6200 from the fastener 6098, a user can easily correct the orientation at which the support structure 6100 is hanging.

Specifically, as shown in FIG. 28A, the hanging element 6200 can be slid within the sixth slot 6306 in the direction of the arrow Y by moving the support structure 6100 in the direction of the arrow Z to arrive at the positioning of the hanging element 6200 shown in FIG. 28B. As seen, by sliding the hanging element 6200 relative to the support structure 6100 (or, equivalently, sliding the support structure 6100 along the support surface relative to the hanging element 6200), the orientation at which the support structure 6100 is hanging from the support surface can be corrected so that the support structure 6100 is hanging in a level manner. Moreover, even in the portrait orientation where only one of the hanging elements 6200 is used, the single hanging element 6200 may be hung from two (or more) of the fasteners 6098. This will enable horizontal movement of the support structure 6100 on the support surface rather than level hanging control.

Figure 29A:
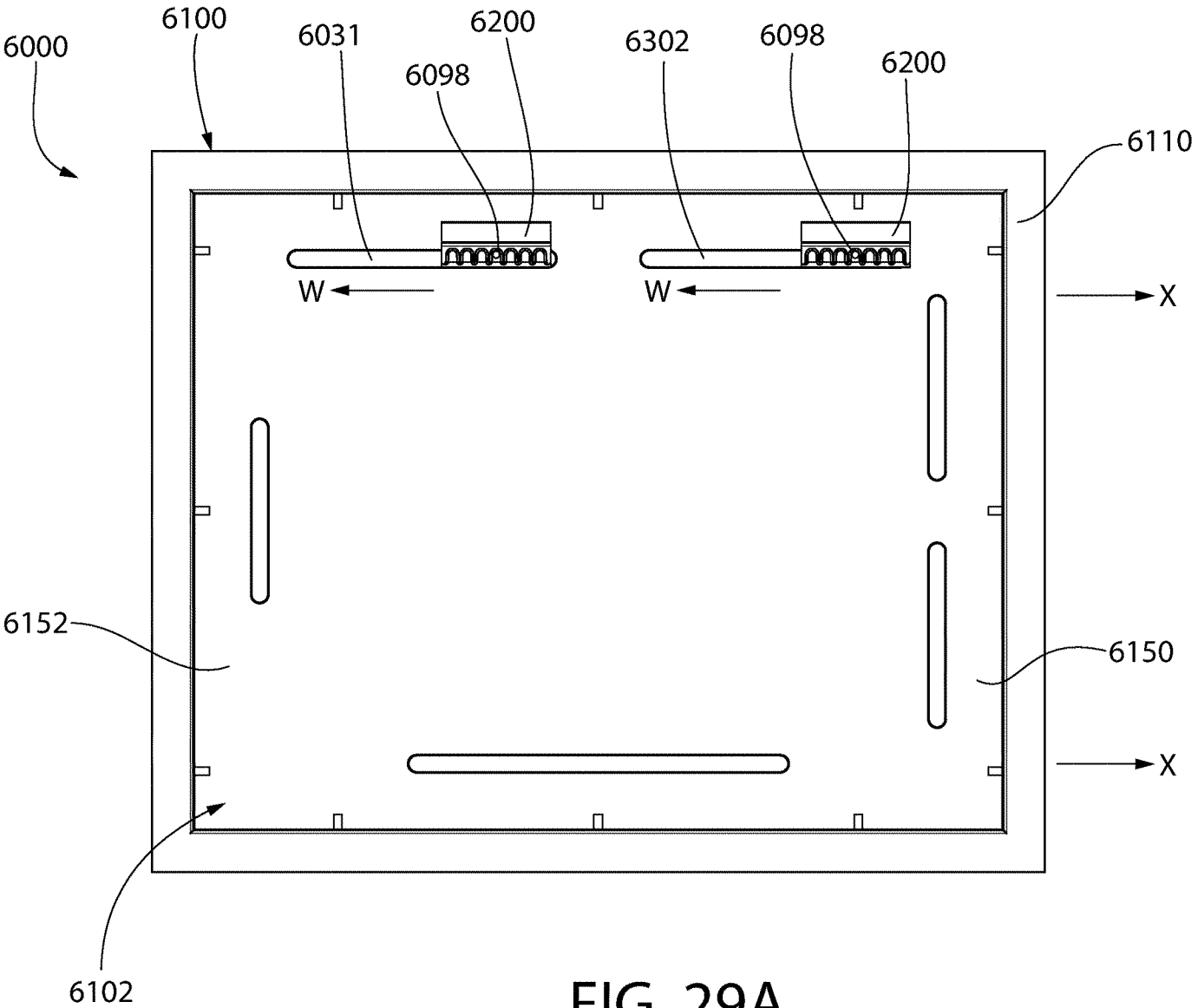
FIGS. 29A and 29B illustrate the hanging elements sliding relative to the support structure to facilitate moving the support structure side-to-side along the support surface.
Figure 29B:
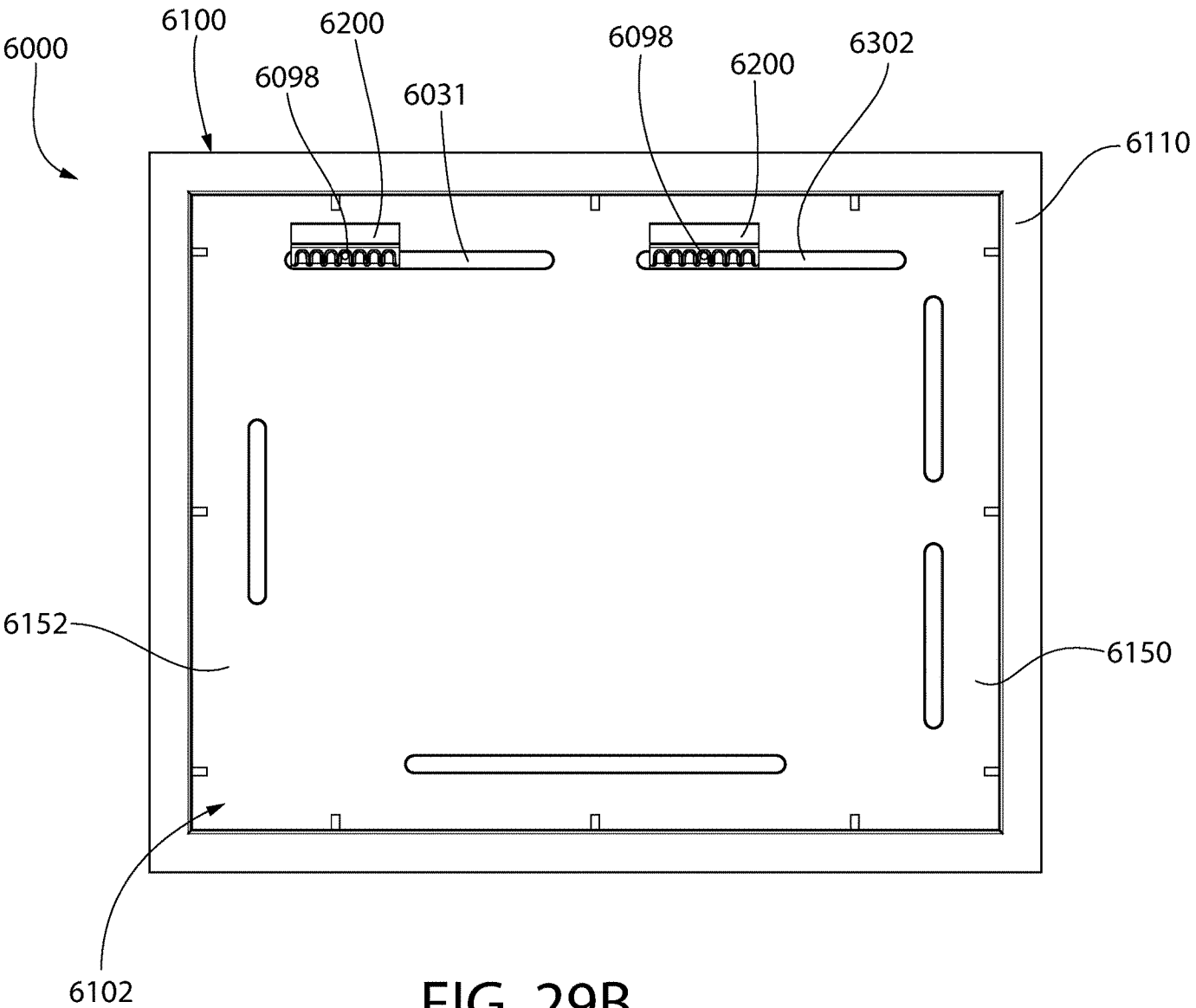

FIGS. 29A and 29B illustrate the frame apparatus 6000 being hung from a support surface (not shown) by two of the fasteners 6098. Specifically, in this embodiment there are two hanging elements 6200 being used to hang the support structure 6100 from the support surface, including one hanging element 6200 located within the first slot 6301 and one hanging element 6200 located within the second slot 6302. Each of the hanging elements 6200 is hanging from a single fastener 6098 that is protruding from the support surface, although each hanging element 6200 may be hanging from multiple fasteners 6098 if so desired.

As long as the fasteners 6098 are positioned in the support surface in a level manner, the support structure 6100 will be hung from the support surface in a level manner because the hanging elements 6200 in the first and second slots 6301, 6302 are level with one another. In this embodiment, the support structure 6100 can be moved horizontally along the support surface in the direction of the arrows labeled X while the hanging elements 6200 are hanging from the fasteners 6098 to change the horizontal location along the support surface at which the support structure 6100 is located. Thus, as shown in FIG. 29A, the support structure 6100 is being moved to the right (in the direction of the arrows X), which causes the hanging elements 6200 to move right to left (in the direction of the arrows W) within the first and second slots 6301, 6302, respectively. Thus, the support structure 6100 can be readily moved a desired distance to the left or to the right even after it is hanging from the support surface without having to add additional fasteners in the support surface.

In some embodiments, it may be possible to move the support structure 6100 approximately between 0.5 and 5 inches, more specifically between 0.5 and 4 inches, more specifically between 0.5 and 3 inches, and more specifically between 0.5 and 2 inches. In yet another embodiment, it may be possible to move the support structure 6100 between approximately 1.5 and 5 inches horizontally along the support surface while the support structure 6100 is hanging from the support surface. The distance that the support structure 6100 can be moved is the difference between the length of the slot and the length of the hanging element 6200 located within the slot.

Figure 30A:
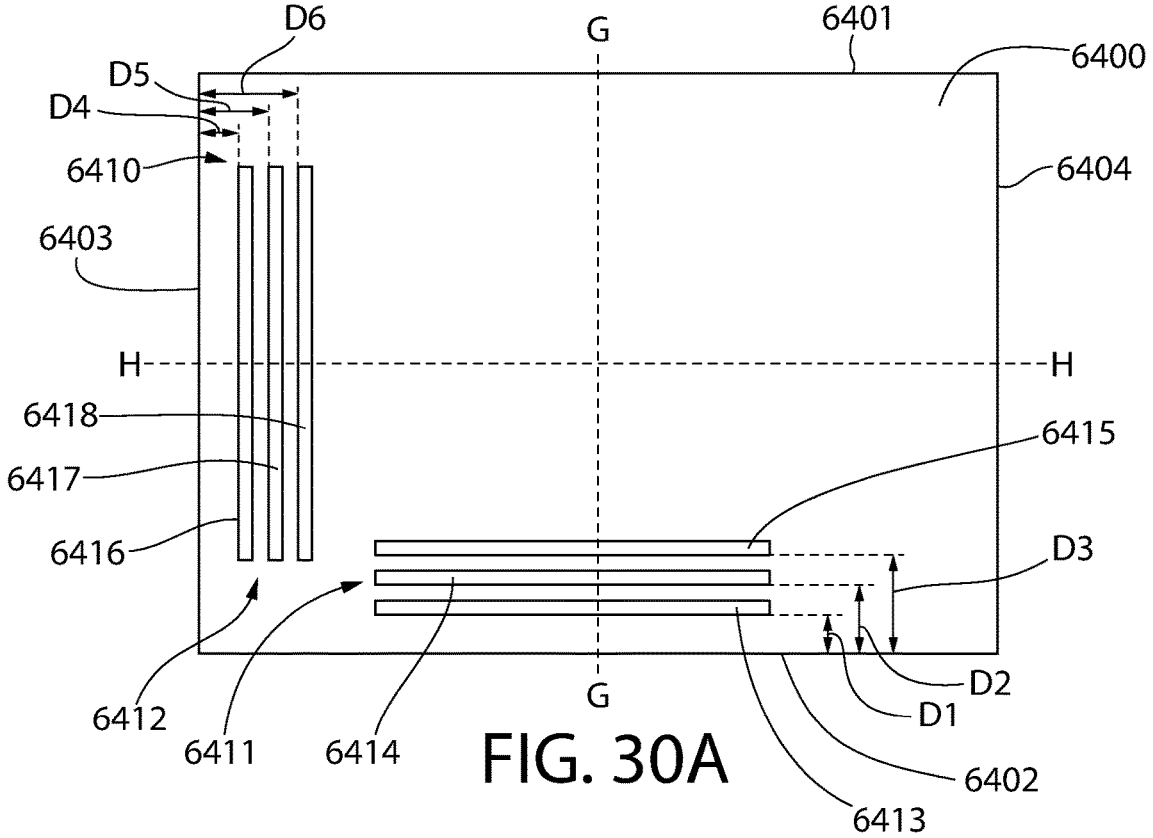
FIGS. 30A-30C illustrate alternative embodiments of the backer panel of the support structure.

Referring now to FIG. 30A, an alternative embodiment of a backer panel 6400 is illustrated in accordance with an embodiment of the present invention. Of course, FIG. 30A could alternatively be an illustration of a rear surface of a support structure that includes a backer panel and a frame such that the slots illustrated could be formed into the backer panel, the frame, or both. As shown in FIG. 30A, a plurality of slots 6410 are formed into the backer panel 6400, each of the slots 6410 forming an aperture through the backer panel 6400. The difference between this embodiment and those previously described is in the arrangement or pattern of the slots 6410.

The backer panel 6400 (or the rear surface of the support structure) has a longitudinal axis G-G and a transverse axis H-H similar to that which has been described above. Furthermore, the backer panel 6400 comprises a top edge 6401, a bottom edge 6402, a first lateral edge 6403, and a second lateral edge 6404. The first and second lateral edges 6403, 6404 are parallel to one another and extend between the top and bottom edges 6401, 6402. The top and bottom edges 6401, 6402 are parallel to one another and extend between the first and second lateral edges 6403, 6404.

The plurality of slots 6400 comprises a first set of slots 6411 that are located on the same side of the transverse axis H-H, and more specifically between the transverse axis H-H and the bottom edge 6402 of the backer panel 6400 and a second set of slots 6412 that are located on the same side of the longitudinal axis G-G, and more specifically between the longitudinal axis G-G and the first lateral edge 6403 of the backer panel 6400. Of course, the first set of slots 6411 could be located between the transverse axis H-H and the top edge 6401 instead of or in addition to being located between the transverse axis H-H and the bottom edge 6402. Similarly, the second set of slots 6412 could be located between the longitudinal axis G-G and the second lateral edge 6404 instead of or in addition to being located between the longitudinal axis G-G and the first lateral edge 6403.

The first set of slots 6411 are all elongated along an axis that is parallel to the transverse axis H-H (and parallel to the top and bottom edges 6401, 6402 of the backer panel 6400). Thus, the slots of the first set of slots 6411 are all parallel to one another. In the exemplified embodiment, the first set of slots 6411 comprises a first slot 6413 located a first distance D1 from the bottom edge 6402, a second slot 6414 located a second distance D2 from the bottom edge 6402, and a third slot 6415 located a third distance D3 from the bottom edge 6402. The first distance D1 is less than the second distance D2 and the second distance D2 is less than the third distance D3. Each of the three slots 6414-6415 is also located at a different distance from the transverse axis H-H. Thus, all three of the slots 6413-6415 are located between the transverse axis H-H and the bottom edge 6402, but at different elevations in that space between the transverse axis H-H and the bottom edge 6402. This allows for a vertical adjustment of a support structure or frame in addition to the horizontal adjustment described above. Specifically, when the support structure is hung in a landscape orientation, changing the first, second, and third slots 6413-6415 that the hanging element 6200 is located within will adjust the vertical hanging height of the support structure or frame on a support surface (i.e., a wall). This allows a vertical hanging height of the support structure to be modified without having to insert a new fastener into the support surface, thereby creating another hole in the support surface.

The second set of slots 6412 are all elongated along an axis that is parallel to the longitudinal axis G-G (and parallel to the first and second lateral edges 403, 6404 of the backer panel 6400). Thus, the slots of the second set of slots 6412 are all parallel to one another. In the exemplified embodiment, the second set of slots 6412 comprises a first slot 6416 located a first distance D4 from the first lateral edge 6403, a second slot 6417 located a second distance D5 from the first lateral edge 6403, and a third slot 6418 located a third distance D3 from the first lateral edge 6403. The first distance D4 is less than the second distance D5 and the second distance D5 is less than the third distance D6. Furthermore, the slots 6416-6418 are all located a different distance from the longitudinal axis G-G. Thus, all three of the slots 6416-6418 are located between the longitudinal axis G-G and the first lateral edge 6403, but at different distances therebetween. This allows for a vertical adjustment of a support structure or frame in addition to the horizontal adjustment described above. Specifically, when the support structure is hung in a portrait configuration, changing the first, second, and third slots 6416-6418 that the hanging element 6200 is located within will adjust the vertical hanging height of the support structure or frame on a support surface (i.e., a wall).

Figure 30B:
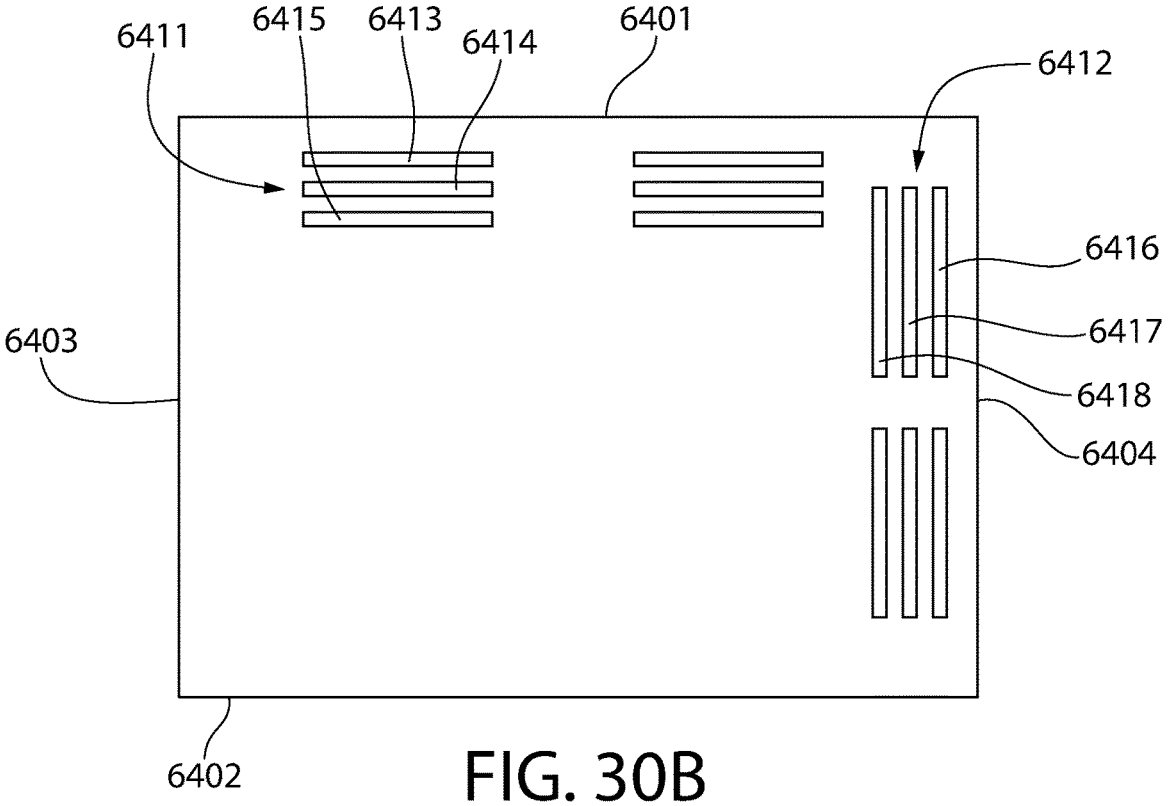

FIG. 30B is identical to FIG. 30A except that the first set of slots 6411 are located adjacent to the top edge 6401 rather than the bottom edge 6402 and each of the slots 6413-6415 comprise two spaced apart slots. Furthermore, in FIG. 30B the second set of slots 6412 are located adjacent to the second lateral edge 6404 rather than the first lateral edge 6403 and each of the slots 6416-6418 comprise two spaced apart slots. Of course, in the configuration of FIG. 30B, there could also be slots located adjacent to the first lateral edge 6403 and adjacent to the bottom edge 6402. Alternatively, the slots could be in the same location as in FIG. 30A except with each slot being formed by two axially spaced apart slots as shown in FIG. 30B.

Figure 30C:
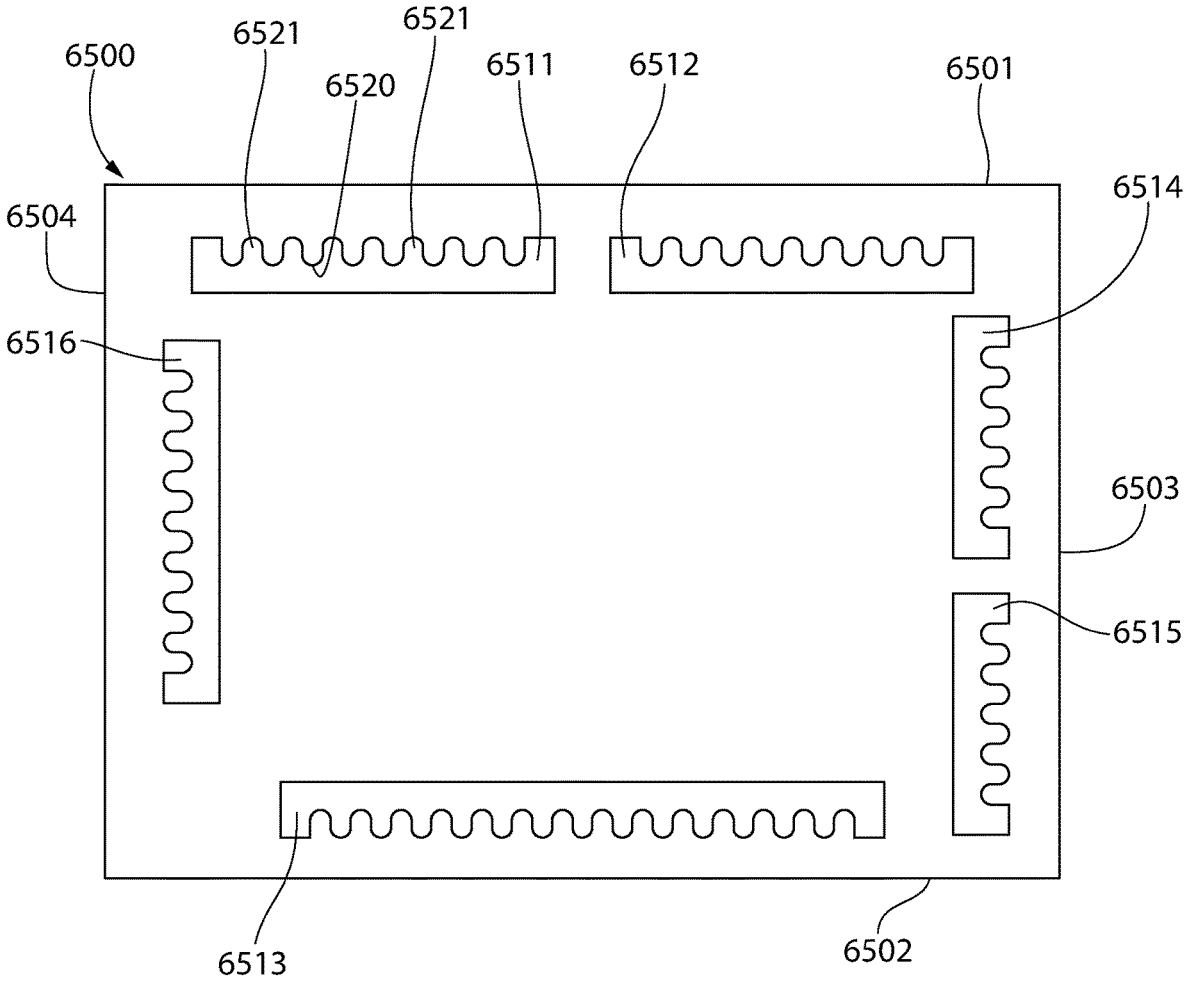

FIG. 30C illustrates yet another embodiment of a backer panel 6500. Of course, FIG. 30C could alternatively be an illustration of a rear surface of a support structure that includes a backer panel and a frame such that the slots illustrated could be formed into the backer panel, the frame, or both. As shown in FIG. 30C, a plurality of slots 6510 are formed into the backer panel 6500, each of the slots 6510 forming an aperture through the backer panel 6500. The difference between this embodiment and those previously described is in the shape of each of the slots 6510.

Specifically, the backer panel 6500 comprises a top edge 6501, a bottom edge 6502, a first lateral edge 6503, and a second lateral edge 6504. In this embodiment, there is a first slot and a second slot 6511, 6512 located adjacent to the top edge 6501 and extending parallel to the top edge 6501, a third slot 6513 located adjacent to the bottom edge 6502 and extending parallel to the bottom edge 6502, a fourth slot and a fifth slot 6514, 6515 located adjacent to the first lateral edge 6503 and extending parallel to the first lateral edge 6503, and a sixth slot 6516 located adjacent to the second lateral edge 6504 and extending parallel to the second lateral edge 6504. Thus, the pattern/arrangement of the slots is identical to that which was described with reference to FIGS. 20-29B.

However, the difference in this embodiment is that the slots 6511-6516 are not merely oval or rectangular in shape, but rather they include notches or the like that are configured to directly receive a fastener that is coupled to a support surface. Thus, using this embodiment, it may be possible to omit the hanging element entirely and to simply hang the support structure from the support surface via direct interaction/engagement between a fastener in the support surface and one of the slots 6511-6516.

In FIG. 30C, each of the slots 6511-6516 has the same shape/configuration, and thus the details described below with regard to the first slot 6511 are applicable to all of the slots 6511-6516. The first slot 6511 comprises an upper edge 6520 having an undulating or wavy appearance such that the upper edge 6520 defines a plurality of spaced apart receiving notches 6521. Each of the receiving notches 6521 is configured, based on its size and shape, to receive a portion of a fastener (i.e., screw, nail, or the like) that is protruding from a support surface to thereby hang the support structure from the support surface. Thus, as noted above in this embodiment the hanging element may not be needed. Rather, the support structure could be coupled directly to a fastener in the support surface within the hanging element being used as an intervening component. The support structure could still be slid side-to-side along the support surface by changing which of the receiving notches 6521 that the fastener is located within.

FIGS. 31A-40B illustrate different alternative embodiments of hanging elements 6200*a-j*. Each of the hanging elements 6200*a-j* will be described briefly below.

Figure 31B:
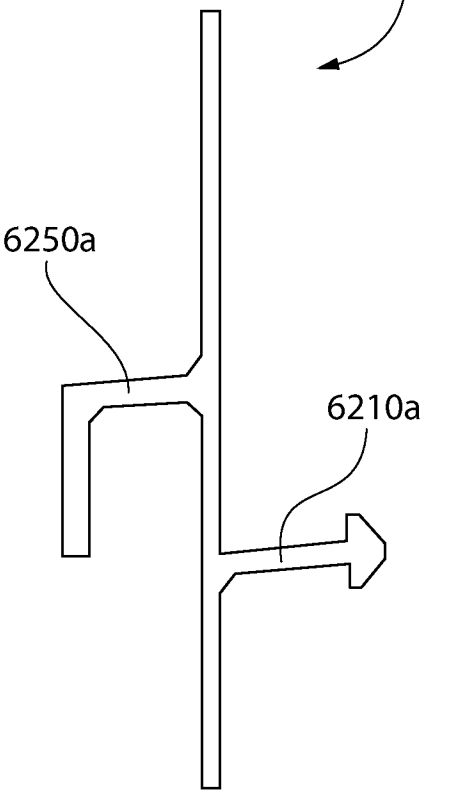
FIGS. 31A and 31B illustrate one alternative embodiment of a hanging element.
Figure 31A:
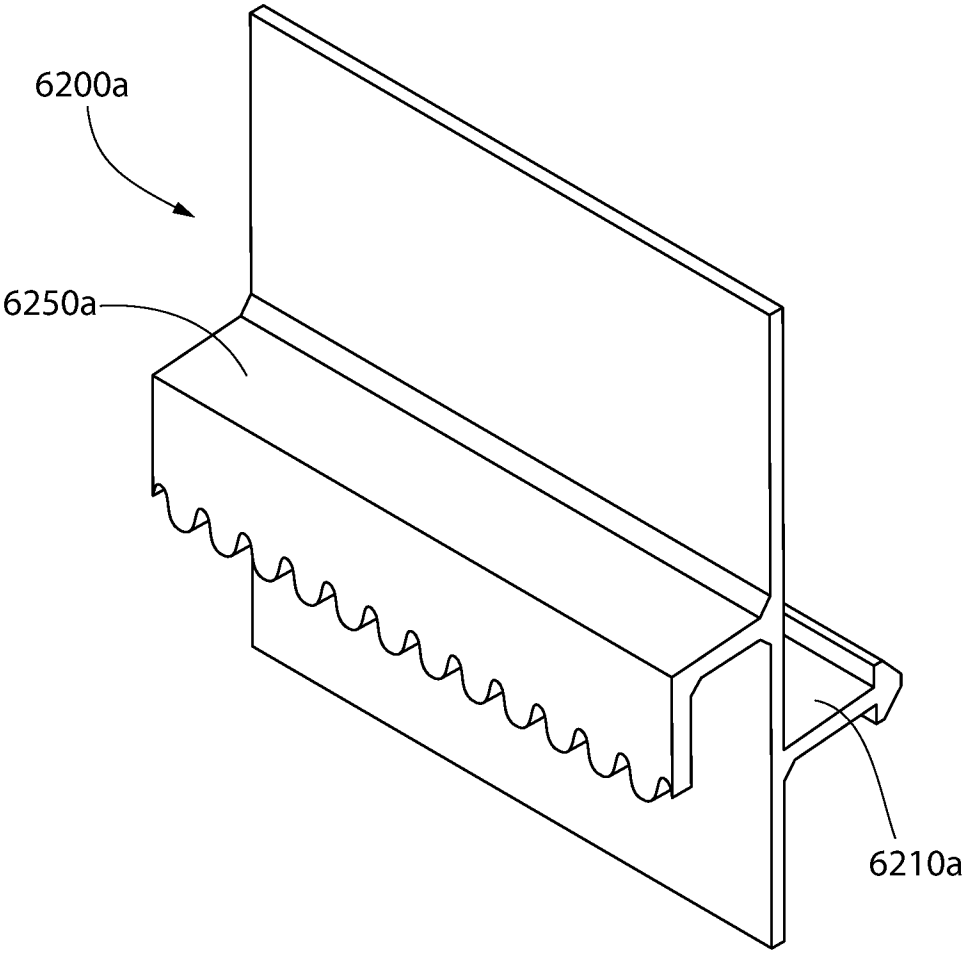

Referring to FIGS. 31A and 31B, a hanging element 6200*a* is illustrated. The hanging element 6200*a* comprises a coupling portion 6210*a* configured to couple the hanging element 6200*a* to a support structure (such as the support structure 6100) and a mounting element 6250*a* configured to couple the hanging element 6200*a* to a fastener that is protruding from a support surface. The main difference between this embodiment and the one previously described is that the first mounting element 6210*a* comprises a narrow portion and a thickened portion.

Figure 32B:
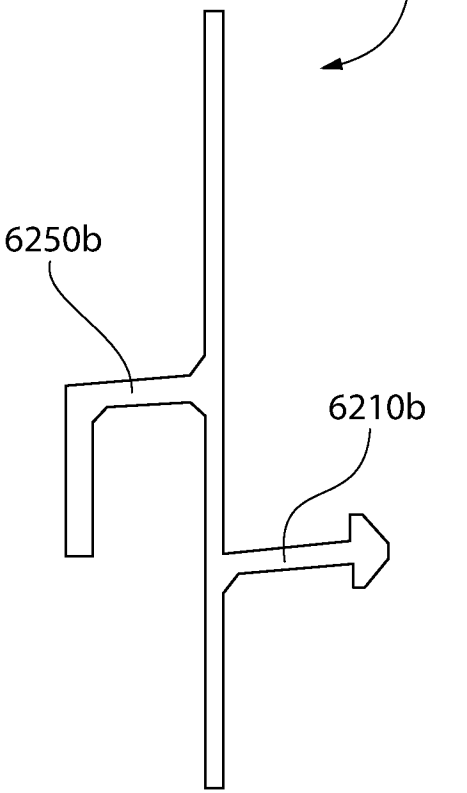
FIGS. 32A and 32B illustrate another alternative embodiment of a hanging element.
Figure 32A:
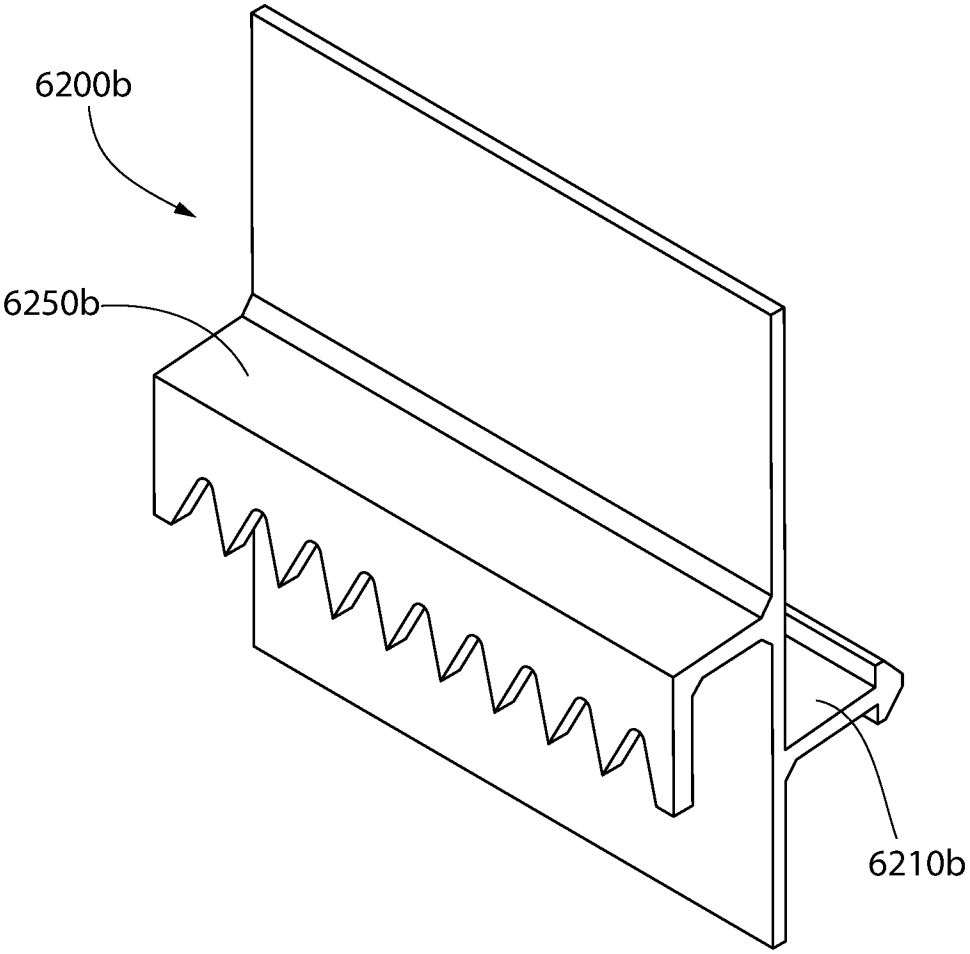

FIGS. 32A and 32B illustrate a hanging element 6200*b* comprising a coupling portion 6210*b* and a mounting portion 6250*b*. The hanging element 6200*b* is identical to the hanging element 6200*a* except that the configuration of the teeth/notches of the mounting portion 6250*b* are slightly modified. In this embodiment, the teeth/notches are more similar to those associated with a sawtooth hanger.

Figure 33B:
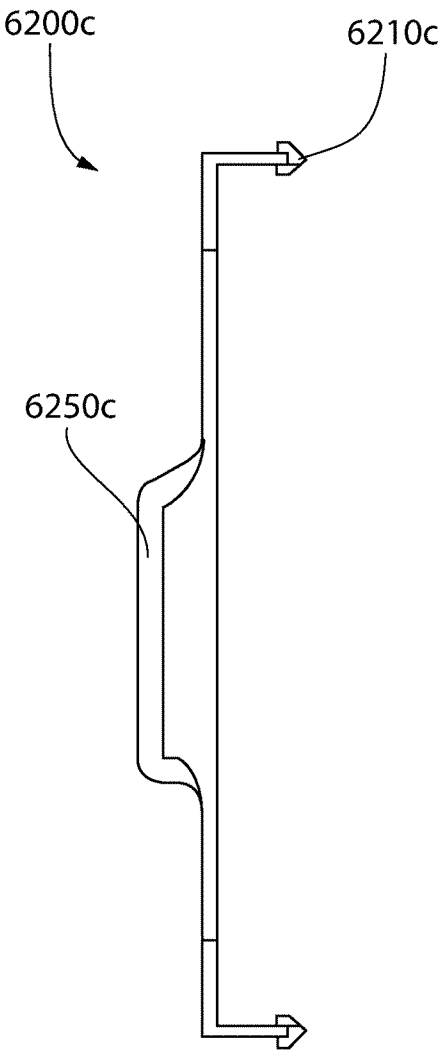
FIGS. 33A and 33B illustrate another alternative embodiment of a hanging element.
Figure 33A:
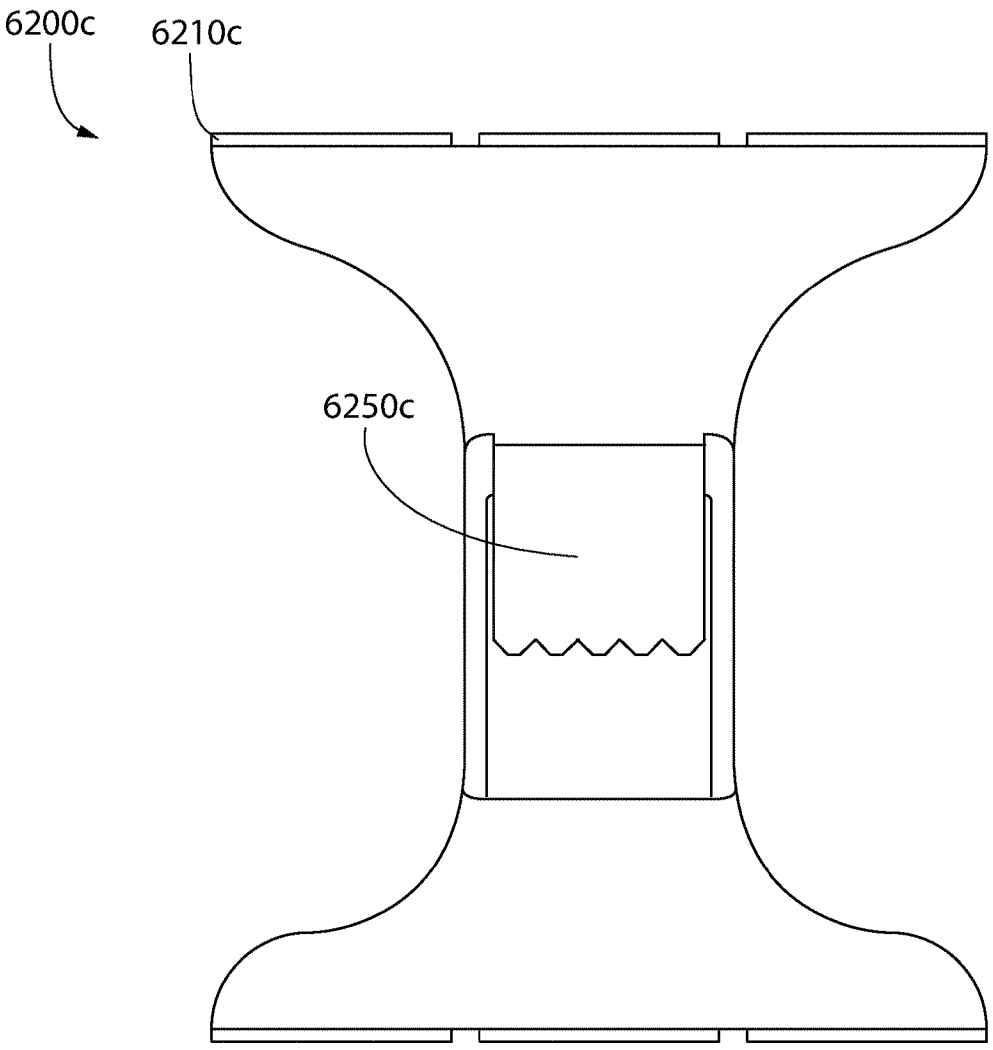

FIGS. 33A and 33B illustrate a hanging element 6200*c* comprising a coupling portion 6210*c* and a mounting portion 6250*c*. The hanging element 6200*c* is quite different in appearance than the hanging elements described previously in this document. Specifically, the coupling portion 6210*c* comprises two separate sections, each of which could be mounted to a support structure within a different slot. Specifically, one of the sections of the coupling portion 6210*c* could be positioned within a slot located adjacent to a top edge of a support structure while simultaneously another one of the sections of the coupling portion 6210*c* could be positioned within a slot located adjacent to a bottom edge of the support structure. The mounting portion 6250*c* is located between the two sections of the coupling portion 6210*c* and would be available to receive a fastener in a support surface.

Figure 34B:
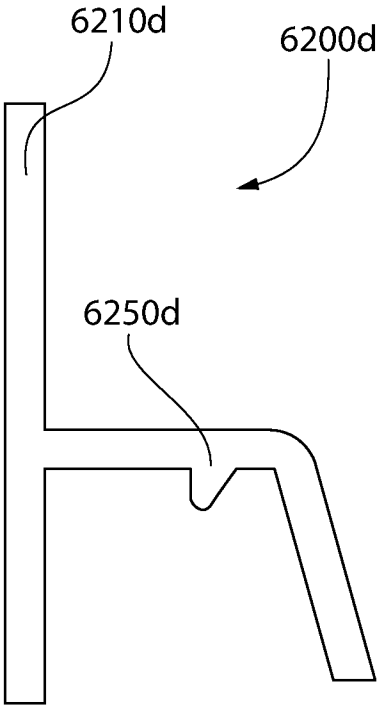
FIGS. 34A and 34B illustrate another alternative embodiment of a hanging element.
Figure 34A:
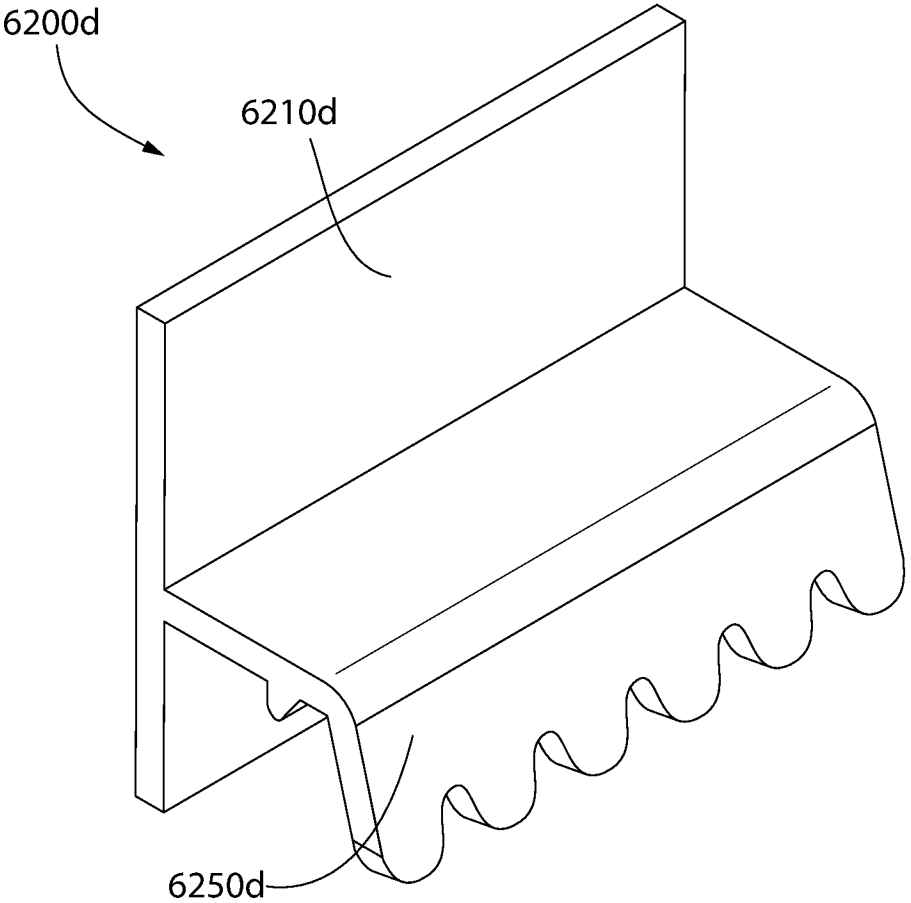

FIGS. 34A and 34B illustrate a hanging element 6200*d* comprising a coupling portion 6210*d* and a mounting portion 6250*d*. This variation is similar to the hanging element 6200*d* except some aspects of the hanging element 6200*d*, and more specifically some portions of the coupling portion 6210*d* of the hanging element 6200*d*, have been removed. However, the coupling portion 6210*d* is still configured to be coupled to the support structure within one of the slots as described previously.

Figure 35B:
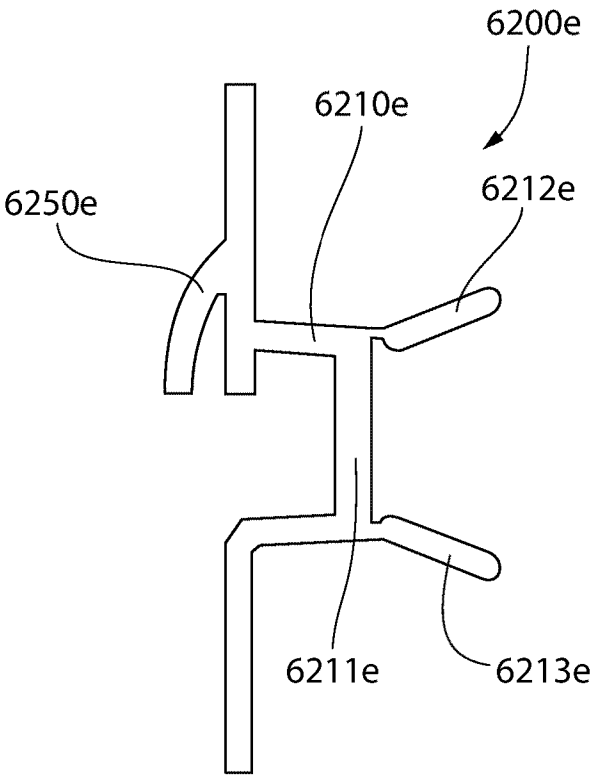
FIGS. 35A and 35B illustrate another alternative embodiment of a hanging element.
Figure 35A:
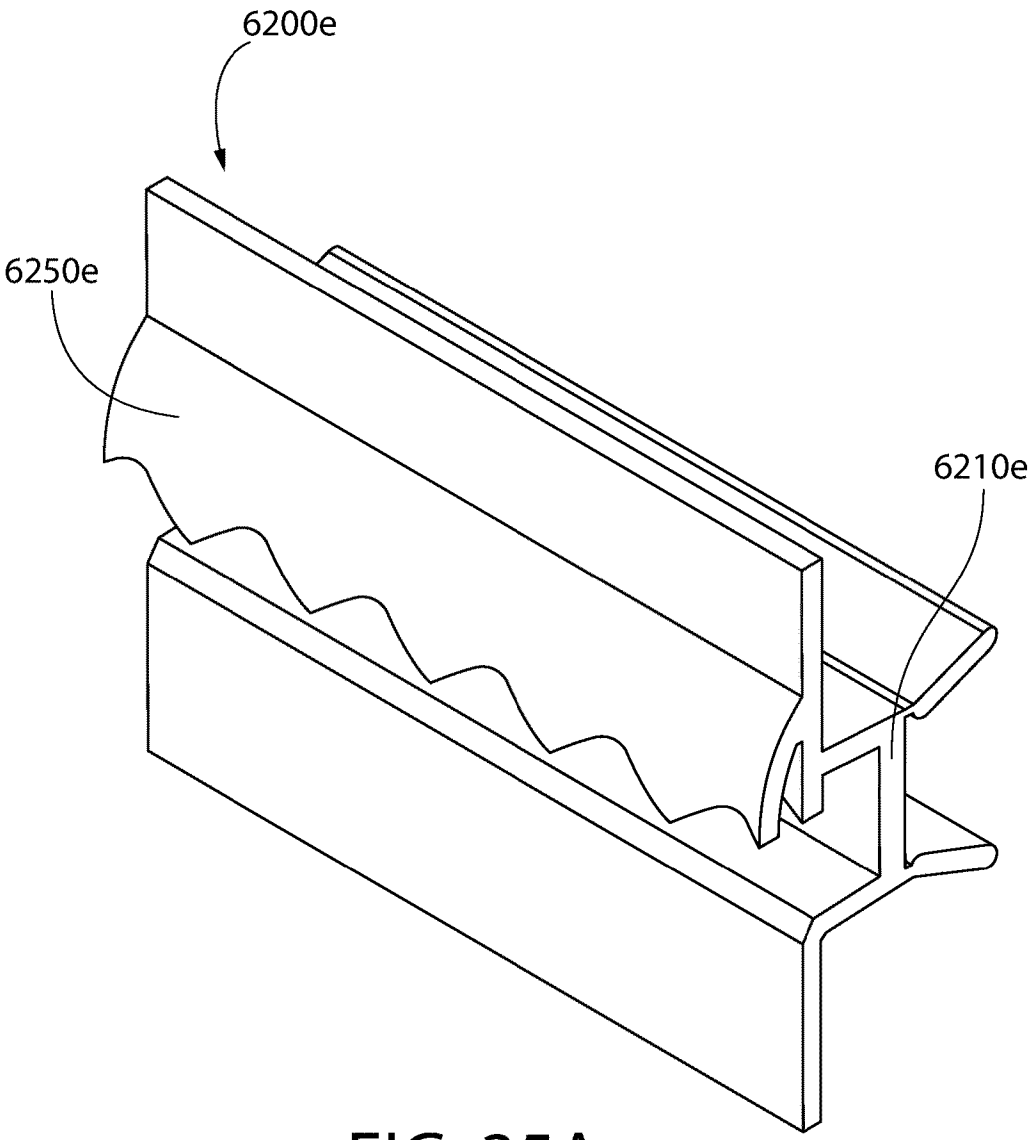

FIGS. 35A and 35B illustrate yet another embodiment of a hanging element 6200*e*. In this embodiment, the hanging element 6200*e* comprises a coupling portion 6210*e* for coupling the hanging element 6200*e* to a support structure and a mounting portion 6250*e* for coupling the hanging element 6200*e* to a fastener on a support surface. In this embodiment, the coupling portion 6210*e* comprises a first portion 6211*e*, a second portion 6212*e*, and a third portion 6213*e*. The second and third portions 6212*e*, 6213*e* are movably/pivotably coupled to the first portion 6211*e* to permit the coupling portion 6210*e* to pass through one of the slots to couple the hanging element 6200*e* to a support structure. In the exemplified embodiment, the second and third portions 6212*e*, 6213*e* are coupled to the first portion 6211*e* by a living hinge, although this is not required in all embodiments.

Figure 36B:
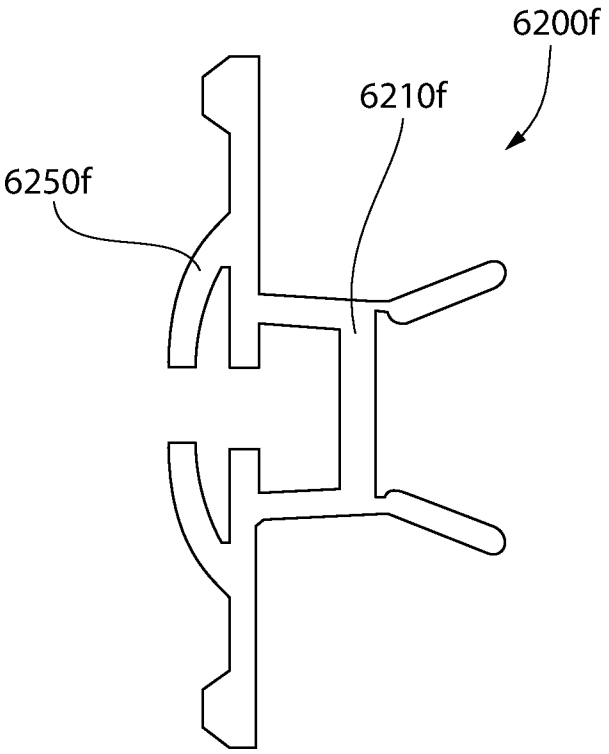
FIGS. 36A and 36B illustrate another alternative embodiment of a hanging element.
Figure 36A:
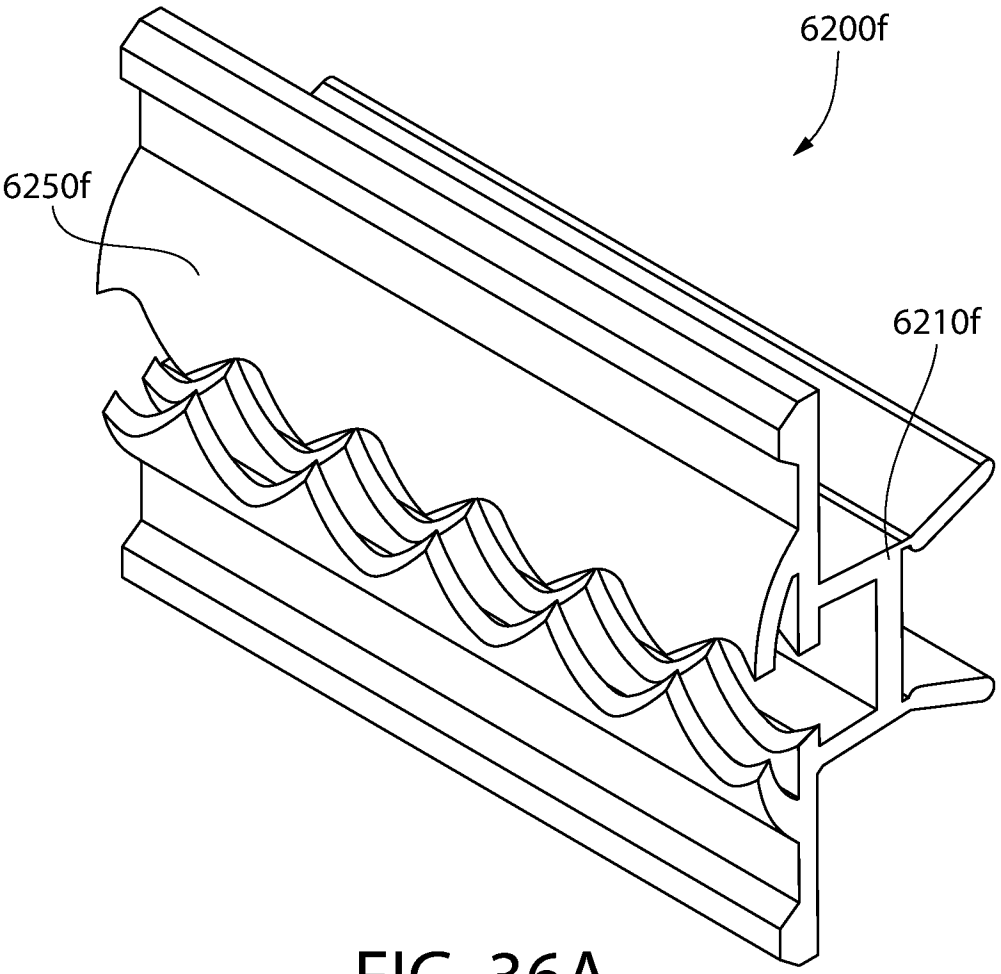

Referring to FIGS. 36A and 36B, yet another embodiment of a hanging element 6200*f* is illustrated. The hanging element 6200*f* comprises a coupling portion 6210*f* for coupling the hanging element 6200*f* to a support structure and a mounting portion 6250*f* for coupling the hanging element 6200*f* to a support surface. The coupling portion 6210*f* comprises a living hinge type configuration as with the hanging element 6200*e* described above. However, in this embodiment the mounting portion 6250*f* comprises a symmetric design that is different from those previously shown and described.

Figure 37B:
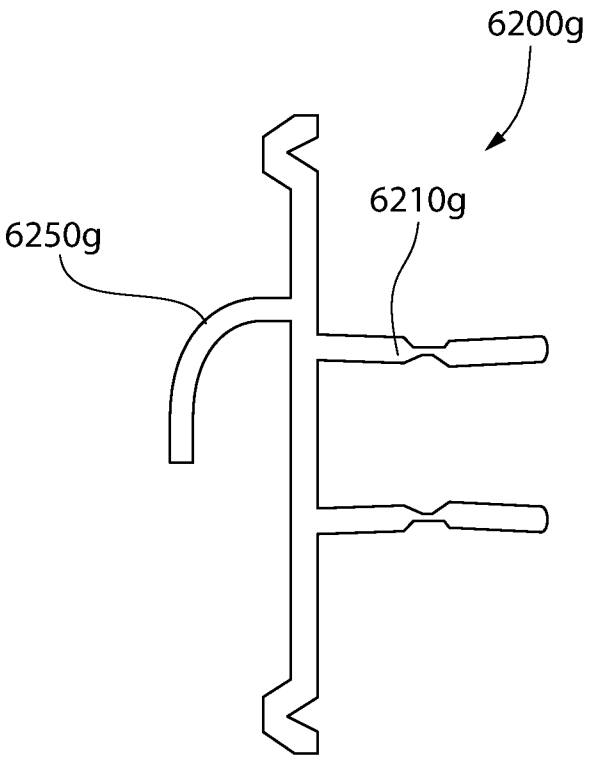
FIGS. 37A and 37B illustrate another alternative embodiment of a hanging element.
Figure 37A:
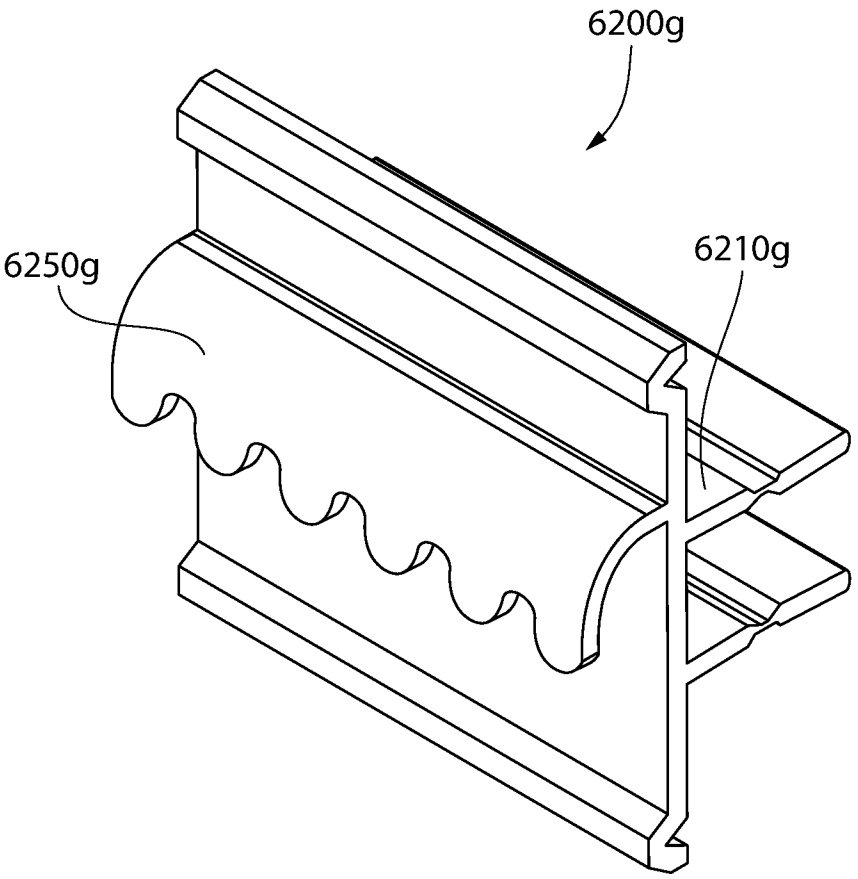

FIGS. 37A and 37B illustrate still another embodiment of a hanging element 6200*g*. The hanging element 6200*g* comprises a coupling portion 6210*g* for coupling the hanging element 6200*g* to a support structure and a mounting portion 6250*g* for coupling the hanging element 6200*g* to a support surface. The coupling portion 6210*g* comprises a living hinge type configuration similar to that which was described above.

Figure 38B:
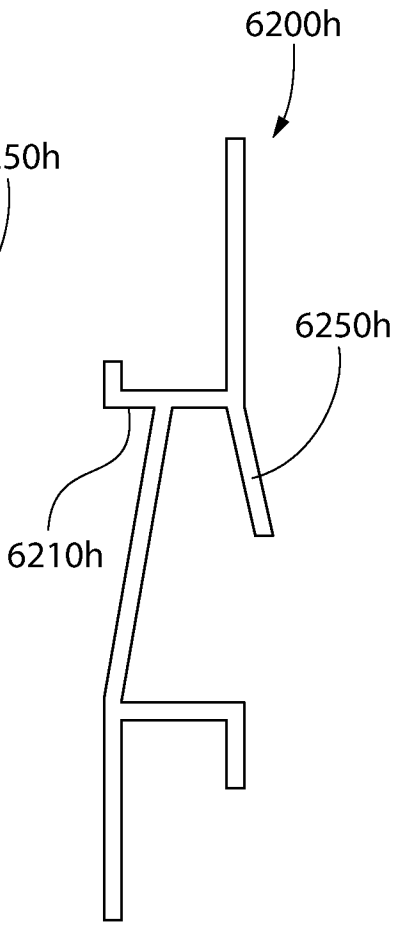
FIGS. 38A and 38B illustrate another alternative embodiment of a hanging element.
Figure 38A:
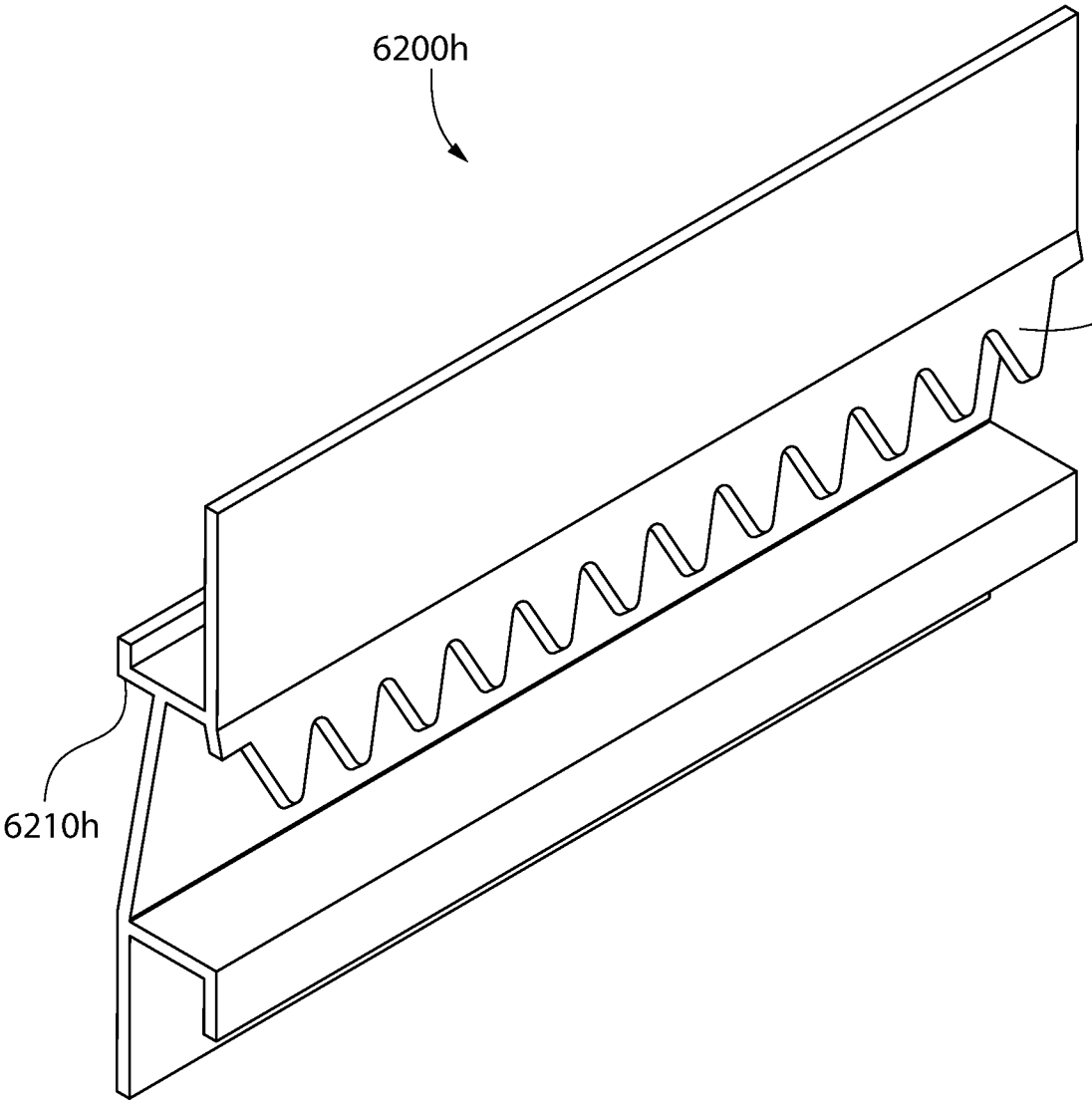

FIGS. 38A and 38B illustrate another embodiment of a hanging element 6200*h*. The hanging element 6200*h* comprises a coupling portion 6210*h* for coupling the hanging element 6200*h* to a support structure and a mounting element 6250*h* for coupling the hanging element 6200*h* to a support surface.

Figure 39B:
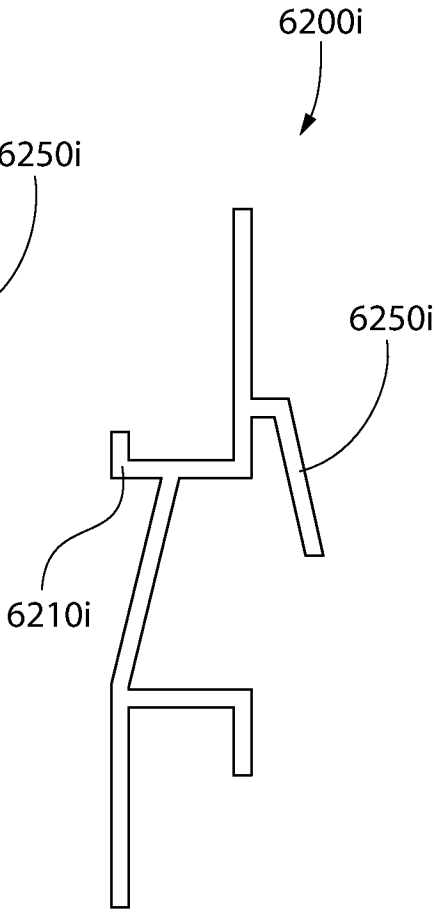
FIGS. 39A and 39B illustrate another alternative embodiment of a hanging element.
Figure 39A:
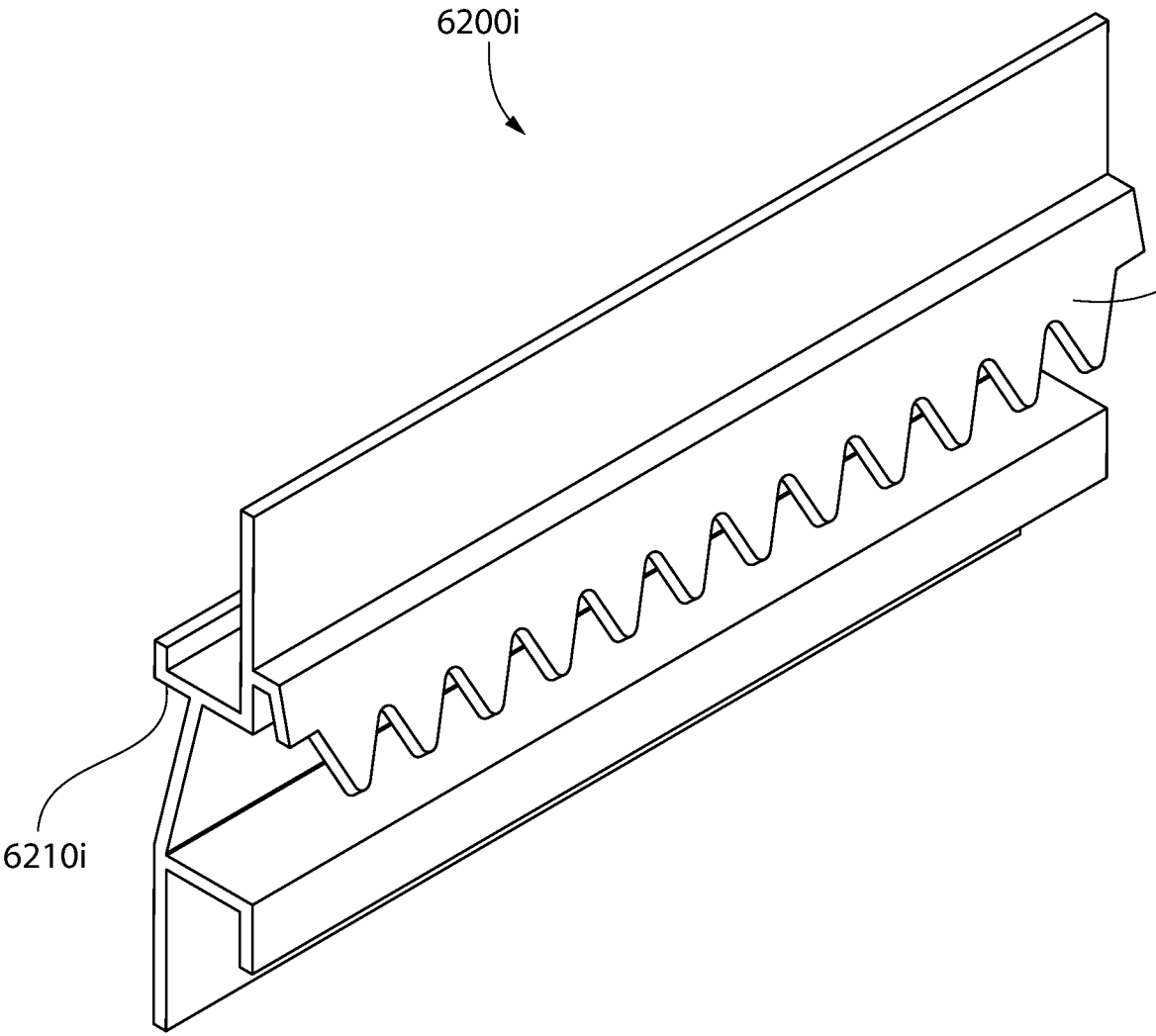

FIGS. 39A and 39B illustrate another embodiment of a hanging element 6200*i*. The hanging element 6200*i* comprises a coupling portion 6210*i* for coupling the hanging element 6200*i* to a support structure and a mounting element 6250*i* for coupling the hanging element 6200*i* to a support surface.

Figure 40B:
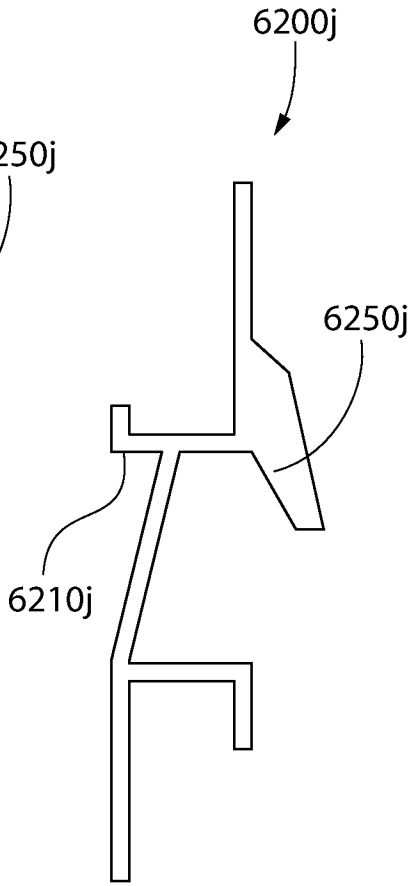
FIGS. 40A and 40B illustrate another alternative embodiment of a hanging element.
Figure 40A:
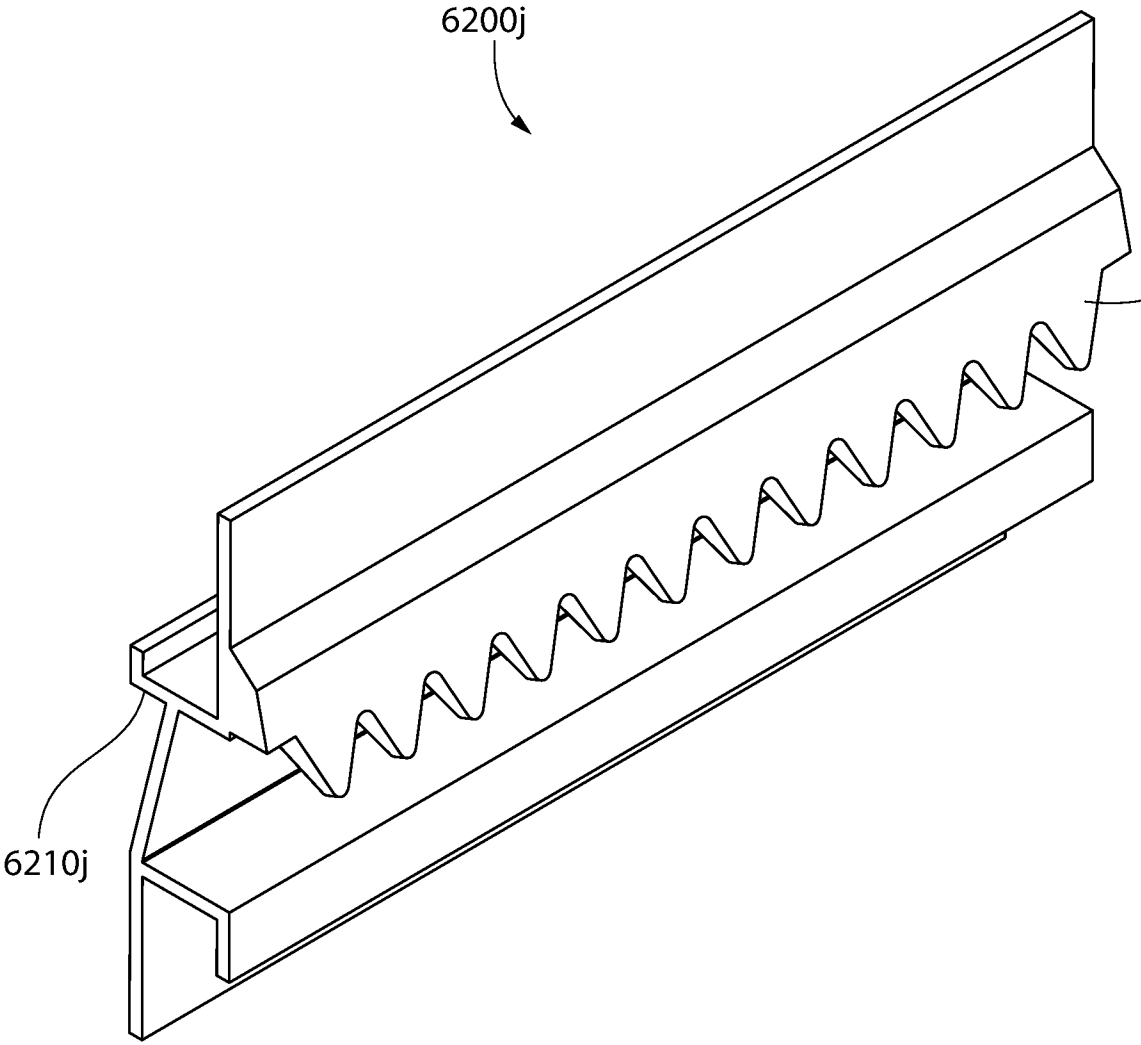

FIGS. 40A and 40B illustrate another embodiment of a hanging element 6200*j*. The hanging element 6200*j* comprises a coupling portion 6210*j* for coupling the hanging element 6200*j* to a support structure and a mounting element 6250*j* for coupling the hanging element 6200*j* to a support surface.

The concepts described herein and shown in the drawings can be used for the hanging of posters, wall frames, mirrors, canvas-type articles, artwork, or the like from a support surface such as a wall or the like. Thus, the disclosure set forth herein is not limited to use with standard rigid frames but can be used with a variety of different items that are hung from a wall for display or other purposes. It is also possible to utilize the concepts disclosed herein to hang cabinets, shelves, and other articles that are generally hung from a wall or wall-like support surface.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A frame apparatus for displaying an article, the frame apparatus comprising:

a frame comprising a rabbet;

a backer panel positioned in the rabbet of the frame;

a plurality of slots formed into the backer panel, each of the slots being an aperture that extends through the backer panel from a front surface of the backer panel to a rear surface of the backer panel, the plurality of slots comprising:

at least one slot that is elongated along a first axis; and at least one slot that is elongated along a second axis that is perpendicular to the first axis; and at least one hanging element slidably coupled to the backer panel within one of the at least one slots, the at least one hanging element comprising:

a coupling portion having a first portion disposed within the one of the at least one slots and a second portion adjacent to the front surface of the backer panel; and a mounting portion protruding from the rear surface of the backer panel for hanging the frame apparatus from a support surface.

2. The frame apparatus according to claim 1 wherein the hanging element is slidable within the one of the at least one slots along a respective one of the first and second axes while remaining coupled to the backer panel.

3. The frame apparatus according to claim 1 further comprising:

the frame comprising a top edge, a bottom edge opposite the top edge, a first lateral edge, and a second lateral edge opposite the first lateral edge;

wherein the at least one slot that is elongated along the first axis is located adjacent to one of the top and bottom edges of the frame and the first axis is parallel to the one of the top and bottom edges of the frame; and wherein the at least one slot that is elongated along the second axis is located adjacent to one of the first and second lateral edges of the frame and the second axis is parallel to the one of first and second lateral edges of the frame.

4. The frame apparatus according to claim 1 wherein each of the plurality of slots has a length and the hanging element has a length, the length of the hanging element being less than the length of each of the plurality of slots.

5. The frame apparatus according to claim 1 wherein the at least one slot that is elongated along the first axis does not intersect the at least one slot that is elongated along the second axis.

6. The frame apparatus according to claim 1 wherein an entirety of the at least one hanging element is spaced apart from the frame when slidably coupled to the backer panel.

7. The frame apparatus according to claim 1 further comprising a stack located within the rabbet of the frame, the stack comprising the backer panel and a glazing, wherein the rear surface of the backer panel is exposed along a rear of the frame, and wherein the hanging element extends through the one of the at least one slots so that the second portion of the coupling portion of the hanging element is positioned between the front surface of the backer panel and the glazing.

8. The frame apparatus according to claim 1 wherein the backer panel is a separate component from the frame such that the backer panel is removably positioned in the rabbet of the frame.

9. The frame apparatus according to claim 1 further comprising:

wherein the frame comprises:

a top edge, a bottom edge opposite the top edge, a first lateral edge, and a second lateral edge opposite the first lateral edge;

a longitudinal axis that is parallel to the second axis and is equidistant from the first and second lateral edges; and a transverse axis that is parallel to the first axis and is equidistant from the top and bottom edges; and wherein the plurality of slots comprises a first set of slots that extend in a direction parallel to the transverse axis and a second set of slots that extend in a direction parallel to the longitudinal axis, wherein the first set of slots are all located on a same side of the transverse axis at different distances from the top edge of the frame and the second set of slots are all located on a same side of the longitudinal axis at different distances from the first lateral edge of the frame.

10. The frame apparatus according to claim 1 wherein the coupling portion of the at least one hanging element comprises the second portion and a third portion which extend from the first portion in opposite directions, the first and second portions being adjacent to the front surface of the backer panel on opposite sides of the first axis when the at least one hanging element is slidably coupled to the backer panel within the at least one slot that is elongated along the first axis, and the first and second portions being adjacent to the front surface of the backer panel on opposite sides of the second axis when the at least one hanging element is slidably coupled to the backer panel within the at least one slot that is elongated along the second axis.

11. The frame apparatus according to claim 1 wherein the mounting portion of the hanging element comprises a plurality of spaced apart receiving notches each of which is configured to receive a portion of a fastener that is protruding from the support surface.

12. The frame apparatus according to claim 1 wherein each of the plurality of slots comprises an upper edge having a plurality of spaced apart receiving notches, each of the receiving notches being configured to receive a portion of a fastener that is coupled to the support surface to hang the frame apparatus from the support surface.

13. A frame apparatus for displaying an article, the frame apparatus comprising:

a support structure comprising a rear surface;

a plurality of slots located on the rear surface of the support structure, the plurality of slots comprising:

at least one slot that is elongated along a first axis, the at least one slot that is elongated along the first axis comprising a first slot and a second slot located adjacent to a top edge of the support structure, the first and second slots being distinct and spaced apart from one another along the first axis;

a third slot located adjacent to a bottom edge of the support structure and being elongated along a third axis that is parallel to the first axis;

at least one slot that is elongated along a second axis that is perpendicular to the first axis, the at least one slot that is elongated along the second axis comprising a fourth slot and a fifth slot located adjacent to a first lateral edge of the support structure, the fourth and fifth slots being distinct and spaced apart from one another along the second axis; and a sixth slot located adjacent to a second lateral edge of the support structure and being elongated along a fourth axis that is parallel to the second axis; and at least one hanging element slidably coupled to the support structure within one of the first, second, third, fourth, fifth, and sixth slots, the at least one hanging element comprising a mounting portion for hanging the support structure from a support surface.

14. The frame apparatus according to claim 13 wherein the third slot is aligned with each of the first and second slots and with a gap that exists between the first and second slots, and wherein the sixth slot is aligned with each of the fourth and fifth slots and with a gap that exists between the fourth and fifth slots.

15. The frame apparatus according to claim 13 wherein the support structure comprises a frame having a rabbet and a backer panel positioned in the rabbet of the frame, the plurality of slots being apertures extending through the backer panel from a front surface of the backer panel to a rear surface of the backer panel, wherein an entirety of the at least one hanging element is spaced apart from the frame when slidably coupled to the support structure, and wherein the hanging element is slidable within the one of the first, second, third, fourth, fifth, and sixth slots in a direction of a respective one of the first, second, third, and fourth axes while remaining coupled to the support structure.

16. A frame apparatus for displaying an article, the frame apparatus comprising:

a frame;

a backer panel coupled to the frame, the backer panel comprising a front surface and a rear surface opposite the front surface;

a plurality of slots in the backer panel, each of the slots forming an aperture that extends through the backer panel from the front surface of the backer panel to the rear surface of the backer panel, the plurality of slots comprising:

at least one slot that is elongated along a first axis; and at least one slot that is elongated along a second axis that is perpendicular to the first axis; and at least one hanging element coupled to the backer panel within one of the at least one slots and being slidable relative to the backer panel along a respective one of the first and second axes, the at least one hanging element comprising a mounting portion that is spaced apart from the backer panel to hang the frame apparatus from a support surface, wherein an entirety of the at least one hanging element is spaced apart from the frame when coupled to the backer panel.

17. The frame apparatus according to claim 16 wherein the plurality of slots comprises:

the at least one slot that is elongated along the first axis comprising a first slot and a second slot that are elongated along the first axis and spaced apart by a gap;

a third slot that is elongated along a third axis that is parallel to the first axis;

the at least one slot that is elongated along the second axis comprising a fourth slot and a fifth slot that are elongated along the second axis and spaced apart by a gap; and a sixth slot that is elongated along a fourth axis that is parallel to the second axis.

18. The frame apparatus according to claim 17 wherein the frame comprises a transverse axis that is parallel to and equidistant from the first and third axes and a longitudinal axis that is parallel to and equidistant from the second and fourth axes, and wherein the first and second slots are located on an opposite side of the transverse axis than the third slot and wherein the fourth and fifth slots are located on an opposite side of the longitudinal axis than the sixth slot.

19. The frame apparatus according to claim 16 wherein the frame comprises a transverse axis that is parallel to the first axis and a longitudinal axis that is parallel to the second axis, wherein the plurality of slots comprises a first set of slots that extend in a direction parallel to the transverse axis and a second set of slots that extend in a direction parallel to the longitudinal axis, wherein the first set of slots are all located on a same side of the transverse axis at different distances from the transverse axis, and wherein the second set of slots are all located on a same side of the longitudinal axis at different distances from the longitudinal axis.

20. The frame apparatus according to claim 16 further comprising:

the frame comprises an inner surface defining a display opening and a rabbet defined by a floor and a wall of the frame;

a stack comprising the backer panel and a glazing positioned within the rabbet of the frame; and wherein the hanging element extends through the one of the at least one slots so that at least a portion of the hanging element is located between the backer panel and the glazing to couple the hanging element to the backer panel.

* * * * *